US008113630B2

(12) United States Patent
Suzuki et al.

(10) Patent No.: US 8,113,630 B2
(45) Date of Patent: Feb. 14, 2012

(54) METHOD, HEAD, AND APPARATUS FOR EJECTING LIQUID

(75) Inventors: Yoshiyuki Suzuki, Tino (JP); Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 199 days.

(21) Appl. No.: 12/394,155

(22) Filed: Feb. 27, 2009

(65) Prior Publication Data

US 2009/0219313 A1 Sep. 3, 2009

(30) Foreign Application Priority Data

Feb. 29, 2008 (JP) ..... 2008-050545
Nov. 28, 2008 (JP) ..... 2008-305332

(51) Int. Cl.
*B41J 2/045* (2006.01)
*B41J 2/17* (2006.01)

(52) U.S. Cl. ..... 347/68; 347/70; 347/94

(58) Field of Classification Search ..... 347/47, 347/68–72, 100, 65, 94
See application file for complete search history.

(56) References Cited

U.S. PATENT DOCUMENTS

| | | | | |
|---|---|---|---|---|
| 5,933,168 | A * | 8/1999 | Sakai | 347/70 |
| 6,517,199 | B1 * | 2/2003 | Tomioka et al. | 347/101 |
| 6,685,305 | B2 * | 2/2004 | Okuda | 347/71 |
| 7,562,428 | B2 | 7/2009 | Shinkai | |
| 2007/0159511 | A1 | 7/2007 | Shinkai | |

FOREIGN PATENT DOCUMENTS

| | | |
|---|---|---|
| CN | 2715991 Y | 8/2005 |
| JP | 2005-034998 | 2/2005 |

* cited by examiner

*Primary Examiner* — Geoffrey Mruk
(74) *Attorney, Agent, or Firm* — Workman Nydegger

(57) ABSTRACT

A liquid ejecting method includes ejecting a liquid through a liquid ejecting head. Viscosity of the liquid falls within a range from 6 mPa·s to 15 mPa·s. The liquid ejecting head includes a nozzle that ejects the liquid, a pressure compartment that causes a change in the pressure of the liquid to eject the liquid through the nozzle, and a supply unit that communicates with the pressure compartment and supplies the liquid to the pressure compartment. A channel flow resistance of the supply unit ranges from equal to or higher than a channel flow resistance of the pressure compartment to equal to or lower than twice the channel flow resistance of the pressure compartment. A channel length of the pressure compartment ranges from equal to or longer than a channel length of the supply unit to equal to or shorter than twice the channel length of the supply unit.

15 Claims, 37 Drawing Sheets

METHOD, HEAD, AND APPARATUS FOR EJECTING LIQUID

BACKGROUND

1. Technical Field

The present invention relates to a liquid ejecting method, a liquid ejecting head, and a liquid ejecting apparatus.

2. Related Art

Liquid ejecting apparatuses such as ink jet printers include a liquid ejecting head including a nozzle that ejects a liquid, a pressure compartment that gives a change in the pressure of the liquid in order to cause the liquid to be ejected through the nozzle, a supply unit that supplies the liquid stored in a reservoir to the pressure compartment (as disclosed in JP-A-2005-34998). A size of a liquid channel in the liquid ejecting head is determined based on the premise that a liquid having viscosity close to viscosity of water is handled.

Attempts have been recently made to use ink jet technique to eject a liquid higher in viscosity than generally available ink. It has been learned that the ejection of the liquid becomes unstable if a high viscosity liquid is ejected through a head having a known structure. For example, a flight trajectory of the liquid is curved, or an insufficient amount of ink is ejected.

SUMMARY

An advantage of some aspects of the invention is that ejection of a liquid higher in viscosity than a generally available ink is stabilized.

According to one aspect of the invention, a liquid ejecting method, includes ejecting a liquid through a liquid ejecting head. Viscosity of the liquid falls within a range of from equal to or higher than 6 mPa·s to equal to or lower than 15 mPa·s. The liquid ejecting head includes a nozzle that ejects the liquid, a pressure compartment that causes a change in the pressure of the liquid in order to eject the liquid through the nozzle, and a supply unit that communicates with the pressure compartment and supplies the liquid to the pressure compartment. A channel flow resistance of the supply unit falls within a range of from equal to or higher than a channel flow resistance of the pressure compartment to equal to or lower than twice the channel flow resistance of the pressure compartment. A channel length of the pressure compartment falls within a range of from equal to or longer than a channel length of the supply unit to equal to or shorter than twice the channel length of the supply unit.

These and other features of the invention will become apparent from the following description of embodiments with reference to the drawings.

BRIEF DESCRIPTION OF THE DRAWINGS

The invention will be described with reference to accompanying drawings, wherein like numbers reference like elements.

DESCRIPTION OF EXEMPLARY EMBODIMENTS

Figure 1:
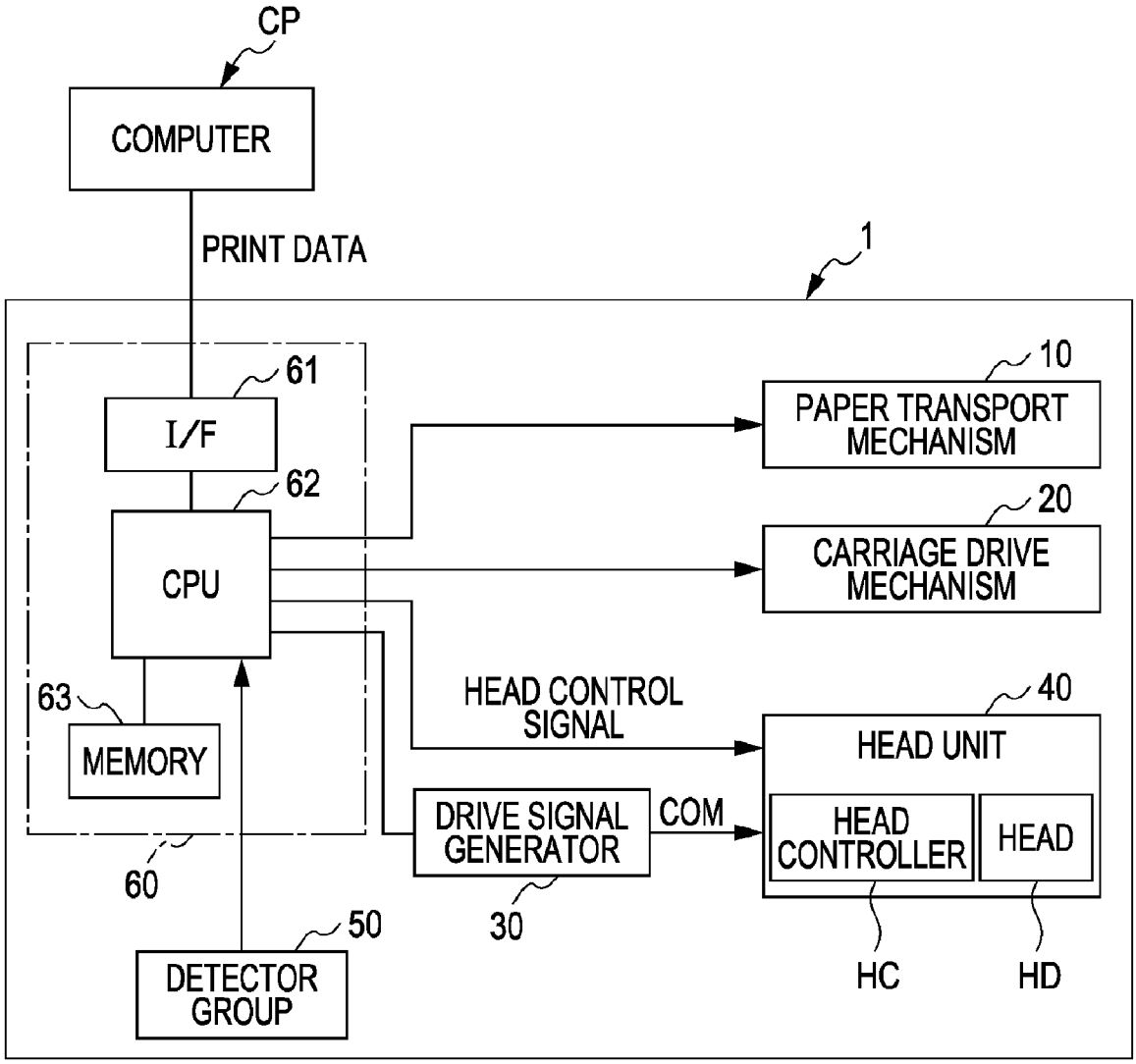
FIG. 1 is a block diagram illustrating a printing system in accordance with one embodiment of the invention.

The embodiments of the invention are described below.

A liquid ejecting method of one embodiment of the invention includes ejecting a liquid through a liquid ejecting head. Viscosity of the liquid falls within a range of from equal to or higher than 6 mPa·s to equal to or lower than 15 mPa·s. The liquid ejecting head includes a nozzle that ejects the liquid, a pressure compartment that causes a change in the pressure of the liquid in order to eject the liquid through the nozzle, and a supply unit that communicates with the pressure compartment and supplies the liquid to the pressure compartment. A channel flow resistance of the supply unit falls within a range of from equal to or higher than a channel flow resistance of the pressure compartment to equal to or lower than twice the channel flow resistance of the pressure compartment. A channel length of the pressure compartment falls within a range of from equal to or longer than a channel length of the supply unit to equal to or shorter than twice the channel length of the supply unit.

In accordance with the liquid ejecting method, a vibration persisting even after the ejection of the liquid is quickly settled. As a result, the ejection of a high-viscosity liquid is stabilized.

A channel flow resistance of the nozzle is preferably higher than the channel flow resistance of the supply unit.

In accordance with the liquid ejecting method, an insufficient supply of the liquid to the pressure compartment is controlled.

Inertance of the nozzle is preferably lower than inertance of the supply unit.

In accordance with the liquid ejecting method, a pressure vibration provided to the liquid causes the liquid to be ejected efficiently.

The channel flow resistance of the supply unit preferably falls within a range of from equal to or higher than $1.73\times10^{12}$ Pa·s/m$^3$ to equal to or lower than $3.46\times10^{12}$ Pa·s/m$^3$, and the channel length of the pressure compartment preferably falls within a range of from equal to or longer than 500 μm to equal to or shorter than 1000 μm.

In accordance with the liquid ejecting method, an amount of liquid of about 10 ng can be ejected through the nozzle.

A diameter of the nozzle may fall within a range of from equal to or larger than 10 μm to equal to or smaller than 40 μm, and a length of the nozzle may fall within a range of from equal to or longer than 40 μm to equal to or shorter than 100 μm.

In accordance with the liquid ejecting method, an amount of liquid of about 10 ng can be ejected through the nozzle.

The pressure compartment preferably includes a section, the section changing the shape thereof to cause a change in the pressure of the liquid.

In accordance with the liquid ejecting method, a pressure change is efficiently conveyed to the liquid within the pressure compartment.

The liquid ejecting head preferably includes an element that changes the section in shape in response to a change pattern of a voltage of an applied ejection pulse.

In accordance with the liquid ejecting method, the pressure of the liquid within the pressure compartment is precisely controlled.

A liquid ejecting head of one embodiment of the invention includes a nozzle that ejects a liquid, a pressure compartment that causes a change in the pressure of the liquid in order to eject the liquid through the nozzle, and a supply unit that communicates with the pressure compartment and supplies the liquid to the pressure compartment. A channel flow resistance of the supply unit falls within a range of from equal to or higher than a channel flow resistance of the pressure compartment to equal to or lower than twice the channel flow resistance of the pressure compartment. A channel length of the pressure compartment falls within a range of from equal to or longer than a channel length of the supply unit to equal to or shorter than twice the channel length of the supply unit.

A liquid ejecting apparatus of one embodiment of the invention includes an ejection pulse generator that generates an ejection pulse, and a liquid ejecting head that ejects a liquid through a nozzle. The liquid ejecting head includes a pressure compartment that changes a shape of a section to cause a change in the pressure of the liquid so that the liquid is ejected through the nozzle, an element that changes the shape of the section in response to a change pattern of a voltage of an applied ejection pulse, a supply unit that communicates with the pressure compartment and supplies the liquid to the pressure compartment. A channel length of the pressure compartment falls within a range of from equal to or longer than a channel length of the supply unit to equal to or shorter than twice the channel length of the supply unit.

Printing System

A printing system illustrated in FIG. 1 includes a printer 1 and a computer CP. The printer 1 corresponds to the liquid ejecting apparatus and ejects ink as a kind of liquid to a medium such as a paper sheet, cloth, and film. The medium is a target to which the liquid is ejected. The computer CP is communicably connected to the printer 1. To cause the printer 1 to print an image, the computer CP transmits to the printer 1 print data of the image.

Printer 1

The printer 1 includes a paper transport mechanism 10, a carriage drive mechanism 20, a drive signal generator 30, a head unit 40, a detector group 50, and a printer controller 60.

Figure 4:
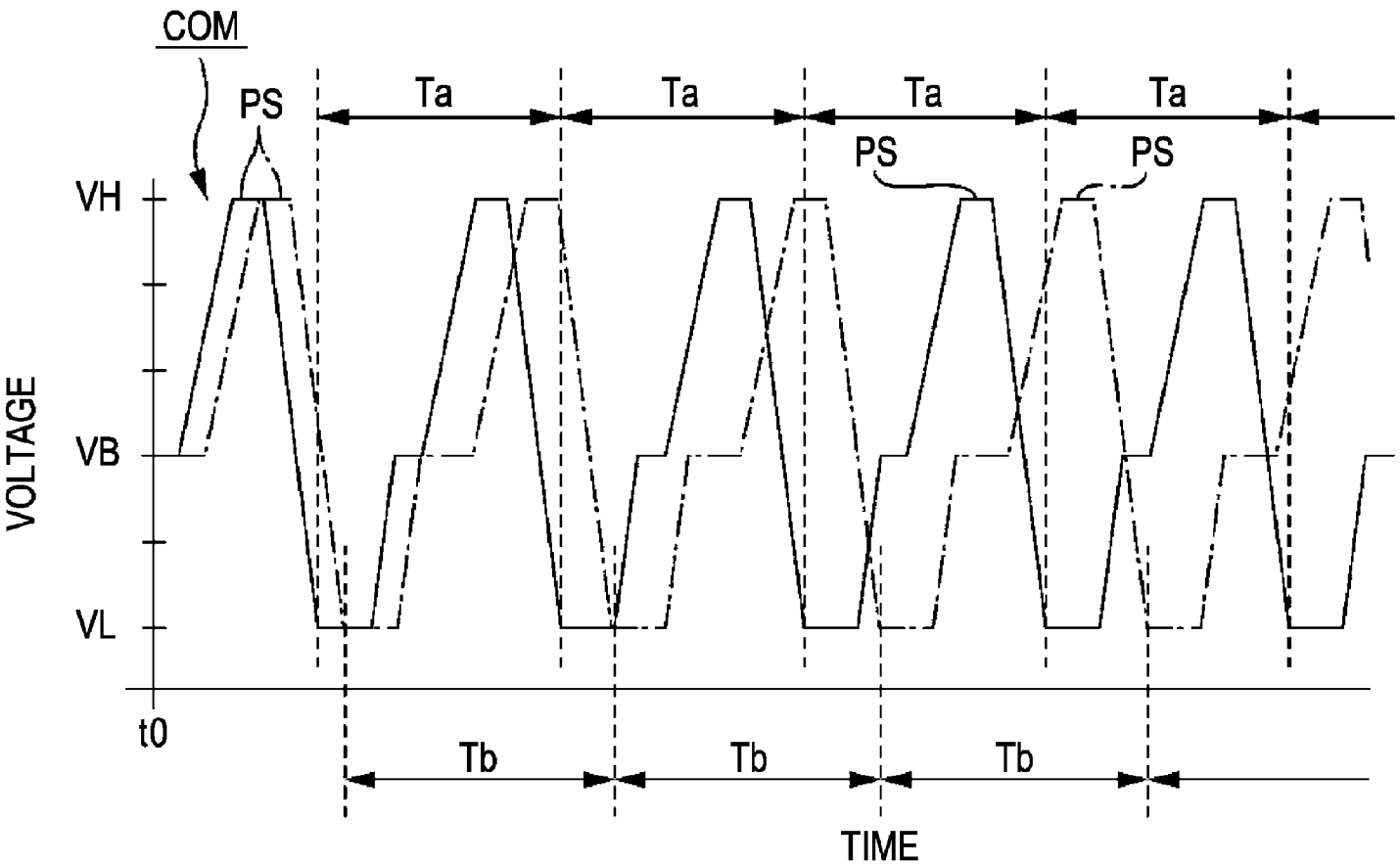
FIG. 4 illustrates a driving signal.

The paper transport mechanism 10 transports paper sheets in a transport direction. The carriage drive mechanism 20 moves a carriage supporting the head unit 40 in a predetermined movement direction (in a direction of width of the paper sheet). The drive signal generator 30 generates a drive signal COM. The drive signal COM is applied to a head HD (piezoelectric elements 433 illustrated in FIG. 2A) during printing to the paper sheet, and is a series of signals including an ejection pulse PS as illustrated in FIG. 4. The ejection pulse PS is a change pattern of voltage for the piezoelectric element 433 so that the head HD ejects drops of ink. Since the drive signal COM contains the ejection pulse PS, the drive signal generator 30 corresponds to an ejection pulse generator. The structure of the drive signal generator 30 and the ejection pulse PS will be described later. The head unit 40 includes the head HD and a head controller HC. The head HD is one type of liquid ejecting head, and ejects ink to a paper sheet. The head controller HC controls the head HD in response to a head control signal from the printer controller 60. The head HD will be also described later. The detector group 50 includes a plurality of detectors monitoring the status of the printer 1. Detection results of the detectors are output to the printer controller 60. The printer controller 60 generally controls the printer 1. The printer controller 60 will also be described later.

Figure 2A:
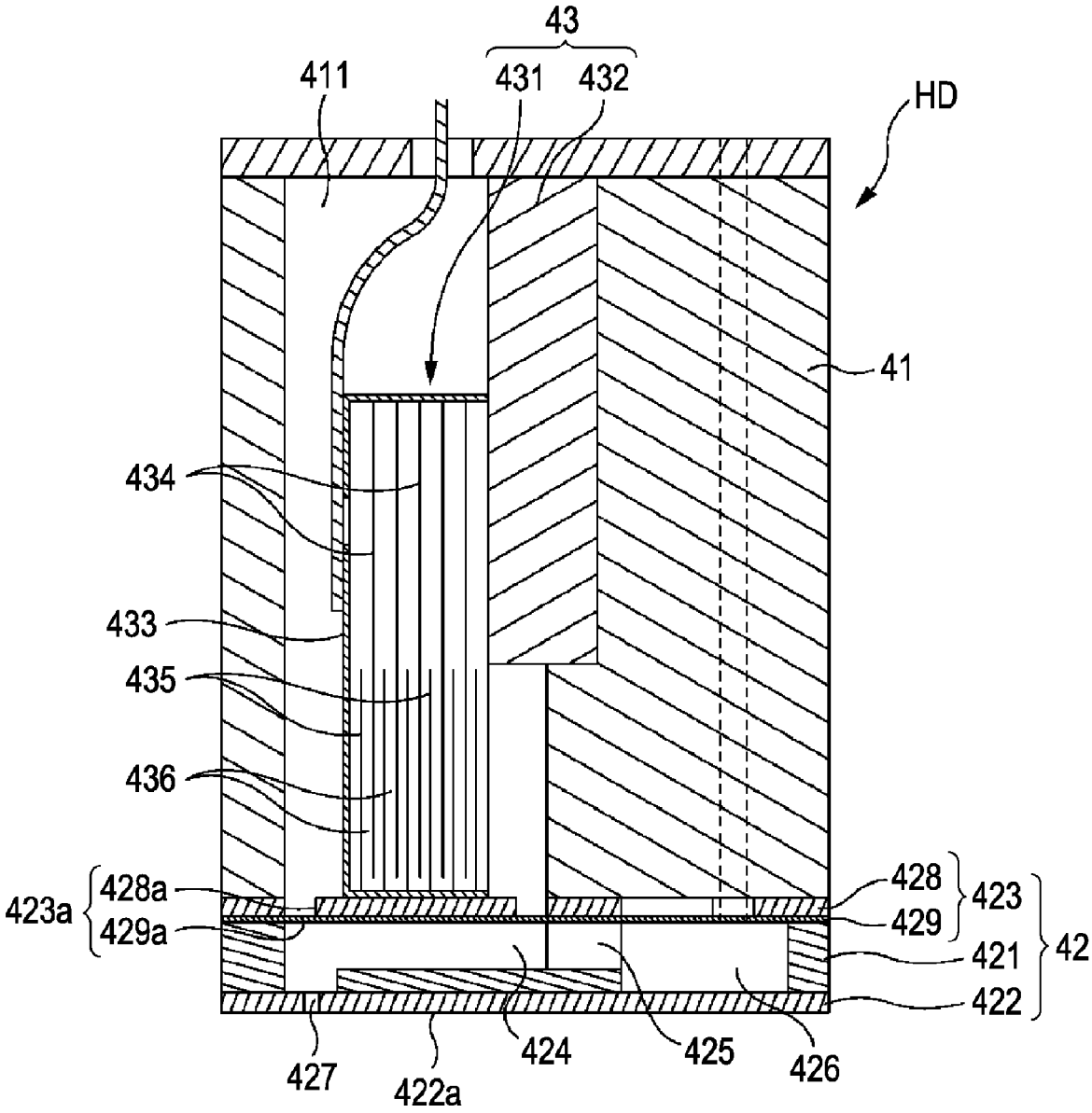
FIG. 2A is a sectional view of a head, and FIG. 2B diagrammatically illustrates a structure of the head.

Referring to FIG. 2A, the head HD includes a case 41, a channel unit 42, and a piezoelectric element unit 43. The case 41 includes a container 411 that contains and secures the piezoelectric element unit 43. The case 41 is made of a resin, for example. The channel unit 42 is connected to the end portion of the case 41.

The channel unit 42 includes a channel formation substrate 421, a nozzle plate 422, and a vibration plate 423. The nozzle plate 422 is bonded to one surface of the channel formation substrate 421 and the vibration plate 423 is bonded to the other surface of the channel formation substrate 421. The channel formation substrate 421 includes a channel serving as a pressure compartment 424, a channel serving as an ink supply 425, and an opening serving as a common ink container 426. The channel formation substrate 421 is a silicon substrate, for example. The pressure compartment 424 is an elongated shape running in a direction perpendicular to the direction of arrangement of nozzles 427. The ink supply 425 causes the pressure compartment 424 to communicate with the common ink container 426. The ink supply 425 supplies ink (one type of the liquid) stored in the common ink container 426 to the pressure compartment 424. The ink supply 425 serves as the supply unit supplying the liquid to the pressure compartment 424. The common ink container 426 temporarily stores the ink supplied from an ink cartridge (not shown), and corresponds to a common liquid storage chamber.

The nozzle plate 422 includes a plurality of nozzles 427 arranged in parallel along a predetermined direction at predetermined intervals. Ink is ejected out of the head HD externally through the nozzles 427. The nozzle plate 422 is one of a stainless plate and a silicon plate.

The vibration plate 423 has a two-layer structure that is made by laminating a resin elastic membrane 429 onto a stainless steel support plate 428. A portion of the support plate 428 corresponding to the pressure compartment 424 at the vibration plate 423 is etched in a ring shape. Islands 428*a* are formed within the ring. The island 428*a* and a portion 429*a* of the elastic membrane 429 form a diaphragm section 423*a*. The diaphragm section 423*a* is deformed in shape by a piezoelectric element 433 contained in the piezoelectric element unit 43, thereby varying the volume of the pressure compartment 424. More specifically, the diaphragm section 423*a* defines a section of the pressure compartment 424. The section of the pressure compartment 424 changes the shape thereof, thereby providing a pressure change to the ink (liquid) in the pressure compartment 424.

The piezoelectric element unit 43 includes a piezoelectric element group 431 and a fixed substrate 432. The piezoelectric element group 431 has a comb-like form. Each tooth of the comb is a piezoelectric element 433. The end of each piezoelectric element 433 is bonded to the corresponding island 428*a*. The fixed substrate 432, secured to the case 41, supports the piezoelectric element group 431. The fixed substrate 432 is a stainless steel substrate, and glued to an inner wall of the container 411.

The piezoelectric element 433 is one type of electromechanical transducer, and corresponds to an element that operates (shape-changes) to cause a change in the pressure of the liquid within the pressure compartment 424. When a voltage difference is caused between two adjacent electrodes of the piezoelectric element 433 illustrated in FIG. 2A, the piezoelectric element 433 constricts and dilates in a longitudinal direction of the element perpendicular to the direction of lamination of the element. More specifically, the electrodes include a common electrode 434 at a predetermined voltage level and a drive electrode 435 at a voltage level responsive to the drive signal COM (ejection pulse PS). A piezoelectric body 436 sandwiched between the two electrodes 434 and 435 changes the shape thereof in response to a voltage difference between the common electrode 434 and the drive electrode 435. The piezoelectric element 433 constricts and dilates in the longitudinal direction of the element in response to the shape change of the piezoelectric body 436. In accordance with the present embodiment, the common electrode 434 is maintained at ground voltage or at a bias voltage higher than the ground voltage by a predetermined voltage. The higher the voltage of the drive electrode 435 becomes with respect to the voltage of the common electrode 434, the more the piezoelectric element 433 shrinks. Conversely, the closer the voltage of the drive electrode 435 becomes to the voltage of the common electrode 434 or the lower the voltage of the drive electrode 435 becomes, the more the piezoelectric element 433 dilates.

As previously discussed, the piezoelectric element unit 43 is fixed to the case 41 using the fixed substrate 432. When the piezoelectric element 433 constricts, the diaphragm section 423*a* is attracted in a direction farther from the pressure compartment 424. In this way, the pressure compartment 424 dilates. Conversely, when the piezoelectric element 433 dilates, the diaphragm section 423*a* is pushed toward the pressure compartment 424. The pressure compartment 424 thus constricts A pressure change takes place in the ink within the pressure compartment 424 in response to dilation and constriction of the pressure compartment 424. More specifically, the ink within the pressure compartment 424 is pressurized in response to the constriction of the pressure compartment 424, and is depressurized in response to the dilation of the pressure compartment 424. Since the constriction and dilation states of the piezoelectric element 433 are determined by the voltage of the drive electrode 435, the volume of the pressure compartment 424 is also determined by the voltage of the drive electrode 435. The piezoelectric element 433 is thus understood as an element that changes the diaphragm section 423*a* (variation section) in response to the change pattern of the voltage responsive to the applied ejection pulse PS. The pressurization and depressurization of the ink within the pressure compartment 424 are determined by a rate of voltage change or the like per unit time at the drive electrode 435.

Ink Channel

Figure 2B:
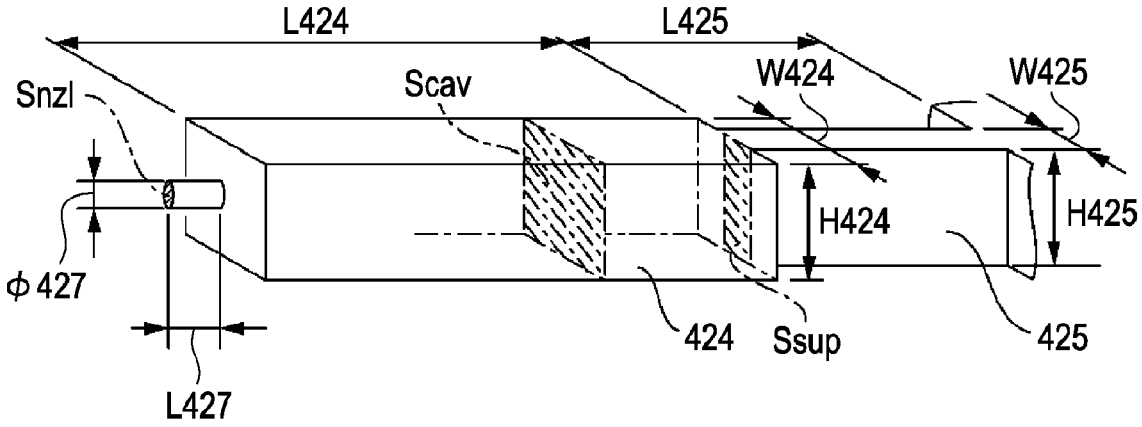

The head HD includes a plurality of ink channels of the number equal to the number of nozzles 427 extending from the common ink container 426 to the nozzles 427 (corresponding to an liquid channel filled with the liquid). The nozzle 427 and the ink supply 425 communicate with the pressure compartment 424 in the ink channel. When characteristics of an ink flow are analyzed, the concept of the Helmholtz resonator applies. FIG. 2B diagrammatically illustrates a structure of the head HD on the basis of the concept of the Helmholtz resonator.

In a generally available head HD, a length L424 of the pressure compartment 424 falls within a range of from 200 μm to 2000 μm. A width W424 of the pressure compartment 424 falls within a range of from 20 μm to 300 μm. A height H424 of the pressure compartment 424 falls within a range of from 30 μm to 500 μm. A length L425 of the ink supply 425 falls within a range of from 50 μm to 2000 μm. A width W425 of the ink supply 425 falls within a range of from 20 μm to 300 μm. A height H425 of the ink supply 425 falls within a range of from 30 μm to 500 μm. A diameter ϕ427 of the nozzle 427 falls within a range of from 10 μm to 40 μm. A length L427 of the nozzle 427 falls within a range of from 40 μm to 100 μm.

FIG. 2B diagrammatically illustrates an ink channel, and does not necessarily illustrate an actual structure of the ink channel. When a pressure change is given to the ink within the pressure compartment 424 in the ink channel, ink is ejected through the nozzle 427. The pressure compartment 424, the ink supply 425, and the nozzle 427 operate as a Helmholtz resonator. When the ink within the pressure compartment 424 is pressurized, the magnitude of the pressure varies with a unique period called Helmholtz period. In other words, the ink vibrates in pressure.

The Helmholtz period (vibration period unique to ink) Tc is generally expressed in the following equation (1):

$$Tc=1/f$$

$$f=\tfrac{1}{2}\pi\sqrt{[(Mn+Ms)/(MnMs(Cc+Ci))]} \quad (1)$$

where Mn represents inertance of the nozzle 427 (mass of ink per unit section area as will be described later), Ms represents inertance of the ink supply 425, Cc represents compliance of the pressure compartment 424 (volume change per unit pressure representing flexibility), and Ci represents compliance of ink (Ci=volume V/[density ρ×speed of sound $c^2$]).

The amplitude of the pressure vibration gradually decreases when ink flows through the ink channel. For example, the pressure vibration attenuates because of a loss in the nozzle 427 and the ink supply 425, and a loss in a wall defining the pressure compartment 424.

In the generally available head HD, the Helmholtz period falls within a range of from 5 μs to 10 μs. For example, the Helmholtz period is about 8 μm on the ink channel illustrated in FIG. 2B formed of the pressure compartment 424 having a width W424 of 100μ, a height H424 of 70 μm, and a length L424 of 1000μ, the ink supply 425 having a width W425 of 50 μm, a height H425 of 70 μm, and a length L425 of 500 μm, and the nozzle 427 having a diameter ϕ427 of 30 μm, and a length L427 of 100 μm. The Helmholtz period also changes depending on a thickness of a wall partitioning the adjacent pressure compartments 424, a thickness and compliance of the elastic membrane 429, and a material of each of the channel formation substrate 421 and the nozzle plate 422.

Printer Controller 60

The printer controller 60 generally controls the printer 1. For example, the printer controller 60 controls each control target element in response to the print data received from the computer CP and detection results from each detector, and prints an image on a paper sheet. With reference to FIG. 1, the printer controller 60 includes an interface 61, a central processing unit (CPU) 62, and a memory 63. The interface 61 exchanges data with the computer CP. The CPU 62 generally controls the printer 1. The memory 63 provides an area for storing a computer program, and a working area. The CPU 62 controls each control target element in accordance with the computer program stored on the memory 63. For example, the CPU 62 controls the paper transport mechanism 10 and the carriage drive mechanism 20. For example, the CPU 62 transmits a head control signal to the head controller HC to control the operation of the head HD, and transmits a control signal to the drive signal generator 30 to generate the drive signal COM.

The control signal for generating the drive signal COM is also called DAC data and is digital data composed of a plurality of bits. The DAC data determines a change pattern of the voltage of the generated drive signal COM. The DAC data is thus data that indicates the voltage of the drive signal COM and the ejection pulse PS. The DAC data is stored on a predetermined area of the memory 63, and is read at the generation of the drive signal COM and output to the drive signal generator 30, Drive Signal Generator 30

Figure 3:
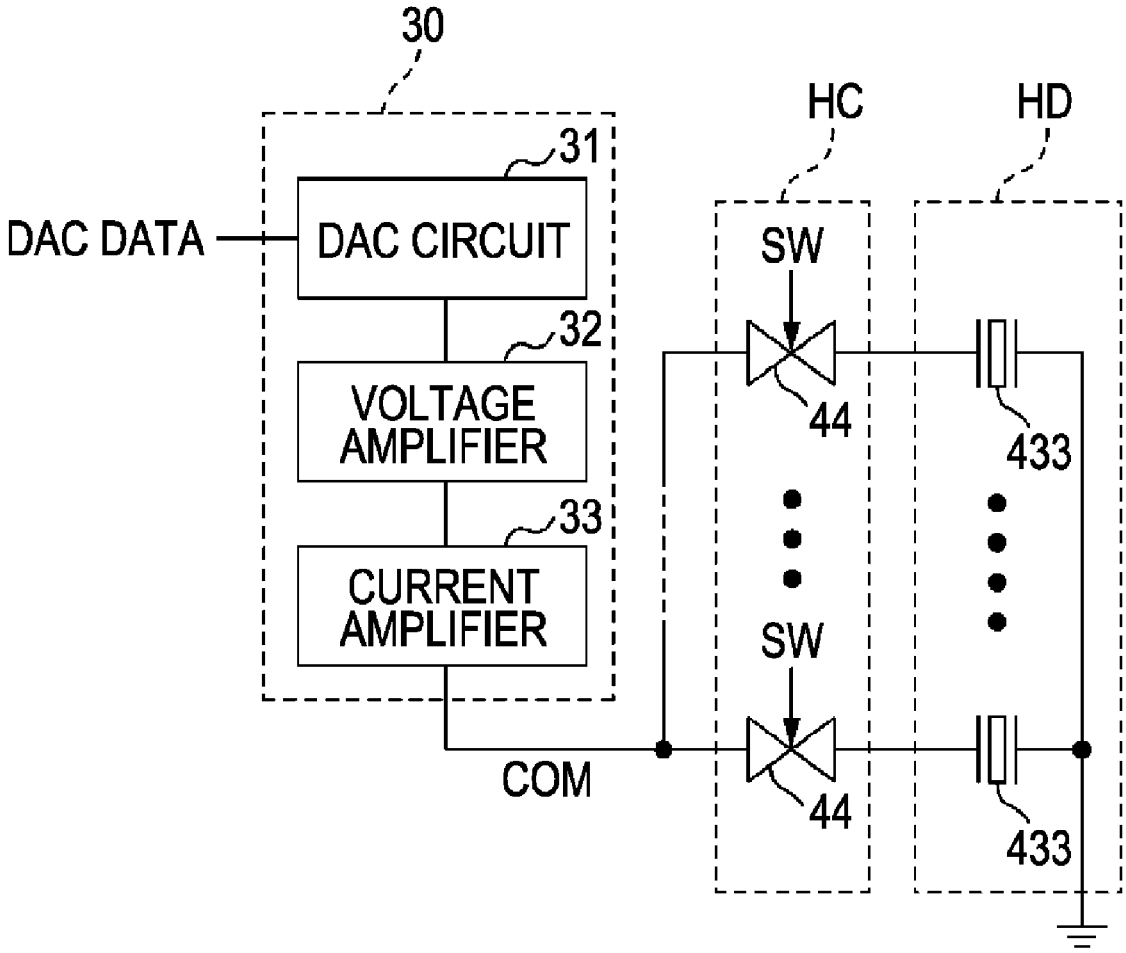
FIG. 3 is a block diagram illustrating a structure of a drive signal generator and other circuits.

The drive signal generator 30 functions as an ejection pulse generator, and generates the drive signal COM containing the ejection pulse PS on the basis of the DAC data. With reference to FIG. 3, the drive signal generator 30 includes a DAC circuit 31, a voltage amplifier 32, and a current amplifier 33. The DAC circuit 31 converts digital DAC data into an analog signal. The voltage amplifier 32 amplifies the voltage of the analog signal converted by the DAC circuit 31 to a level high enough to drive the piezoelectric element 433. In the printer 1, the analog signal output from the DAC circuit 31 is 3.3 V at maximum while the analog signal amplified by the voltage amplifier 32 (hereinafter also referred to as a waveform signal) is 42 V at maximum. The current amplifier 33 current-amplifies the waveform signal from the voltage amplifier 32 and outputs the amplified waveform signal as the drive signal COM. The current amplifier 33 includes a push-pull connected transistor pair.

Head Controller HC

The head controller HC selects a necessary portion of the drive signal COM generated by the drive signal generator 30 in response to the head control signal, and applies the selected portion to the piezoelectric element 433. With reference to FIG. 3, the head controller HC includes a plurality of switches 44, each arranged in the middle of a supply line of the drive signal COM for each piezoelectric element 433. The head controller HC generates a switch control signal from the head control signal. When each switch 44 is controlled by the switch control signal, the necessary portion (for example, the ejection pulse PS) of the drive signal COM is applied to the piezoelectric element 433. Depending on which portion is selected, the ejection of ink through the nozzle 427 is controlled.

Drive Signal COM

The drive signal COM generated by the drive signal generator 30 is described. With reference to FIG. 4, the drive signal COM includes a plurality of ejection pulses PS repeatedly generated. All the ejection pulses PS are identical in shape, i.e., are identical in voltage change pattern. As previously described, the drive signal COM is applied to the drive electrode 435 contained in the piezoelectric element 433. In this way, a voltage difference takes place in response to a voltage change pattern with respect to the common electrode 434 at the fixed voltage. As a result, the piezoelectric element 433 constricts and dilates in accordance with the voltage change pattern, thereby changing the volume of the pressure compartment 424 accordingly.

The voltage of the ejection pulse PS rises from an median voltage VB as a reference voltage to the highest voltage VH, and then falls down to the lowest voltage VL. The ejection pulse PS then rises again to the median voltage VB. As previously discussed, the higher the voltage of the drive electrode 435 with respect to the voltage of the common electrode 434, the more the piezoelectric element 433 constricts and thus increases the volume of the pressure compartment 424.

When the ejection pulse PS is applied to the piezoelectric element 433, the pressure compartment 424 dilates from a standard volume responsive to the median voltage VB to a maximum volume responsive to the highest voltage VH. The pressure compartment 424 then constricts to a minimum volume responsive to the lowest voltage VL and then dilates to the standard volume responsive to the median voltage VB. In the course of the constriction from the maximum volume to the minimum volume, ink within the pressure compartment 424 is pressurized, and ink drops are ejected through the nozzle 427. A portion of the ejection pulse PS transitioning from the highest voltage VH to the lowest voltage VL corresponds to an ejection portion for ejecting ink.

The ejection frequency of the ink drops is determined by an interval between ejection portions generated one after another. Referring to FIG. 4, an ink drop is ejected every period Ta in response to the drive signal COM denoted by a solid line, and an ink drop is ejected every period Tb in response to the drive signal COM denoted by a dot-and-dash chain line. For this reason, the ejection frequency of the solid-line drive signal COM is higher than the ejection frequency of the dot-and-dash chain line drive signal COM.

Ejection Operation

Figure 5A:
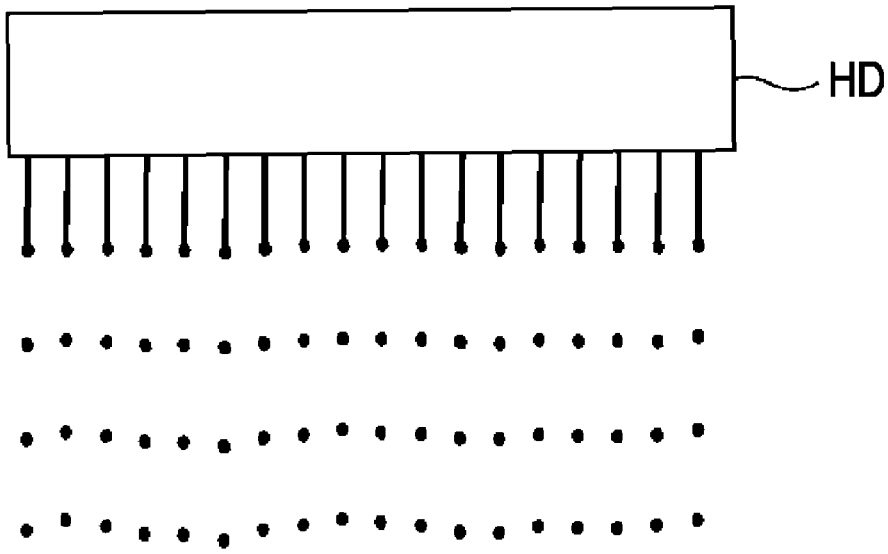
FIG. 5A illustrates high-viscosity ink that is ejected in a stable manner.
Figure 5B:
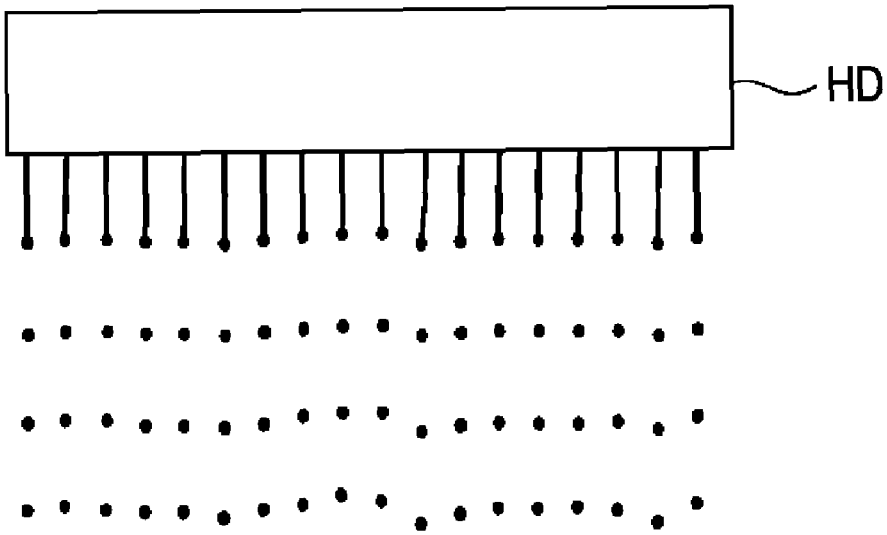
FIG. 5B illustrates high-viscosity ink that is ejected in an unstable manner.

Stabilizing ink ejection operation is required of the printer 1. For example, there is a demand that an amount, a flight trajectory direction, a flight speed, etc. of an ink drop remain unchanged regardless of whether the ink drop is ejected at a low frequency or a high frequency. If ink having a viscosity sufficiently higher than standard viscosity ink having about 1 milli Pascal second (mPa·s), more specifically, ink (high viscosity ink) having a viscosity ranging from 6 to 20 mPa·s is ejected using a known head, the ejection of the ink becomes unstable. FIG. 5A illustrates that the high-viscosity ink is ejected in a stable state, and FIG. 5B illustrates that the high-viscosity ink is ejected in an unstable state. By comparison of the two states, the ink drops suffer from insufficient flight speed and trajectory bending in the unstable state.

A variety of causes for ink ejection instability may be considered. One of the causes is a loss of balance between channel flow resistances.

The channel flow resistance is an internal loss of a medium. In accordance with the present embodiment, the channel flow resistance is a force which the ink flowing through an ink channel is subject to. The channel flow resistance has a direction opposite to the direction of ink flow. As previously discussed with reference to FIG. 2B, the pressure compartment 424 and the ink supply 425 form a generally rectangular parallelepiped channel. A channel flow resistance Rdirect in this ink channel is expressed by the following equation (2):

$$\text{Channel flow resistance } R\text{direct}=(12\times \text{viscosity } \mu\times\text{length } L/\text{width } w\times\text{height } H^3) \quad (2)$$

where viscosity μ represents viscosity of ink, L represents a length of the flow channel, W is a width of the flow channel, and H represents a height of the flow channel.

If the channel flow resistance is unbalanced in the pressure compartment 424 and the ink supply 425, the pressure vibration of the ink within the pressure compartment 424 may persist for an excessively long period of time, the supply of the ink to the pressure compartment 424 may be insufficient, and the pressure of the ink within the pressure compartment 424 may become unstable. Such irregularities lead to an unstable ink ejection.

In view of the above irregularities, the channel flow resistance of the ink supply 425 is determined on the basis of the channel flow resistance of the pressure compartment 424, and the flow channel length of the pressure compartment 424 is determined on the basis of the flow channel length of the ink supply 425. More specifically, the channel flow resistance of the supply unit 425 falls within a range of from equal to or higher than the channel flow resistance of the pressure compartment 424 to equal to or lower than twice the flow resistance of the pressure compartment 424, and a channel length L424 of the pressure compartment 424 falls within a range of from equal to or longer than a channel length L425 of the supply unit 425 to equal to or shorter than twice the channel length L425 of the supply unit 425.

The pressure vibration taking place in the ink within the pressure compartment 424 in response to the ejection of the ink drop is thus efficiently settled by the ink supply 425. The instability of the ejection of the ink drop caused by the pressure vibration is controlled. As a result, the ejection of the ink drop is stabilized. An excessive pressure change in the ink within the pressure compartment 424 is controlled. This is also considered as a factor contributing to the stabilization of the ejection of the ink drop. How the stabilization is achieved is discussed further in detail below.

Ejection Pulse PS

Figure 6:
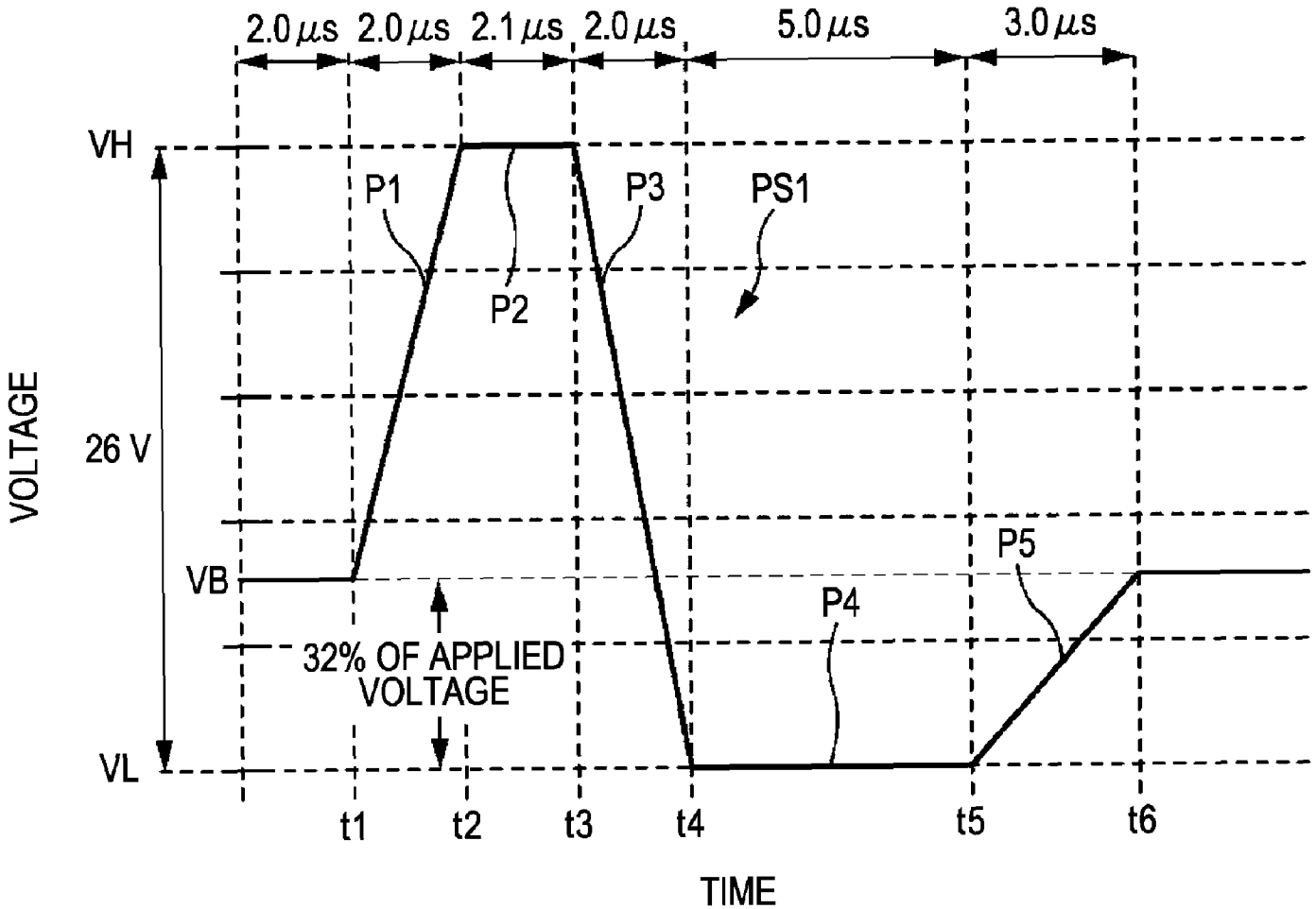
FIG. 6 illustrates an ejection pulse used in evaluation.

An ejection pulse PS1 used in evaluation is described below. FIG. 6 illustrates the ejection pulse PS1. Referring to FIG. 6, the ordinate represents the voltage of the drive signal COM (the ejection pulse PS1), and the abscissa represents times.

The ejection pulse PS1 illustrated in FIG. 6 contains a plurality of portions represented by reference symbols P1 through P5. More specifically, the ejection pulse PS1 contains a first depressurized portion P1, a first voltage held portion P2, a pressurized portion P3, a second voltage held portion P4, and a second depressurized portion P5.

The first depressurized portion P1 is generated from timing t1 to timing t2. The first depressurized portion P1 has the median voltage VB at the timing t1 (corresponding to a starting voltage), and the median voltage VB at the timing t2 (corresponding to an ending voltage). When the first depressurized portion P1 is applied to the piezoelectric element 433, the pressure compartment 424 dilates from the standard volume to the maximum volume during the generation period of the first depressurized portion P1.

The median voltage VB of the ejection pulse PS1 is set to be a voltage higher than the lowest voltage VL of the ejection pulse PS1 by 32% of a difference (26 V) between the highest voltage VH and the lowest voltage VL. The generation period of the first depressurized portion P1 is 2.0 μs.

The first voltage held portion P2 is a portion extending from timing t2 to timing t3. The first voltage held portion P2 remains constant at the highest voltage VH. While the first voltage held portion P2 is applied to the piezoelectric element 433, the pressure compartment 424 is maintained at the maximum volume for the generation period of the first voltage held portion P2. The first voltage held portion P2 of the ejection pulse PS1 is 2.1 μs.

The pressurized portion P3 is a portion generated from timing t3 to timing t4. The pressurized portion P3 has the highest voltage VH as a starting voltage, and the lowest voltage VL as an ending voltage. When the pressurized portion P3 is applied to the piezoelectric element 433, the pressure compartment 424 constricts from the maximum volume to the minimum volume during the generation period of the pressurized portion P3. Ink is ejected in response to the construction of the pressure compartment 424, and the pressurized portion P3 thus corresponds to the ejection portion for ejecting the ink drop. The generation period of the pressurized portion P3 of the ejection pulse PS1 is 2.0 μs.

The second voltage held portion P4 is generated from timing t4 to timing t5. The second voltage held portion P4 remains constant at the lowest voltage VL. When the second voltage held portion P4 is applied to the piezoelectric element 433, the pressure compartment 424 is maintained at the minimum volume during the generation period of the second voltage held portion P4. The generation period of the second voltage held portion P4 of the ejection pulse PS1 is 5.0 μs.

Figure 7:
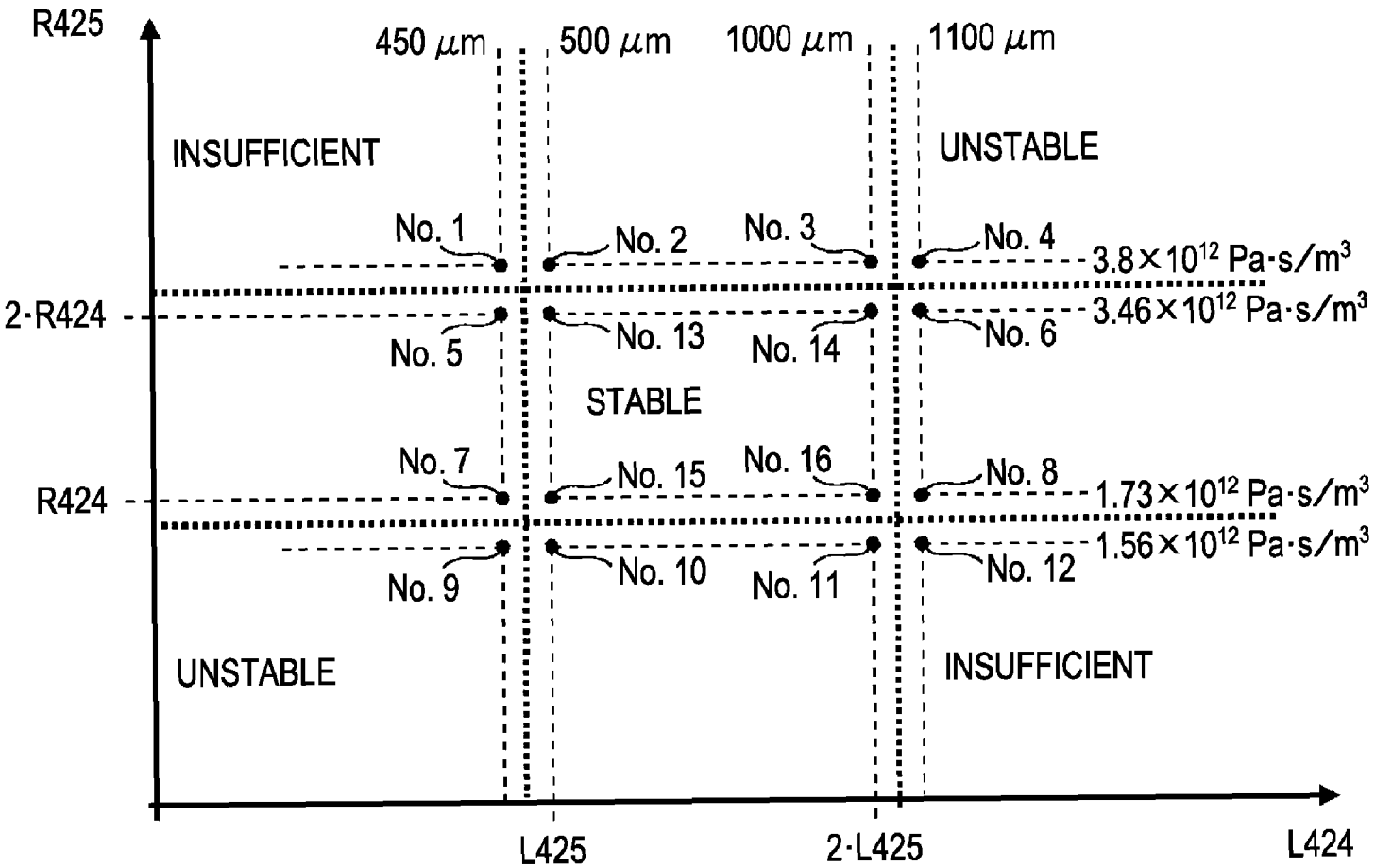
FIG. 7 illustrates structural parameters of each head to be evaluated.

The second depressurized portion P5 is generated from timing t5 to timing t6. The second depressurized portion P5 has the lowest voltage VL as the starting voltage and the median voltage VB as the ending voltage. When the second depressurized portion P5 is applied to the piezoelectric element 433, the pressure compartment 424 dilates from the minimum volume to the standard volume during the generation period of the second depressurized portion P5. The generation period of the second depressurized portion P5 of the ejection pulse PS1 is 3.0 μs. Ink Having a Viscosity of 15 mPa·s FIG. 7 illustrates structural parameters of each head HD to be evaluated. Referring to FIG. 7, the ordinate represents the value of a channel flow resistance R425 of the ink supply 425, and the abscissa represents a length (channel length) L424 of the pressure compartment 424. The length L424 of the pressure compartment 424 is the length of a model of the pressure compartment 424 so that the same reference characters as those in FIG. 2B are used. More specifically, a rectangular parallelepiped pressure compartment 424 equivalent to a real one is determined as a model, and the length of that model is used. Points denoted by No. 1 through No. 16 indicate heads HD by which simulation tests have been performed by ejecting successively ink drops having a viscosity of 15 mPa·s (thus having a specific gravity of about 1). For example, No. 1 head HD has a channel flow resistance R425 of $3.8\times10^{12}$ Pa·s/m$^3$ for the ink supply 425, and a length of L424 of 450 μm ($10^{-6}$ m) for the pressure compartment 424. Also, No. 12 head HD has a channel flow resistance R425 of $1.56\times10^{12}$ Pa·s/m$^3$ for the ink supply 425, and a length of L424 of 1100 μm for the pressure compartment 424.

The other parameter values used in the simulation tests are described below. The heads HD (No. 1 through No. 16 heads HD) have a channel flow resistance R424 of $1.73\times10^{12}$ Pa·s/m$^3$ for the pressure compartment 424 and a length L425 of 500 μm for the ink supply 425. The volume of the pressure compartment 424 is $9680000\times10^{-18}$ m$^3$ and the height H424 of the pressure compartment 424 is 80 μm. The diameter of ϕ427 of the nozzle 427 is 25 μm, and the length L427 of the nozzle 427 is 80 μm.

Figure 59:
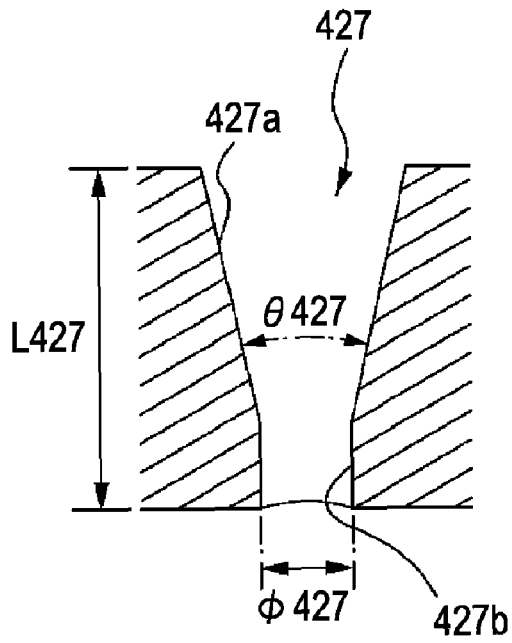
FIG. 59 is an expanded view of a funnel-like nozzle.
Figure 60:
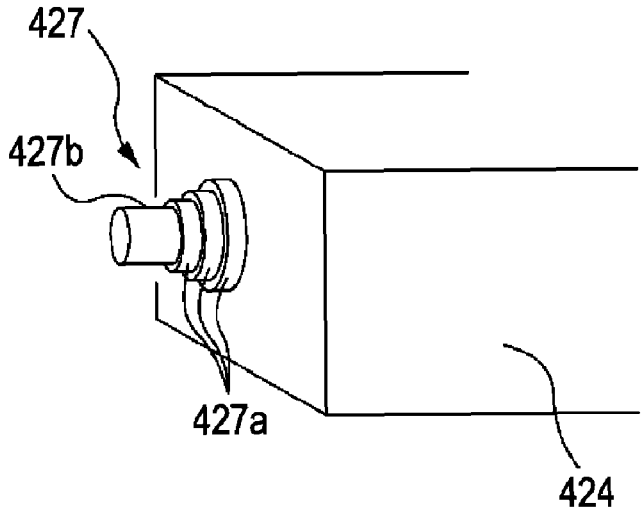
FIG. 60 illustrates a model used to analyze the funnel-like nozzle.

The nozzle 427 used in the simulation tests having a funnel shape includes a tapered portion 427*a* and a straight portion 427*b* (see FIG. 59). The tapered portion 427*a* defines a cone frustum space and has a smaller opening in cross section as it is farther away from the pressure compartment 424. In other words, the nozzle 427 is tapered. The straight portion 427*b* is connected to the smallest diameter end of the tapered portion 427*a*. The straight portion 427*b* defines a cylindrical space, and has a substantially constant cross section perpendicular to the direction of the nozzle. The diameter ϕ427 of the nozzle 427 means the diameter of the straight portion 427*b*. In the simulation tests, the length of the straight portion 427*b* is 20 μm, and a taper angle θ427 of the tapered portion 427*a* is 25 degrees. The length L427 of the nozzle 427 is the sum of the length of the tapered portion 427*a* and the length of the straight portion 427*b*. The length of the tapered portion 427*a* is thus 60 μm.

Out of the evaluation heads, No. 13 through No. 16 heads HD belong to the embodiment of the invention. No. 1 through No. 12 heads HD are comparative examples. Simulation results of these heads HD are described below.

No. 13 Head HD

In No. 13 head HD, the length L424 of the pressure compartment 424 is 500 μm and equals the length L425 of the ink supply 425. The channel flow resistance R425 of the ink supply 425 is $3.46\times10^{12}$ Pa·s/m$^3$ and is twice the channel flow resistance R424 of the pressure compartment 424. As represented by the same reference characters in FIG. 2B, the length L425 of the ink supply 425 indicates the length of the ink supply 425 that is based on a rectangular parallelepiped model.

Figure 8:
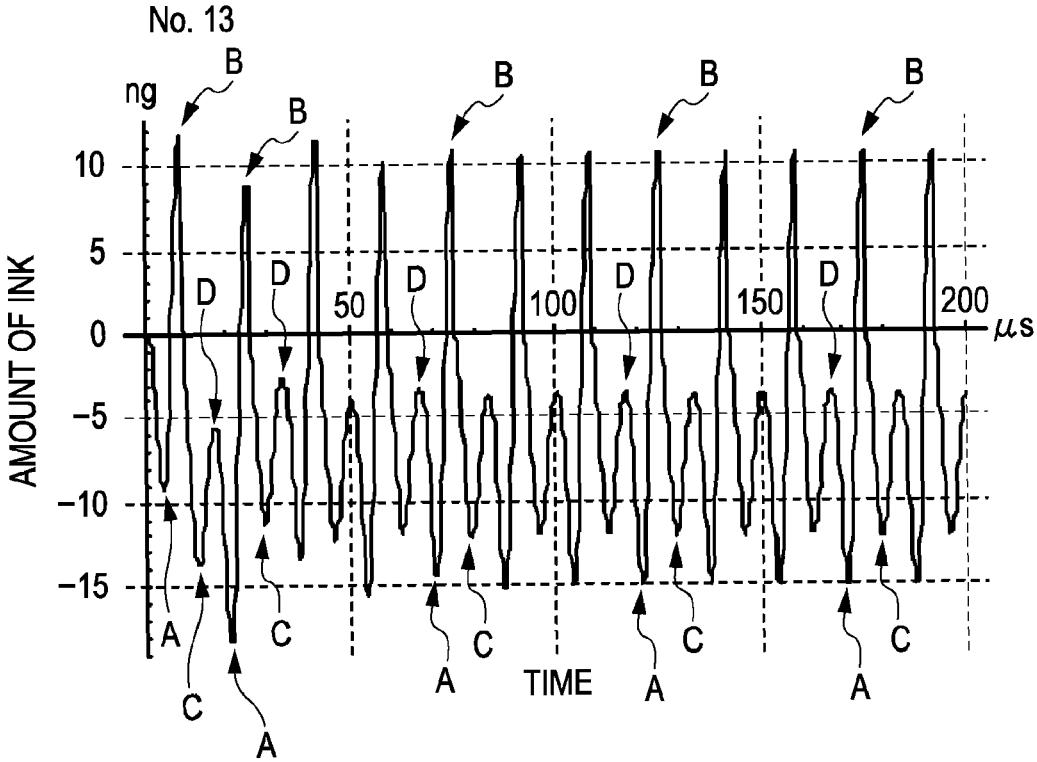
FIG. 8 illustrates results of a simulation in which No. 13 head is ejection-driven at 60 kHz.

When the ejection pulse PS1 of FIG. 6 is applied to the piezoelectric element 433 in the head HD having the above-described ink channel, an ink drop is ejected through the nozzle 427. FIG. 8 illustrates results of a simulation in which ink drops are ejected using No. 13 head HD successively, i.e., at a frequency of 60 kHz. In FIG. 8, the ordinate represents an amount of ink in a meniscus state (in a free surface of ink exposed within the nozzle 427), and the abscissa represents time. Along the ordinate, 0 ng represents a meniscus position at the steady state of ink. The larger the value becomes in the positive side, the more the meniscus is pushed toward the ejection direction. Conversely, the larger the value becomes in the negative side, the more the meniscus is attracted toward the pressure compartment 424. The same is true of the ordinate and abscissa in other drawings (FIGS. 9-23).

When the first depressurized portion P1 of the ejection pulse PS1 is applied to the piezoelectric element 433, the nozzle plate 422 dilates. In response to the dilation, the ink within the pressure compartment 424 has a negative pressure, and ink then flows into the pressure compartment 424 through the ink supply 425. With the ink having a negative pressure, the meniscus is attracted within the nozzle 427 toward the pressure compartment 424.

The movement of the meniscus toward the pressure compartment 424 continues after the end of the application of the first depressurized portion P1. Compliance and other parameters of the wall defining the pressure compartment 424 and of the vibration plate 423 causes the meniscus to move to the pressure compartment 424 during the application of the first voltage held portion P2. The meniscus is reversed at timing labeled by the letter A so that the meniscus is spaced away from the pressure compartment 424. The movement speed of the meniscus is high because constriction of the pressure compartment 424 responsive to the application of the pressurized portion P3 is combined with the movement of the meniscus In response to the application of the pressurized portion P3, the meniscus takes a column-like shape. A front portion of the column-like meniscus is broken away and ejected in a drop at timing B labeled by the letter B. Referring to FIG. 8, an amount of ink at timing B represents an amount of ink ejected.

In reaction to the ejection, the meniscus is drawn back to the pressure compartment 424 at a high speed. The piezoelectric element 433 is then supplied with the second depressurized portion P5. In response to the application of the second depressurized portion P5, the pressure compartment 424 dilates. The ink within the pressure compartment 424 has a negative pressure in response to the dilation. Subsequent to the application of the second depressurized portion P5, the meniscus switches the movement direction thereof to the ejection direction at timing C labeled by the letter C. At the timing of the switching of the meniscus movement direction, the application of a next first depressurized portion P1 to the piezoelectric element 433 starts at timing labeled by the letter D. The above-described operation is repeated thereafter.

The ejection pulse PS1 illustrated in FIG. 6 is also applied to the piezoelectric element 433 in the simulation tests illustrated in other drawings (such as in FIGS. 9-23). For this reason, the meniscus behaves at timings A-D as described above.

In accordance with the present embodiment, evaluation criteria of the head HD is that an ejection amount of ink is stable and 10 ng or more when inks drops are successively ejected in response to the ejection pulse PS1 illustrated in FIG. 6 at a frequency of 60 kHz. If ink drops, each drop being 10 ng or heavier, are stably ejected, images can be printed using high-viscosity ink at a speed and image quality, as high as or higher than those of a printer using known ink. No. 13 head HD ejects fourth and subsequent ink drops stably, each drop at an amount of about 10.5 ng. No. 13 head HD thus satisfies the above-described evaluation criteria. In other words, No. 13 head HD permits each of the ink drops to be ejected at a predetermined amount or higher with a small magnitude of variations in the ink amount even if high-viscosity ink is ejected at a high frequency.

Variations are observed in the ejection amount of a first ink drop to a third ink drop. This is probably because ink flow caused by inertia is small and unstable. The ink flow caused by inertia means an ink flow that is directed from the common ink container 426 to the nozzle 427 in response to successive ejections of ink drops. The above-described evaluation criteria applies in a phase in which the ink drops are successively ejected. If the fourth and subsequent ink drops are stable in the ejection amount and the ejection frequency, the ejection is evaluated as being stable even with a slight degree of variations observed in the ejection amount of the first through third ink drops.

No. 14 Head HD

In No. 14 head HD, the length L424 of the pressure compartment 424 is 1000 μm and is twice the length L425 of the ink supply 425. The channel flow resistance R425 of the ink supply 425 is twice the channel flow resistance R424 of the pressure compartment 424. In comparison with No. 13 head HD, No. 14 head HD is equal to No. 13 head HD in that the channel flow resistance R425 of the ink supply 425 is twice the channel flow resistance R424 of the pressure compartment 424 but is different from No. 13 head HD in that the length L424 of the pressure compartment 424 is twice the length L425 of the ink supply 425.

Figure 9:
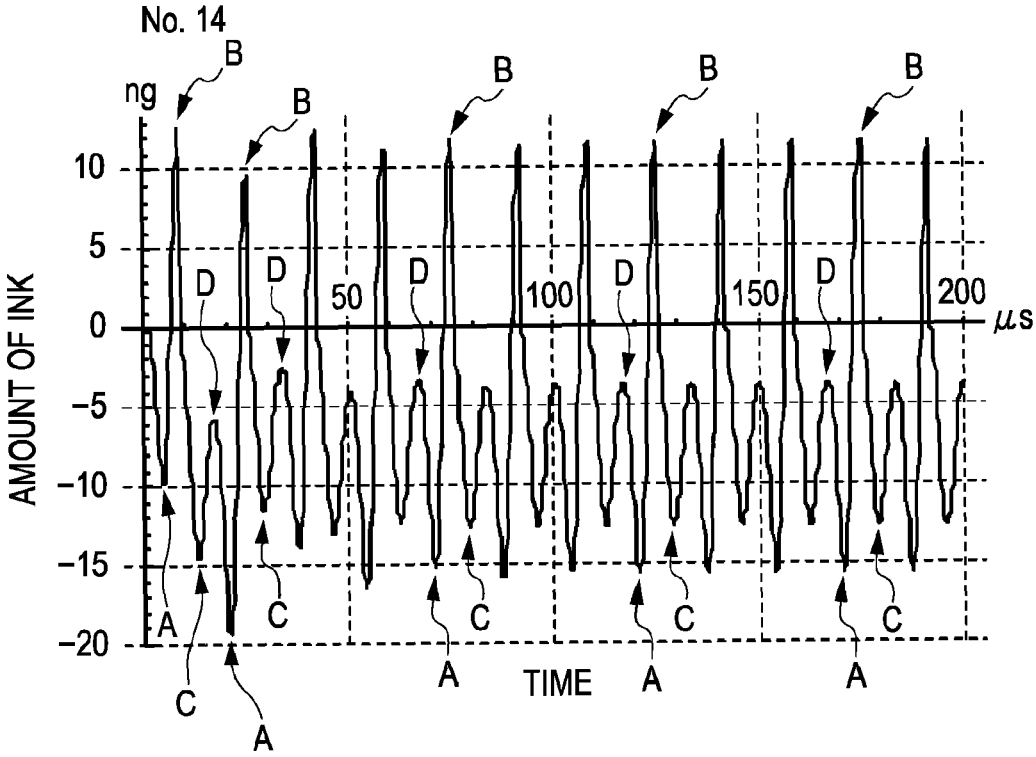
FIG. 9 illustrates results of a simulation in which No. 14 head is ejection-driven at 60 kHz.

FIG. 9 illustrates results of a simulation test in which ink drops are successively ejected using No. 14 head HD. No. 14 head HD ejects fourth and subsequent ink drops stably at an amount of about 11.5 ng. No. 14 head HD also satisfies the evaluation criteria.

No. 15 Head HD

In No. 15 head HD, the length L424 of the pressure compartment 424 is 500 μm and equals the length L425 of the ink supply 425. The channel flow resistance R425 of the ink supply 425 is $1.73\times10^{12}$ Pa·s/m$^3$ and equals the channel flow resistance R424 of the pressure compartment 424. In comparison with No. 13 head HD, No. 15 head HD is equal to No. 13 head HD in that the length L424 of the pressure compartment 424 equals the length L425 of the ink supply 425 but is different from No. 13 head HD in that the channel flow resistance R425 of the ink supply 425 equals the channel flow resistance R424 of the pressure compartment 424.

Figure 10:
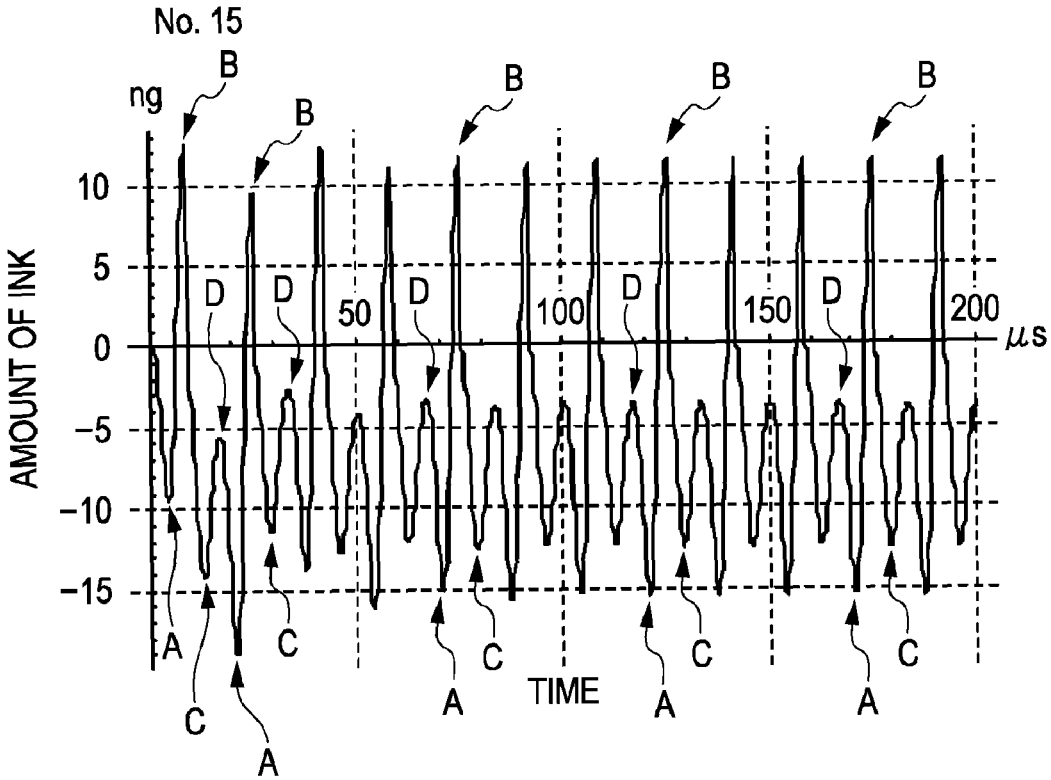
FIG. 10 illustrates results of a simulation in which No. 15 head is ejection-driven at 60 kHz.

FIG. 10 illustrates results of a simulation test in which ink drops are successively ejected using No. 15 head HD. No. 15 head HD ejects fourth and subsequent ink drops stably at an amount of about 11.5 ng. No. 15 head HD also satisfies the evaluation criteria No. 16 Head HD In No. 16 head HD, the length L424 of the pressure compartment 424 is 1000 μm and is twice the length L425 of the ink supply 425. The channel flow resistance R425 of the ink supply 425 equals the channel flow resistance R424 of the pressure compartment 424. In comparison with No. 13 head HD, No. 16 head HD is different from No. 13 head HD in that the length L424 of the pressure compartment 424 is twice the length L425 of the ink supply 425 and that the channel flow resistance R425 of the ink supply 425 equals the channel flow resistance R424 of the pressure compartment 424.

Figure 11:
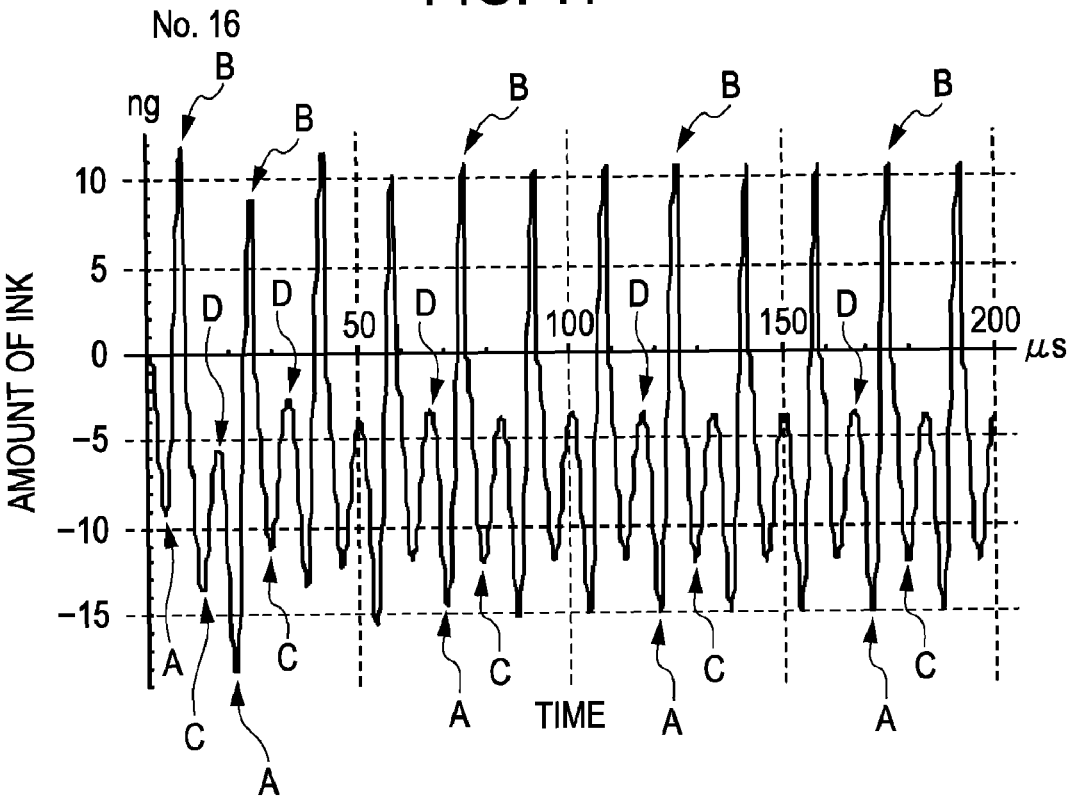
FIG. 11 illustrates results of a simulation in which No. 16 head is ejection-driven at 60 kHz.

FIG. 11 illustrates results of a simulation test in which ink drops are successively ejected using No. 16 head HD. No. 16 head HD ejects fourth and subsequent ink drops stably at an amount of about 10.5 ng. No. 16 head HD also satisfies the evaluation criteria.

Summary of Simulation Test Results of No. 13 Head HD Through No. 16 Head HD All No. 13 head HD through No. 16 head HD are determined to satisfy the evaluation criteria. More specifically, it suffices if the length L424 of the pressure compartment 424 falls within a range of from equal to or longer than the length L425 of the ink supply 425 to equal to or shorter than twice the length L425 of the ink supply 425, more specifically within a range of from equal to or longer than 500 μm to equal to or shorter than 1000 μm. It also suffices if the channel flow resistance R425 of the ink supply 425 falls within a range of from equal to or higher than the channel flow resistance R424 of the pressure compartment 424 to equal to or lower than twice the channel flow resistance R424 of the pressure compartment 424, more specifically within a range of from equal to or higher than $1.73\times10^{12}$ Pa·s/m$^3$ to equal to or lower than $3.46\times10^{12}$ Pa·s/m$^3$.

The channel flow resistance R425 of the ink supply 425 falls within a range of from equal to or higher than the channel flow resistance R424 of the pressure compartment 424 to equal to or lower than twice the channel flow resistance R424 of the pressure compartment 424. This arrangement causes the pressure vibration of ink within the pressure compartment 424 to settle down quickly. Also, a sufficient amount of ink is supplied to the pressure compartment 424. These points are considered to contribute to a stable ejection of the ink drops.

The length L424 of the pressure compartment 424 falls within a range of from equal to or longer than the length L425 of the ink supply 425 to equal to or shorter than twice the length L425 of the ink supply 425. This arrangement causes the ink flow from the common ink container 426 to the nozzle 427 caused by successive ejections of the ink drops to be used to assist the ejection of the ink drops. As a result, an insufficient supply of ink is less likely to take place when the ink drops are ejected at a high frequency. A stable ink supply thus results. Furthermore, a head HD having a portion of the pressure compartment 424 defined by the diaphragm section 423*a* can efficiently eject the ink drops in response to the shape change of the diaphragm section 423*a*.

Effect of Nozzle 427 on Ink Ejection

A shape of the nozzle 427 in the head HD also affects the ejection of the ink drops The effect of the nozzle 427 on the ink ejection is described below.

The channel flow resistance of the nozzle 427 is preferably higher than the channel flow resistance R425 of the ink supply 425. The channel flow resistance of the nozzle 427 higher than the channel flow resistance R425 of the ink supply 425 causes the occurrence of an insufficient supply of ink to the pressure compartment 424 to be less likely. Ink flows more easily through the ink supply 425 than through the nozzle 427 in the ink flow from the common ink container 426 to the nozzle 427, and the occurrence of an insufficient ink supply is thus considered to be less likely. The channel flow resistance Rround through a circular cross section is approximated using the following equation (3):

$$\text{Channel flow resistance } R\text{round}=(8\times\text{viscosity } \mu\times\text{length } L)/(\pi\times\text{radius } r^4) \quad (3)$$

where viscosity μ represents a viscosity of ink, L represents a length of the channel, and r represents a radius of the channel having a circular cross section.

As previously discussed, the nozzle 427 has a generally funnel shape. To apply equation (3), the tapered portion 427*a* illustrated in FIG. 6 is used as a model. More specifically, the tapered portion 427*a* is approximately defined by a plurality of rings that are stepwise reduced in diameter as it closes from the pressure compartment 424 to the straight portion 427*b*.

The minimum channel flow resistance is provided within the above-described nozzle size range when a diameter ϕ4247 of the nozzle 427 being 40 μm is combined with a length of the nozzle 427 of 40 μm. This combination results in a channel flow resistance of about $9.55\times10^{12}$ Pa·s/m$^3$. In other words, the channel flow resistance is about three times the maximum value of the channel flow resistance R425 of the ink supply 425.

When the high-viscosity ink is ejected, the inertance of the nozzle 427 is preferably set to be smaller than the inertance of the ink supply 425. The inertance is a value represented by approximating the following equation (4), and represents the easiness with which ink flows within the channel:

$$\text{Inertance } M=(\text{density } \rho\times\text{length } L)/\text{section area } S \quad (4)$$

where ρ represents a density of ink, S represents a section area of the channel, and L represents the length of the channel.

Equation (4) shows that the inertance is a mass of ink per section area. The higher the inertance, the more difficult it is for ink to flow within the pressure compartment 424 in response to ink pressure. The smaller the inertance, the more easily ink flows within the pressure compartment 424 in response to ink pressure.

Referring to FIG. 2B, the length L and the section area S of the channel are those of the model ink channel. The length L is a length in the flow direction of ink. The section area S is an area in a plane substantially perpendicular to the flow direction of ink. For example, the pressure compartment 424 has a section area labeled Scav in a plane substantially perpendicular to the longitudinal direction of the pressure compartment 424. The same is true of the ink supply 425 and the nozzle 427. The ink supply 425 has a section area labeled Ssup in a plane substantially perpendicular to the longitudinal direction thereof. The nozzle 427 has a section area labeled Snz1 in a plane substantially perpendicular to the longitudinal direction thereof.

If a pressure is applied to a channel from the outside, the larger the section area of the channel, the more easily ink flows within the channel, and the more the mass of the ink within the channel, the more difficult it is for ink to flow within the channel. From equation (4), the higher the inertance, the more difficult it is for ink to flow within the pressure compartment 424 in response to ink pressure, and the smaller the inertance, the more easily ink flows within the pressure compartment 424 in response to ink pressure.

The inertance of the nozzle 427 smaller than the inertance of the ink supply 425 causes the meniscus to move efficiently in response to the pressure vibration imparted to the ink within the pressure compartment 424. As a result, the ink drops are efficiently ejected.

The diameter ϕ427 and the length L427 of the nozzle 427 in the head HD are determined based on an opening shape (width W425 and height H425) and the length L425 of the ink supply 425. The inertance of the nozzle 427 is thus set to be smaller than the inertance of the ink supply 425.

Comparative Examples

Comparative heads HD are described below. As previously discussed, the comparative examples are No. 1 through No. 12 heads HD. In each of No. 1 through No. 4 heads HD, the channel flow resistance R425 of the ink supply 425 is set to be higher than twice the channel flow resistance R424 of the pressure compartment 424. More specifically, the channel flow resistance R425 of the ink supply 425 is set to be $3.8\times10^{12}$ Pa·s/m$^3$. In each of No. 9 through No. 12 heads HD, the channel flow resistance R425 of the ink supply 425 is set to be lower than the channel flow resistance R424 of the pressure compartment 424, i.e., is set to be $1.56\times10^{12}$ Pa·s/m$^3$. In each of Nos. 1, 5, 7, 9 heads HD, the length L424 of the pressure compartment 424 is set to be shorter than the length L425 of the ink supply 425, i.e., is set to be 450 μm. In each of Nos. 4, 6, 8, and 12 heads HD, the length L424 of the pressure compartment 424 is set to be longer than twice the length L425 of the ink supply 425, i.e., is set to be 1100 μm.

Figure 12:
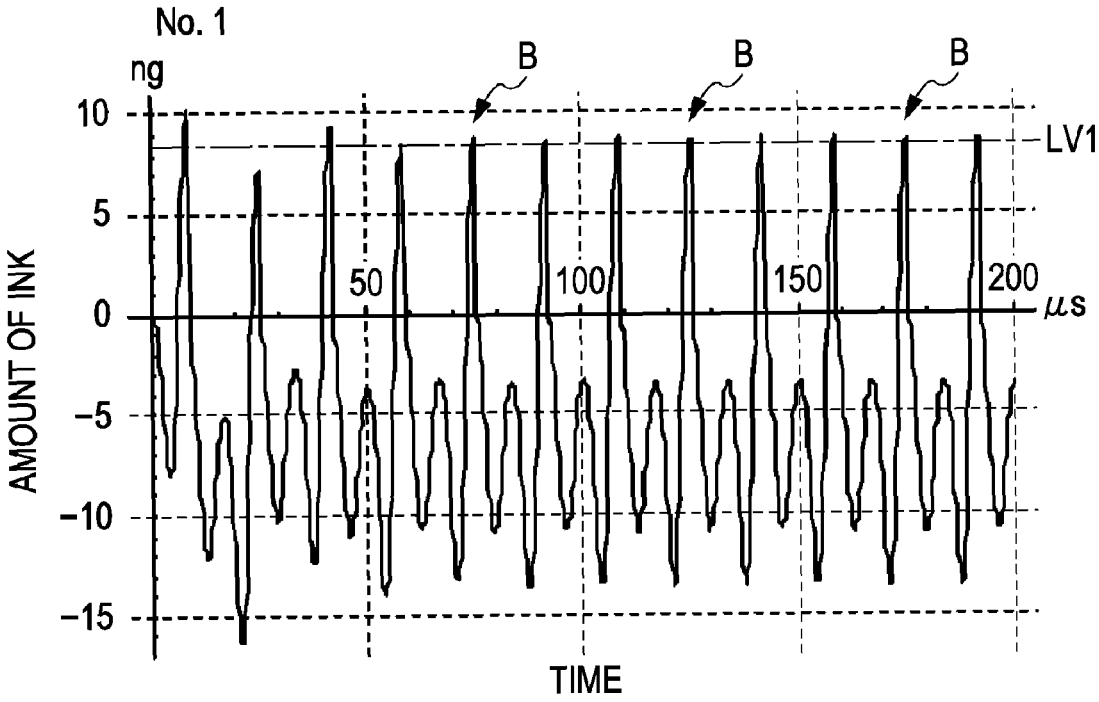
FIG. 12 illustrates results of a simulation in which No. 1 head is ejection-driven at 60 kHz.
Figure 13:
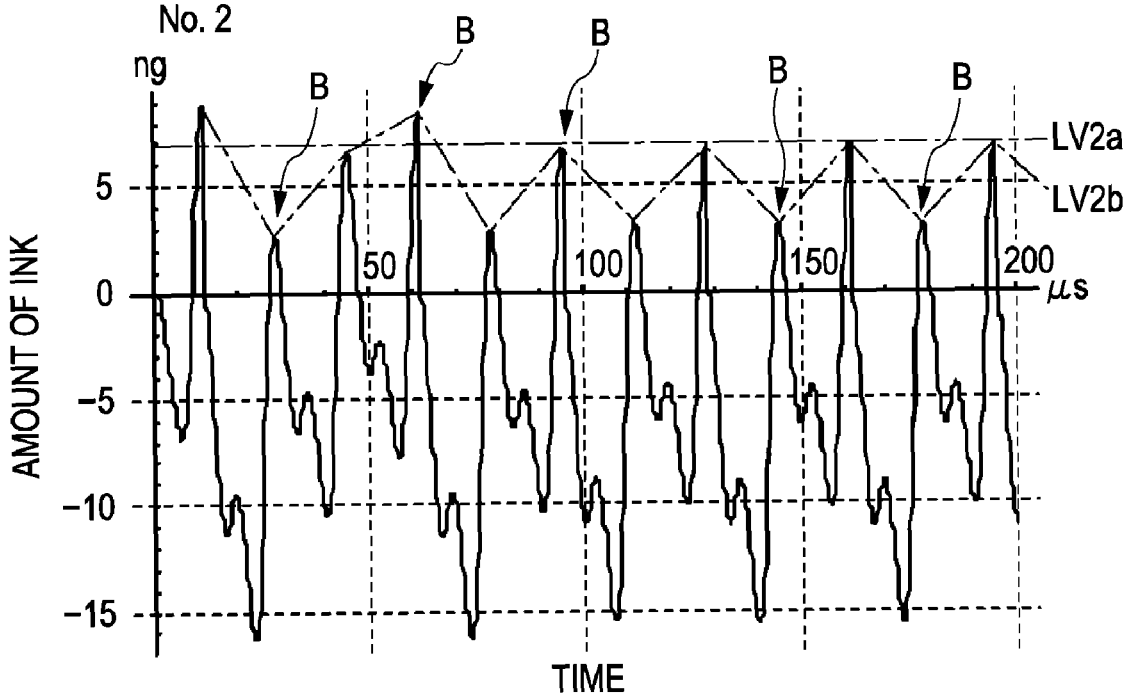
FIG. 13 illustrates results of a simulation in which No. 2 head is ejection-driven at 60 kHz.
Figure 14:
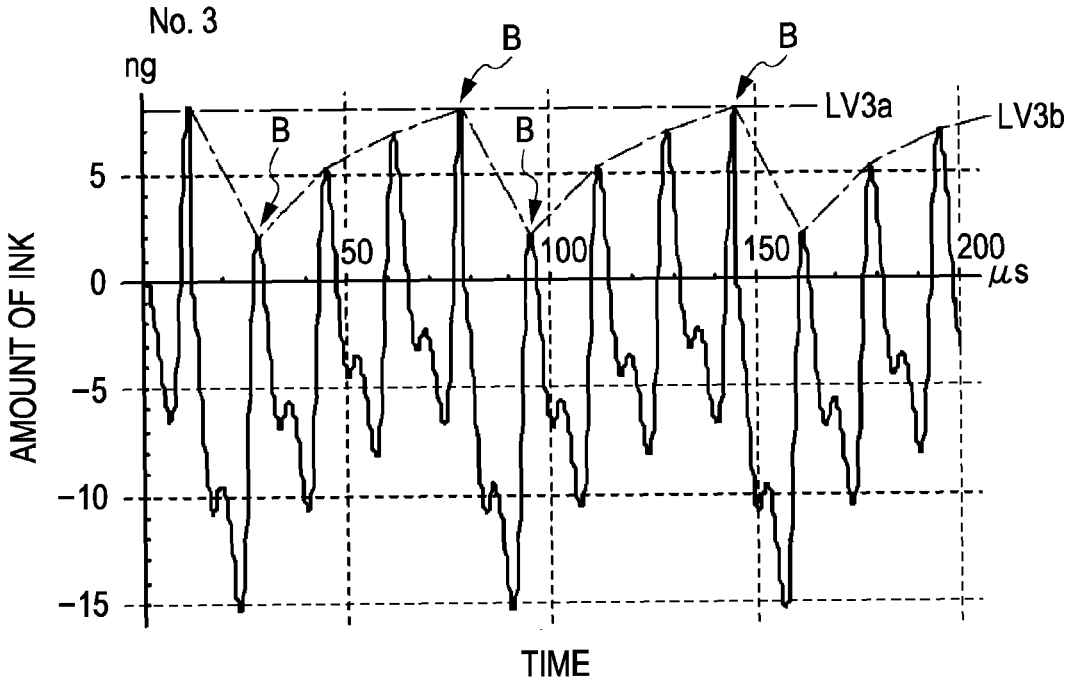
FIG. 14 illustrates results of a simulation in which No. 3 head is ejection-driven at 60 kHz.
Figure 23:
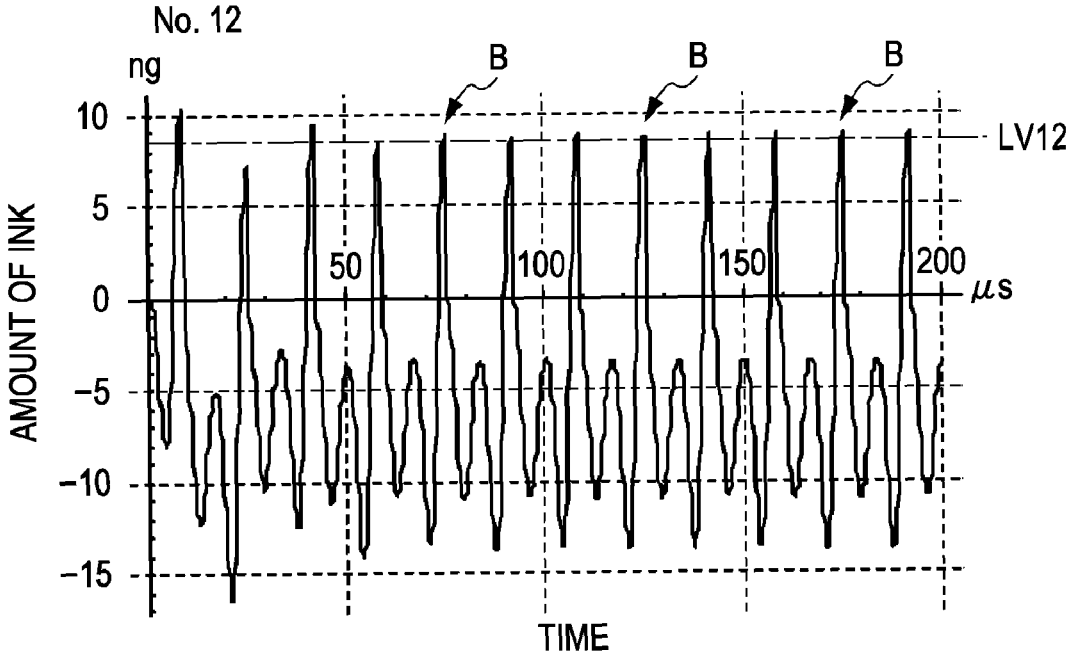
FIG. 23 illustrates results of a simulation in which No. 12 head is ejection-driven at 60 kHz.

FIGS. 12-23 illustrates results of simulation tests of the comparative heads HD. For example, FIG. 12 illustrates the results of the simulation test of No. 1 head HD. FIG. 13 illustrates the results of the simulation test of No. 2 head HD. FIG. 14 illustrates the results of the simulation test of No. 3 head HD. Similarly, the number of each drawing corresponds to the number of the head HD. FIG. 23 thus illustrates the results of the simulation test of No. 12 head HD.

Head HD Having an Excessively High Channel Flow Resistance R425

Heads HD having an excessively high channel flow resistance R425 are No. 1 through No. 4 heads HD illustrated in FIG. 7. As illustrated in FIG. 12 (No. 12 head HD) through FIG. 15 (No. 4 head HD), these heads eject an amount of ink smaller than a standard value (10 ng). For example, No. 1 head HD outputs fourth and subsequent ink drops at a uniform amount of ink but the uniform amount of ink is about 8.5 ng as represented by a line labeled LV1 and fails to reach the standard value. As for No. 2 head HD through No. 4 head HD, maximum ejection amounts of the fourth and subsequent ink drops are about 7 ng (LV2*a*) for No. 2 head HD, about 8 ng (LV3*a*) for No. 3 head HD, and about 8 ng (LV4*a*) for No. 4 head HD.

The possible reason why the ejection amount of ink fails to reach the standard value is that an excessively high channel flow resistance R425 of the ink supply 425 makes it difficult for ink to flow from the common ink container 426 to the pressure compartment 424.

In addition, the ejection amount of No. 1 head HD through No. 4 head HD is unstable. More specifically, the ejection amount of ink suffers from a periodical change. For example, as for fifth and subsequent ink drops, No. 2 head HD alternately ejects a large ink drop (of about 7 ng) and a small ink drop (about 3 ng) as represented by a line labeled LV2*b*. No. 4 head HD repeatedly ejects ink drops having four amount levels from the smallest ink drop (about 2 ng) to the largest ink drop (about 8 ng) as represented by a line labeled LV4*b*. The fourth ink drop is the second largest (about 7 ng), and the fifth ink drop is the largest (about 8 ng). The sixth ink drop is the smallest (about 2 ng), and the seventh ink drop is the third largest (about 5.5 ng). The amplitude of the periodic change in the ejection amount becomes larger as the length L424 of the pressure compartment 424 becomes longer.

The head HD having an excessively high channel flow resistance R425 suffers from an insufficient ejection amount, and the longer the length L424 of the pressure compartment 424 becomes, the more unstable the ejection becomes.

Head HD Having an Excessively Low Channel Flow Resistance R425

Figure 20:
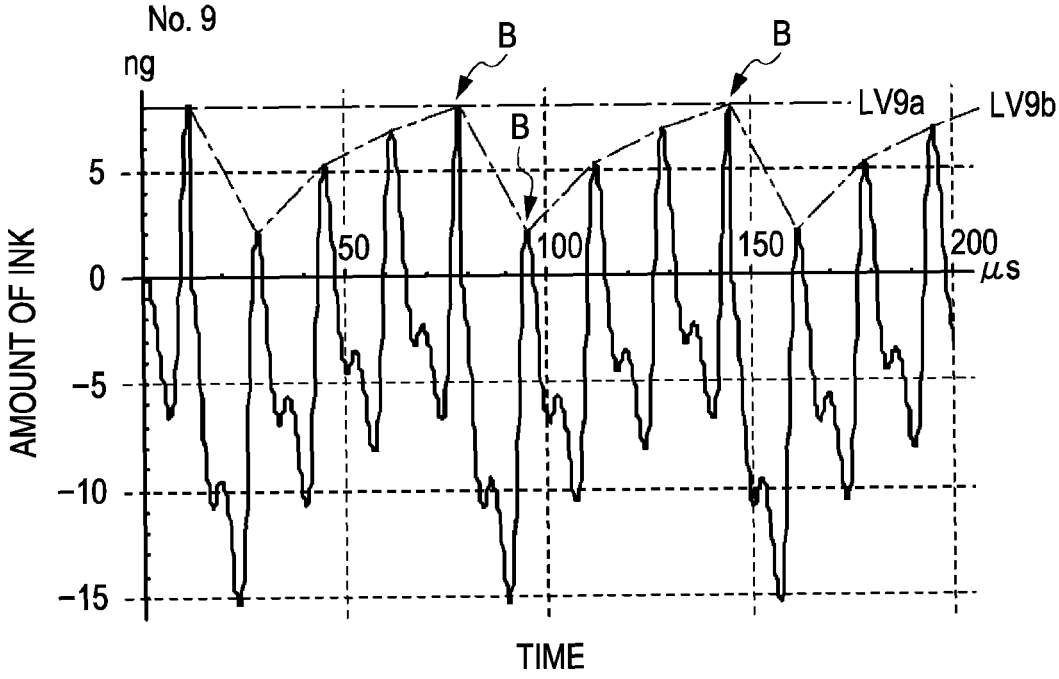
FIG. 20 illustrates results of a simulation in which No. 9 head is ejection-driven at 60 kHz.
Figure 21:
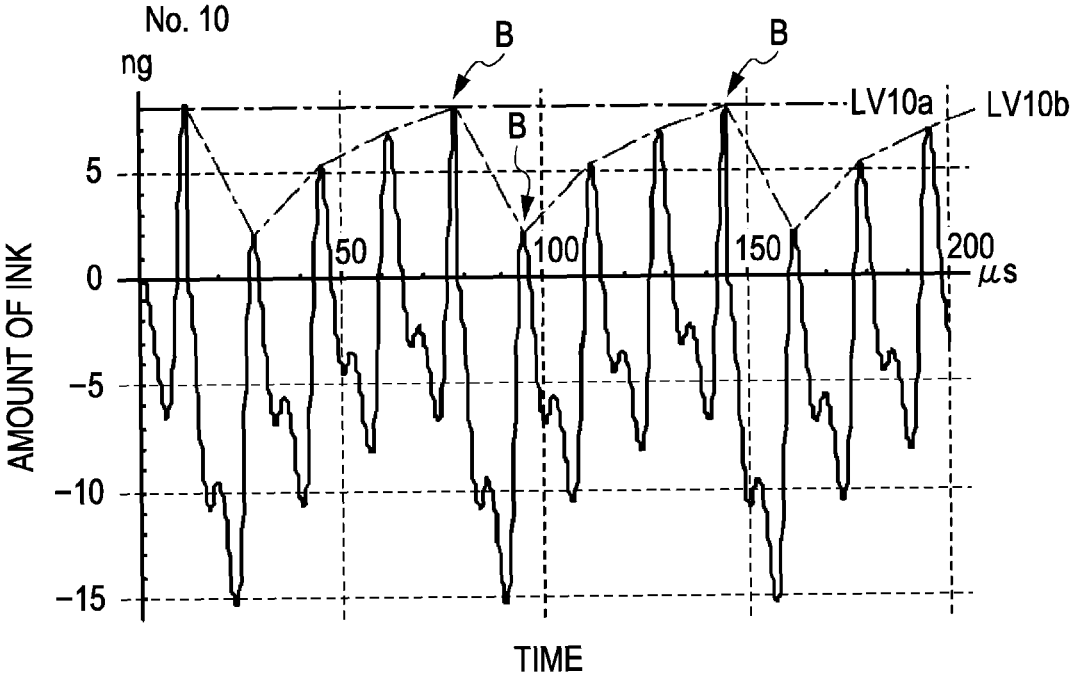
FIG. 21 illustrates results of a simulation in which No. 10 head is ejection-driven at 60 kHz.
Figure 22:
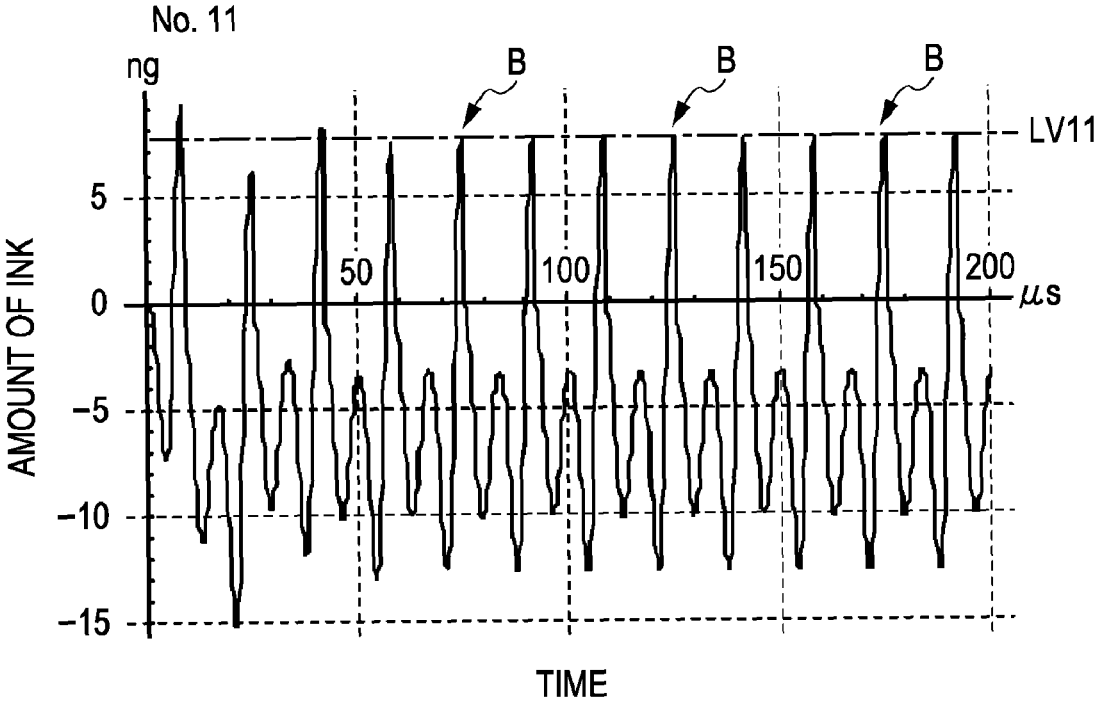
FIG. 22 illustrates results of a simulation in which No. 11 head is ejection-driven at 60 kHz.

Heads HD having an excessively low channel flow resistance R425 are No. 9 head HD through No. 12 head HD. As illustrated in FIG. 20 (No. 9 head HD) through FIG. 23 (No. 12 head HD), these heads eject an amount of ink smaller than the standard value (10 ng). For example, in comparison of No. 9 head HD with No. 10 head HD, fourth and subsequent ink drops are output at an maximum amount about 8.5 ng as represented by lines labeled LV9*a* and LV10*a*, respectively. No. 11 head HD and No. 12 head HD output fourth and subsequent ink drops at a uniform ejection amount of ink. The uniform ejection amount of ink is about 7.5 ng for No. 11 head HD (LV11) and about 8.5 ng for No. 12 head HD (LV12).

In addition, No. 9 head HD and No. 10 head HD suffer from a periodic change in the ejection amount. As represented by lines VL9*b* and LV10*b*, these heads HD repeatedly eject ink drops having four amount levels from the smallest ink drop (about 2 ng) to the largest ink drop (about 8 ng). The periodic change in the ejection amount is identical to that of No. 4 head HD.

The head HD having an excessively low channel flow resistance R425 suffers from an insufficient ejection amount, and the smaller the length L424 of the pressure compartment 424 becomes, the more unstable the ejection becomes.

Head HD Having an Excessively Short Length L424 of the Pressure Compartment 424

Heads HD having an excessively short length L424 of the pressure compartment 424 are No. 1 head HD, No. 5 head HD, No. 7 head HD, and No. 9 head HD illustrated in FIG. 7. With reference to FIG. 12 (No. 1 head HD), FIG. 16 (No. 5 head HD), FIG. 18 (No. 7 head HD), and FIG. 20 (No. 9 head HD), all these heads HD output an ejection amount of ink smaller than the standard value. For example, No. 1 head HD and No. 5 head HD output fourth and subsequent ink drops at a uniform amount of ink but the uniform amount of ink is about 8.5 ng (LV1 and LV5). As for No. 7 head HD and No. 9 head HD, maximum ejection amounts of the fourth and subsequent ink drops are about 6.5 ng (LV7*a*) for No. 7 head HD, and about 8 ng (LV9*a*) for No. 9 head HD.

In addition, No. 7 head HD and No. 9 head HD suffer from a periodic change in the ejection amount. As represented by line VL7*b*, No. 7 head HD ejects alternately a large ink drop (about 6.5 ng) and a small ink drop (about 3 ng). As represented by line VL9*b*, No. 9 head HD repeatedly eject ink drops having four amount levels from the smallest ink drop (about 2 ng) to the largest ink drop (about 8 ng).

The head HD having an excessively short length L424 of the pressure compartment 424 suffers from an insufficient ejection amount, and the lower the channel flow resistance R425 becomes, the more unstable the ejection becomes. Head HD Having an Excessively Long Length L424 of the Pressure Compartment 424

Figure 15:
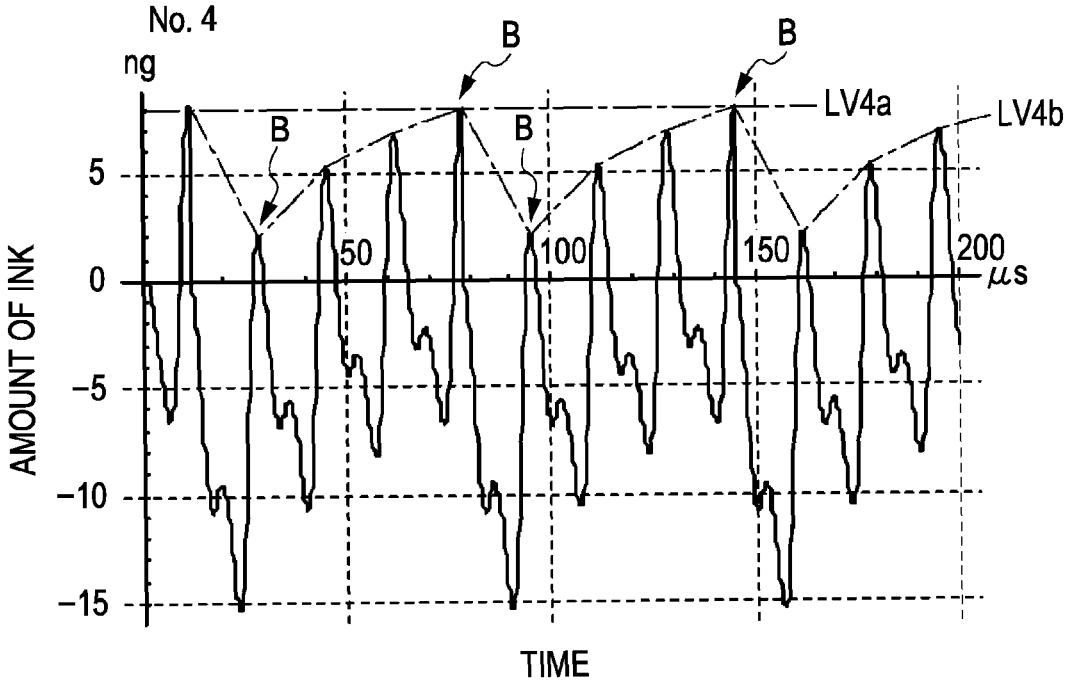
FIG. 15 illustrates results of a simulation in which No. 4 head is ejection-driven at 60 kHz.
Figure 16:
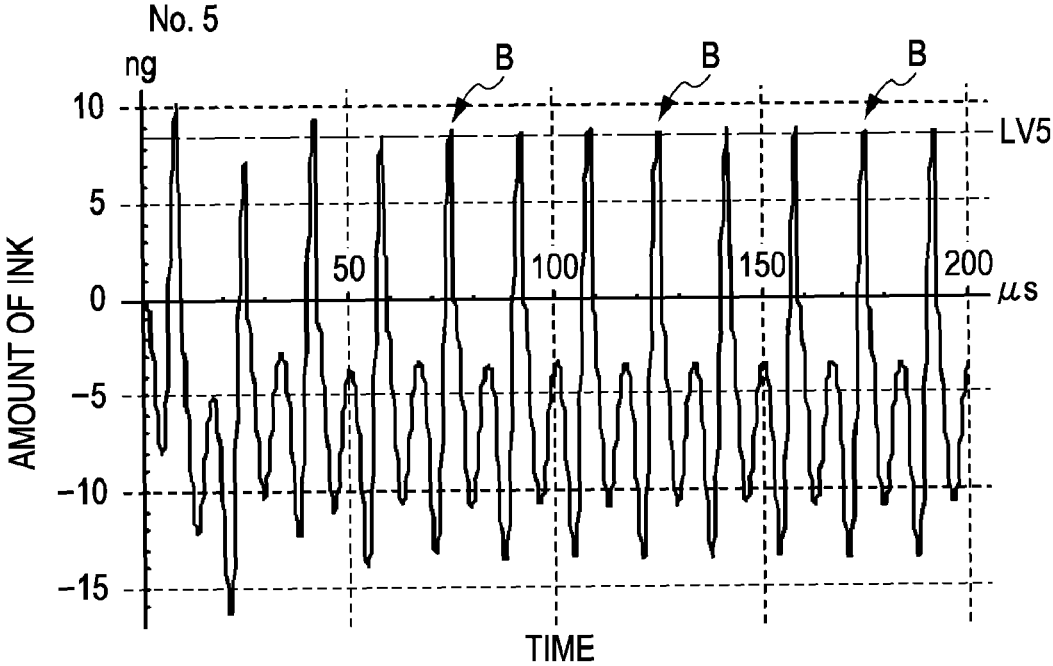
FIG. 16 illustrates results of a simulation in which No. 5 head is ejection-driven at 60 kHz.
Figure 17:
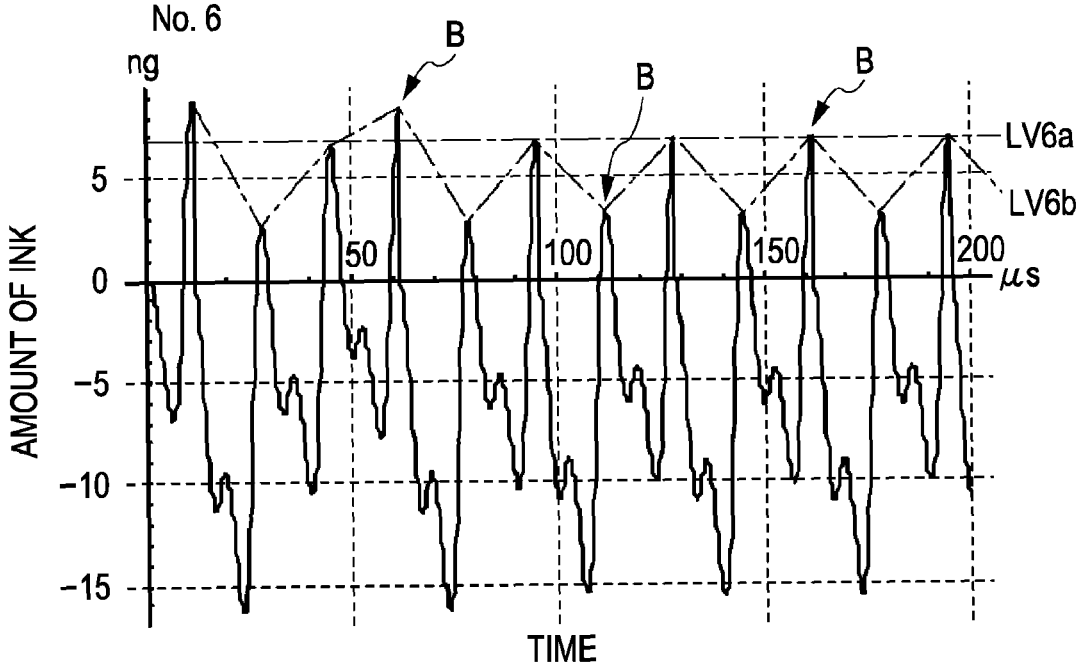
FIG. 17 illustrates results of a simulation in which No. 6 head is ejection-driven at 60 kHz.
Figure 18:
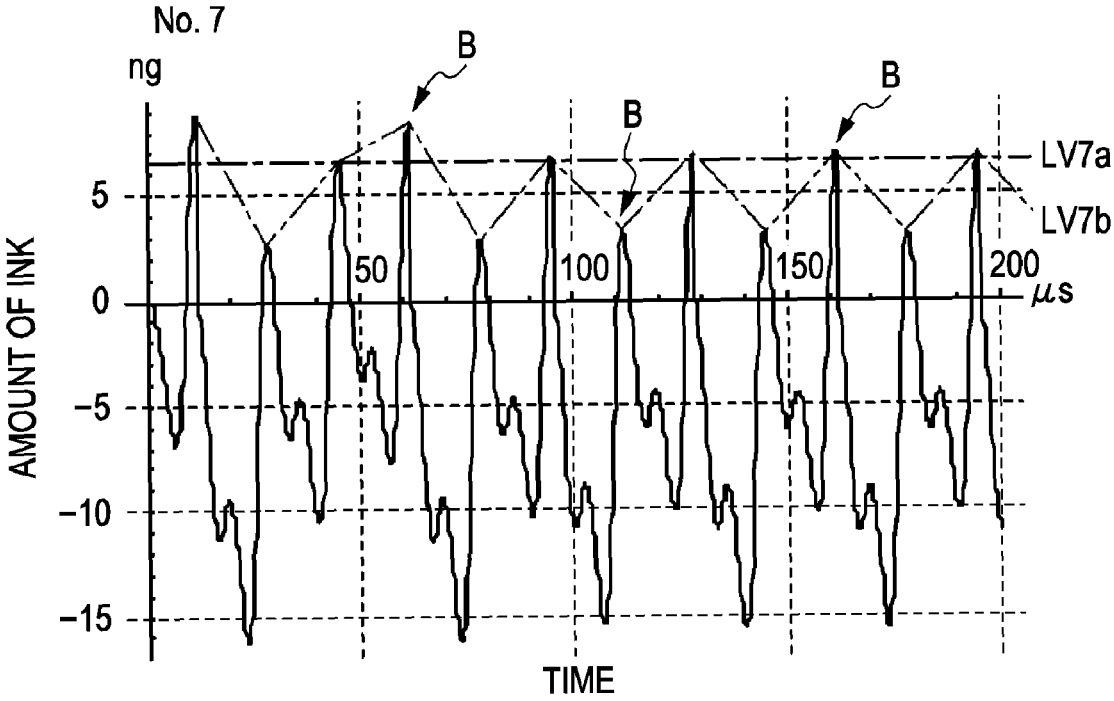
FIG. 18 illustrates results of a simulation in which No. 7 head is ejection-driven at 60 kHz.
Figure 19:
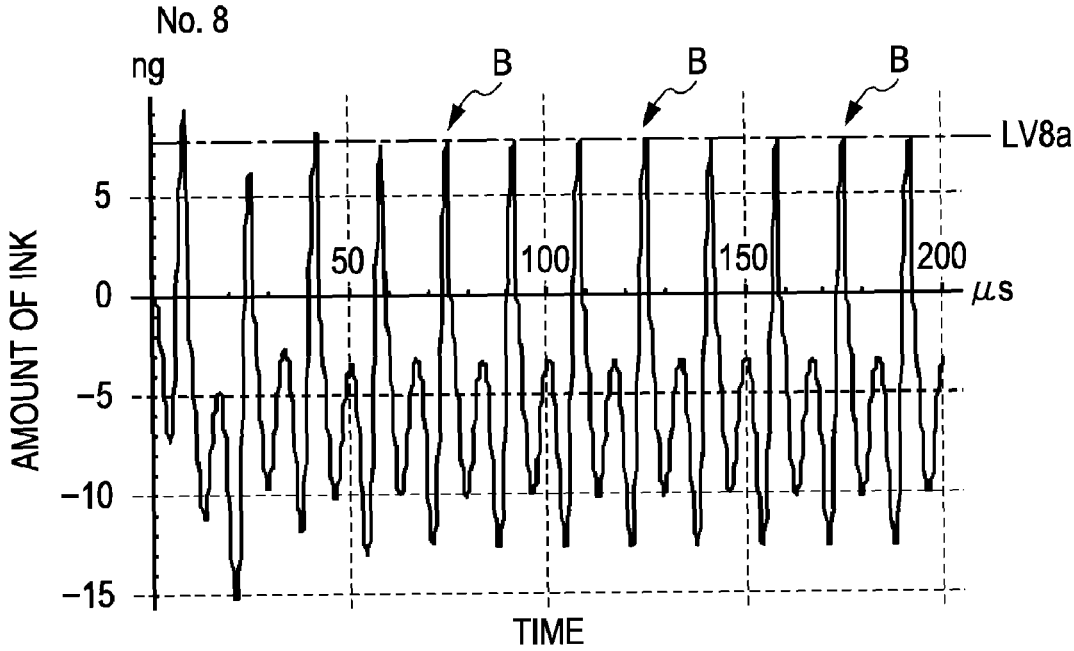
FIG. 19 illustrates results of a simulation in which No. 8 head is ejection-driven at 60 kHz.

Heads HD having an excessively long length L424 of the pressure compartment 424 are No. 4 head HD, No. 6 head HD, No. 8 head HD, and No. 12 head HD as illustrated in FIG. 7. With reference to FIG. 15 (No. 4 head HD), FIG. 17 (No. 6 head HD), FIG. 19 (No. 8 head HD), and FIG. 23 (No. 12 head HD), all these heads HD output ink drops, each at an ejection amount of ink smaller than the standard value. For example, No. 4 head HD ejects the ink drop at the maximum amount of ink of about 8 ng (LV4*a*), and No. 6 head HD ejects the ink drop at the maximum amount of ink of about 6.5 ng (LV6*a*). No. 8 head HD and No. 12 head HD output fourth and subsequent ink drops at a uniform amount of ink but the uniform amount of ink is about 7.5 ng for No. 8 head HD (LV8), and the uniform amount of ink is about 8.5 ng for No. 12 head HD (LV12).

In addition, No. 4 head HD and No. 6 head HD suffer from a periodic change in the ejection amount. As represented by line VL4*b*, No. 4 head HD repeatedly ejects ink drops having four amount levels from the smallest ink drop (about 2 ng) to the largest ink drop (about 8 ng). As represented by line VL6*b*, No. 6 head HD ejects alternately a large ink drop (about 6.5 ng) and a small ink drop (about 3 ng).

The head HD having an excessively long length L424 of the pressure compartment 424 suffers from an insufficient ejection amount, and the higher the channel flow resistance R425 of the ink supply 425 becomes, the more unstable the ejection becomes.

Change in the Ejection Amount Due to Ejection Frequency

Figure 24:
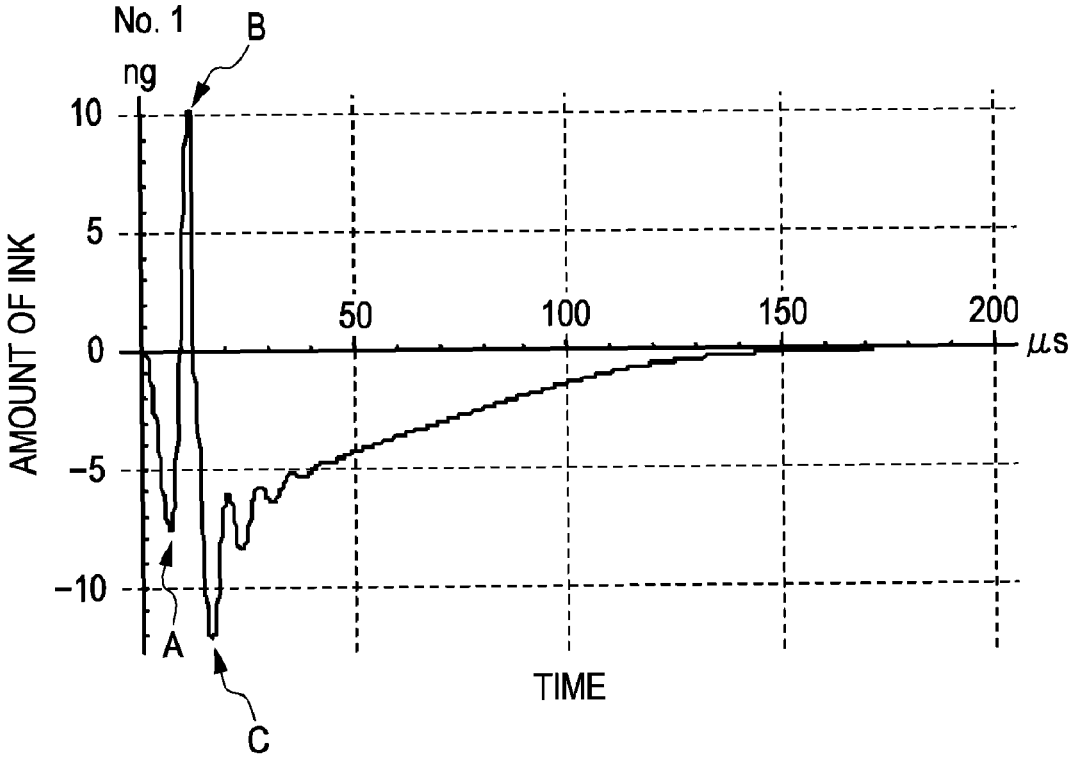
FIG. 24 illustrates results of a simulation in which a drop of ink is ejected using No. 1.
Figure 25:
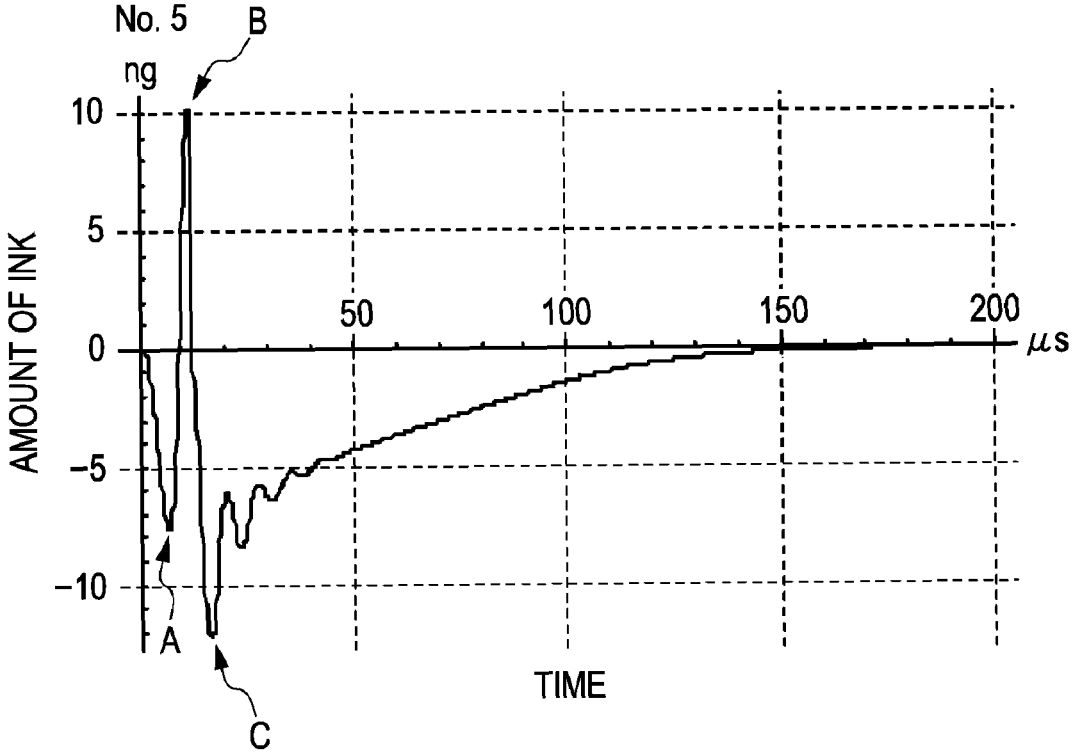
FIG. 25 illustrates results of a simulation in which a drop of ink is ejected using No. 5.
Figure 26:
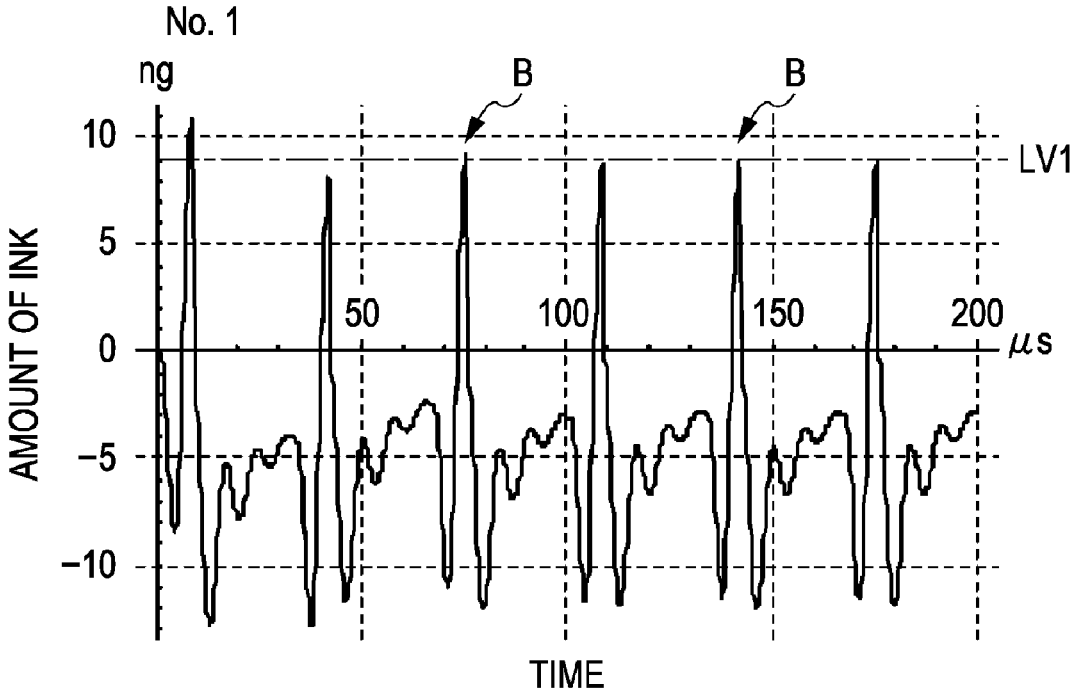
FIG. 26 illustrates results of a simulation in which No. 1 head is ejection-driven at 30 kHz.
Figure 27:
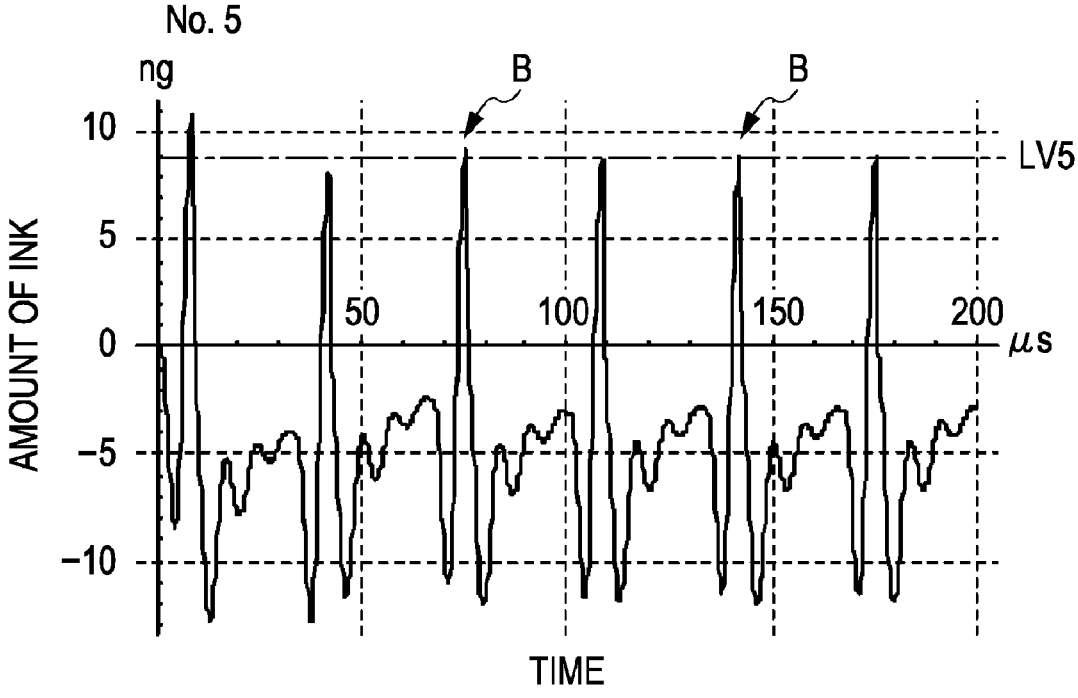
FIG. 27 illustrates results of a simulation in which No. 5 head is ejection-driven at 30 kHz.

Changes in the ejection amount of the previously discussed No. 1 head HD and No. 5 head HD due to the ejection frequency are discussed below. With reference to FIG. 24 (No. 1 head HD) and FIG. 25 (No. 5 head HD), No. 1 head HD and No. 5 head HD eject the ink drops, each drop at an ejection amount equal to or larger than the standard value. However, if the ejection frequency is set to be 30 Hz as illustrated in FIG. 26 (No. 1 head HD) and FIG. 27 (No. 5 head HD), the ejection amount of these heads HD fails to reach the standard value. In this case, each of No. 1 head HD and No. 5 head HD outputs the ejection amount reduced to about 8.5 ng.

Figure 29:
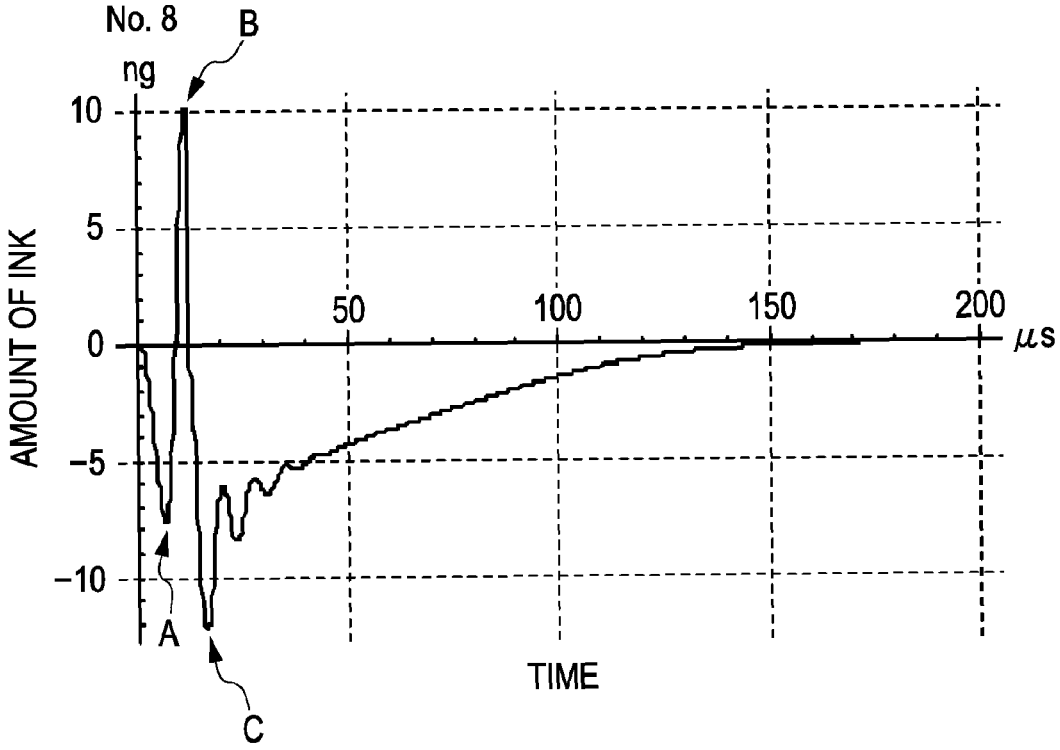
FIG. 29 illustrates results of a simulation in which a drop of ink is ejected using No. 8.
Figure 30:
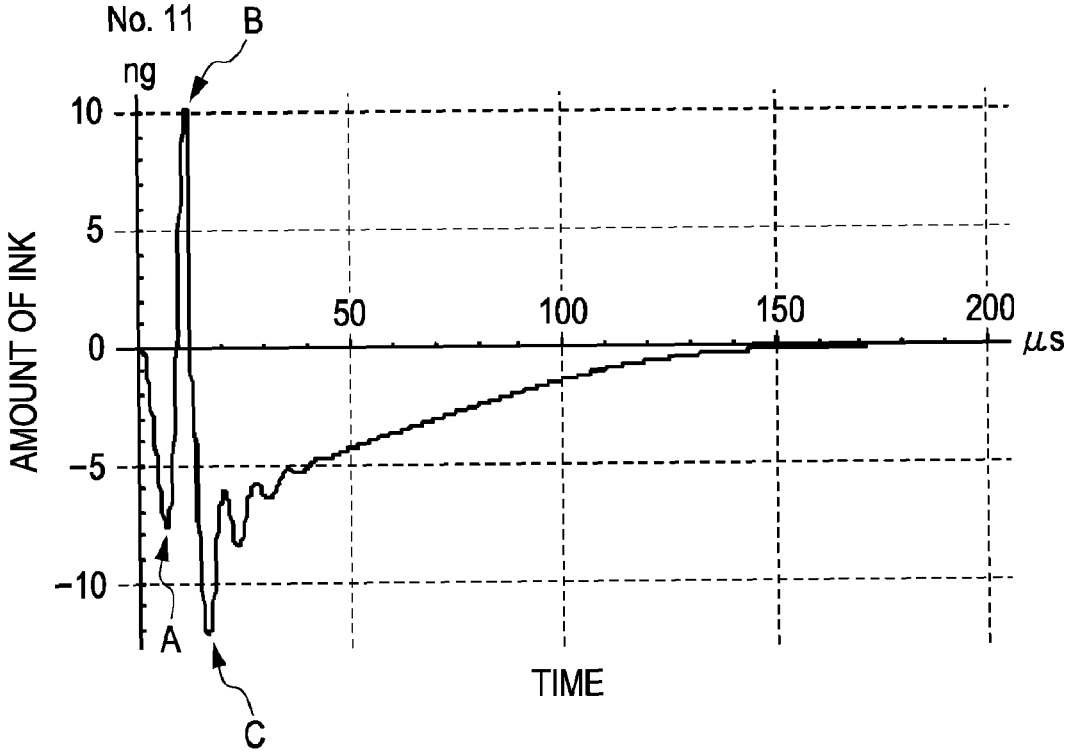
FIG. 30 illustrates results of a simulation in which a drop of ink is ejected using No. 11.
Figure 31:
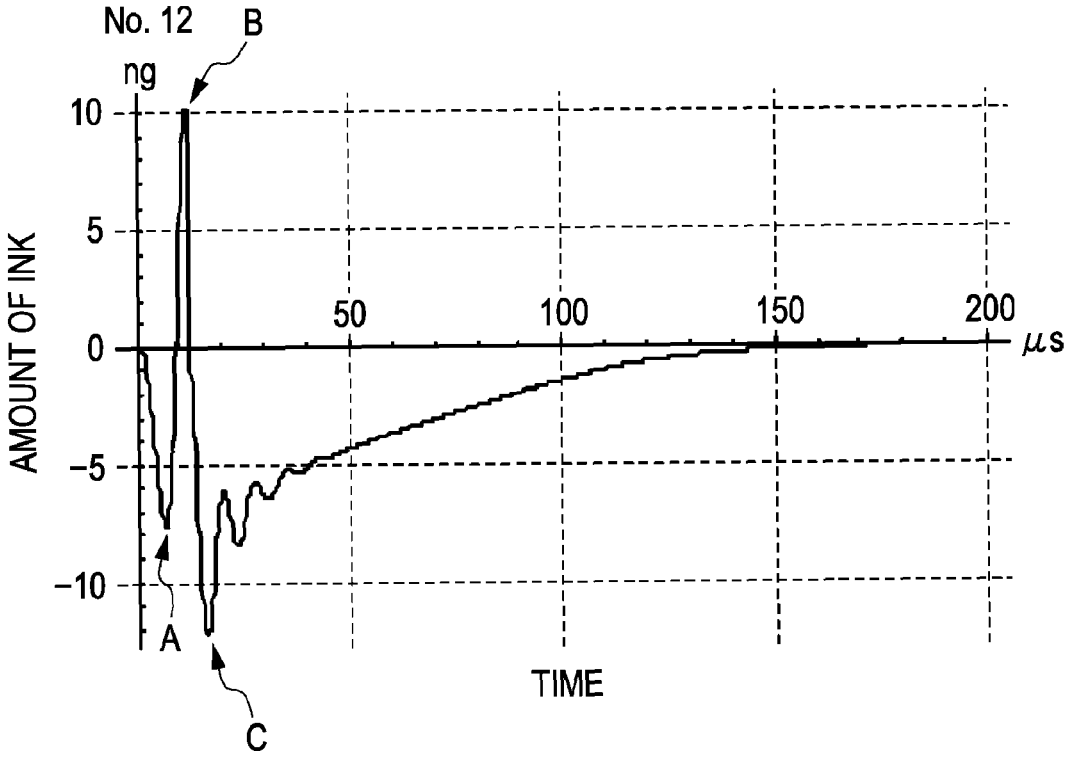
FIG. 31 illustrates results of a simulation in which a drop of ink is ejected using No. 12.
Figure 33:
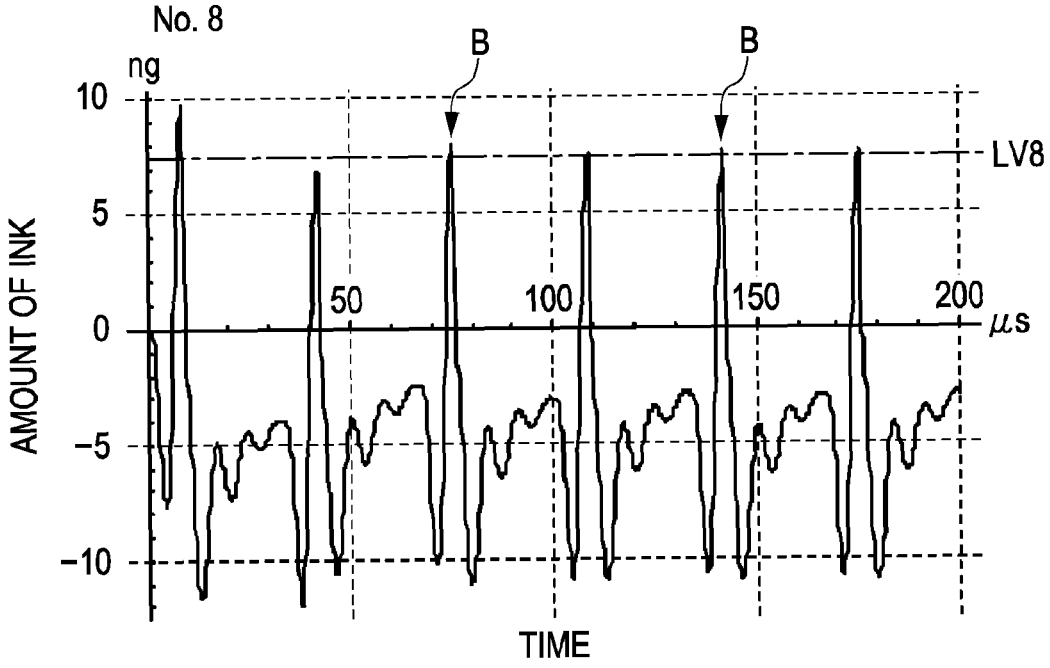
FIG. 33 illustrates results of a simulation in which No. 8 head is ejection-driven at 30 kHz.
Figure 34:
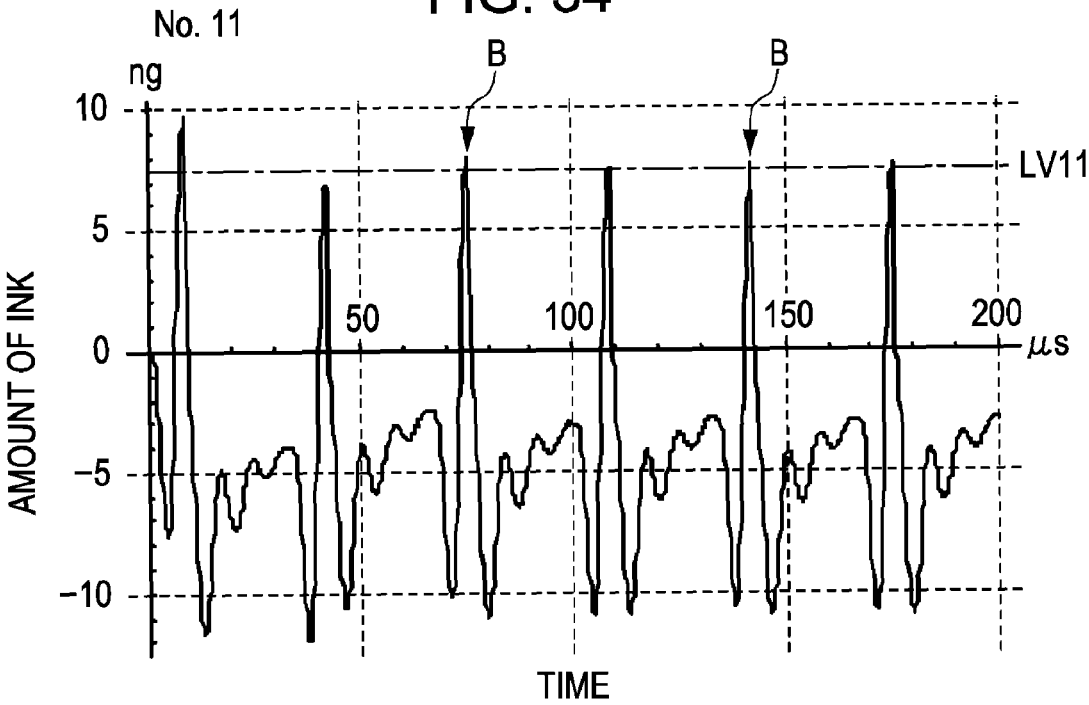
FIG. 34 illustrates results of a simulation in which No. 11 head is ejection-driven at 30 kHz.
Figure 35:
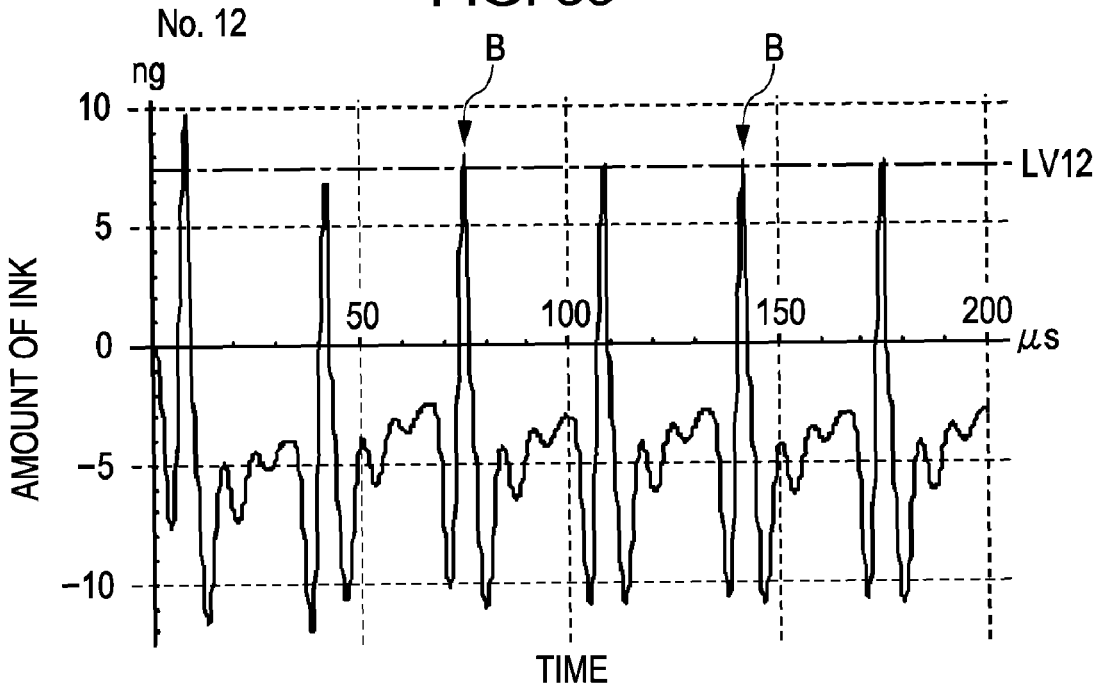
FIG. 35 illustrates results of a simulation in which No. 12 head is ejection-driven at 30 kHz.

Changes in the ejection amount of the previously discussed No. 8 head HD, No. 11 head HD, and No. 12 head HD due to the ejection frequency are also discussed below. With reference to FIG. 29 (No. 8 head HD), FIG. 30 (No. 11 head HD), and FIG. 31 (No. 12 head HD), No. 8 head HD, No. 11 head HD, and No. 12 head HD output an ejection amount equal to or larger than the standard value when a single ink drop is ejected. However, if the ejection frequency is set to be 30 Hz as illustrated in FIG. 33 (No. 8 head HD), FIG. 34 (No. 11 head HD), and FIG. 35 (No. 12 head HD), the ejection amount of these heads HD fails to reach the standard value. In this case, each of No. 8 head HD, No. 11 head HD, and No. 12 head HD outputs the ejection amount reduced to about 7.5 ng.

Figure 28:
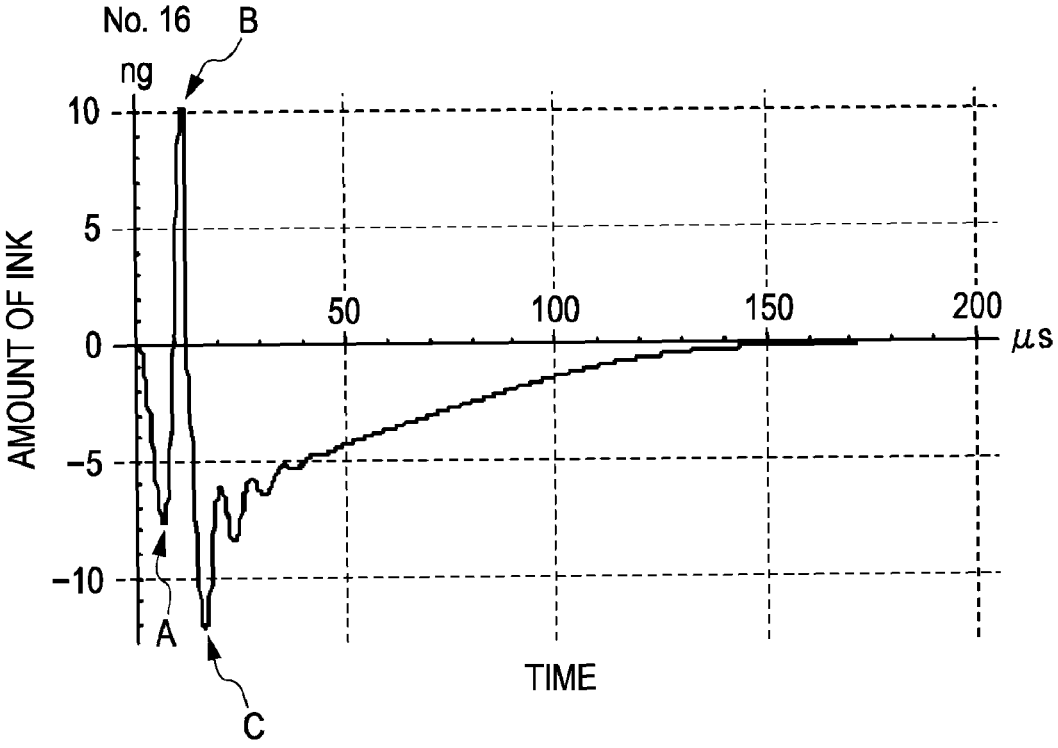
FIG. 28 illustrates results of a simulation in which a drop of ink is ejected using No. 16.
Figure 32:
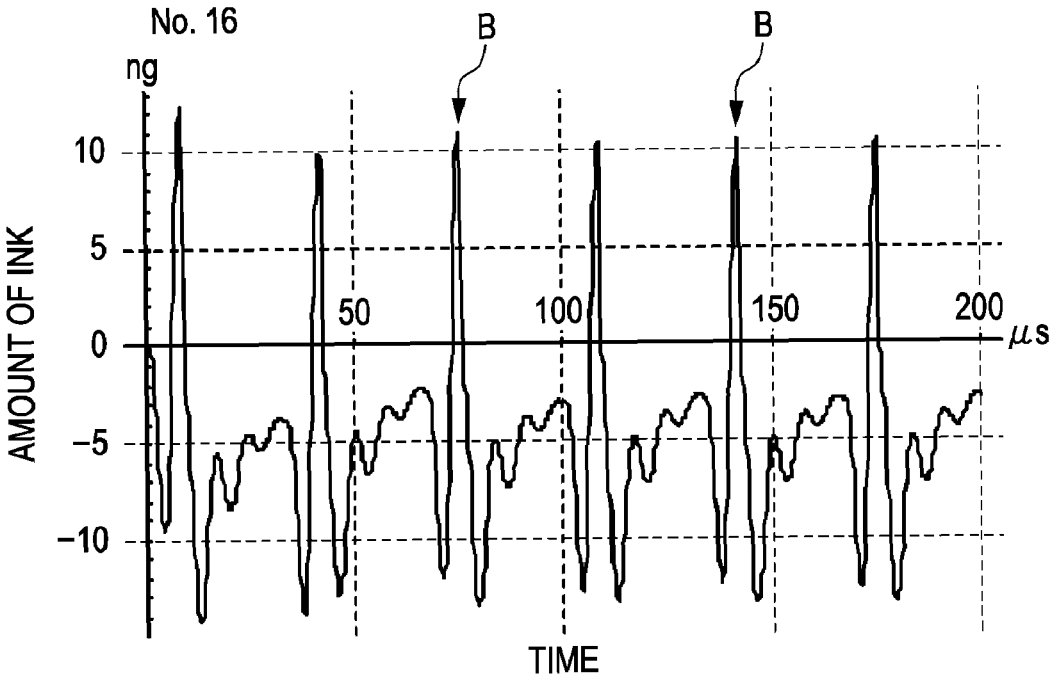
FIG. 32 illustrates results of a simulation in which No. 16 head is ejection-driven at 30 kHz.

In contrast, No. 16 head HD outputs an ejection amount equal to or larger than the standard value as illustrated in FIGS. 28 and 32 regardless of whether the ejection operation is performed on a single drop ejection or a 30 kHz ejection frequency operation. The difference between the heads HD of the embodiment of the invention and the comparative heads HD is thus significant in the change in the ejection amount.

Ink Having a Viscosity of 6 mPa·s

In the above-described evaluation tests, ink used is 15 mPa·s. Ink having a viscosity of 6 mPa·s is similarly ejected using the channel flow resistance R425 of the ink supply 425 and the length L424 of the pressure compartment 424 determined as described above. More specifically, the channel flow resistance R425 of the ink supply 425 is set to be within a range from equal to or higher than the channel flow resistance R424 of the pressure compartment 424 to equal to or lower than twice the channel flow resistance R424 of the pressure compartment 424, and the length L424 of the pressure compartment 424 is set to be within a range of from equal to or longer than the length L425 of the ink supply 425 to equal to or shorter than twice the length L425 of the ink supply 425. With this arrangement, ink drops, each drop equal to or heavier than 10 ng, can be ejected at a frequency as high as 60 kHz.

Low viscosity ink causes a low channel flow resistance. Evaluation tests may also be performed on a low channel flow resistance R425 of the ink supply 425. In view of evaluation results of ink having 15 mPa·s, No. 7 head HD, No. 9 head HD, and No. 10 head HD suffer more from an insufficient ejection amount and ejection instability as well than No. 8 head HD, No. 11 head HD, and No. 12 head HD. No. 7 head HD, No. 9 head HD, and No. 10 head HD are thus more subject to the effect of channel flow resistance.

It suffices if each of No. 15 head HD, No. 7 head HD, No. 9 head HD, and No. 10 head HD is evaluated on ink having 6 mPa·s. In other words, if No. 15 head HD ejects stably ink having a viscosity of 6 mPa·s, each of No. 13 head HD, No. 14 head HD, and No. 16 head HD can also eject stably the ink at a high frequency.

Figure 36:
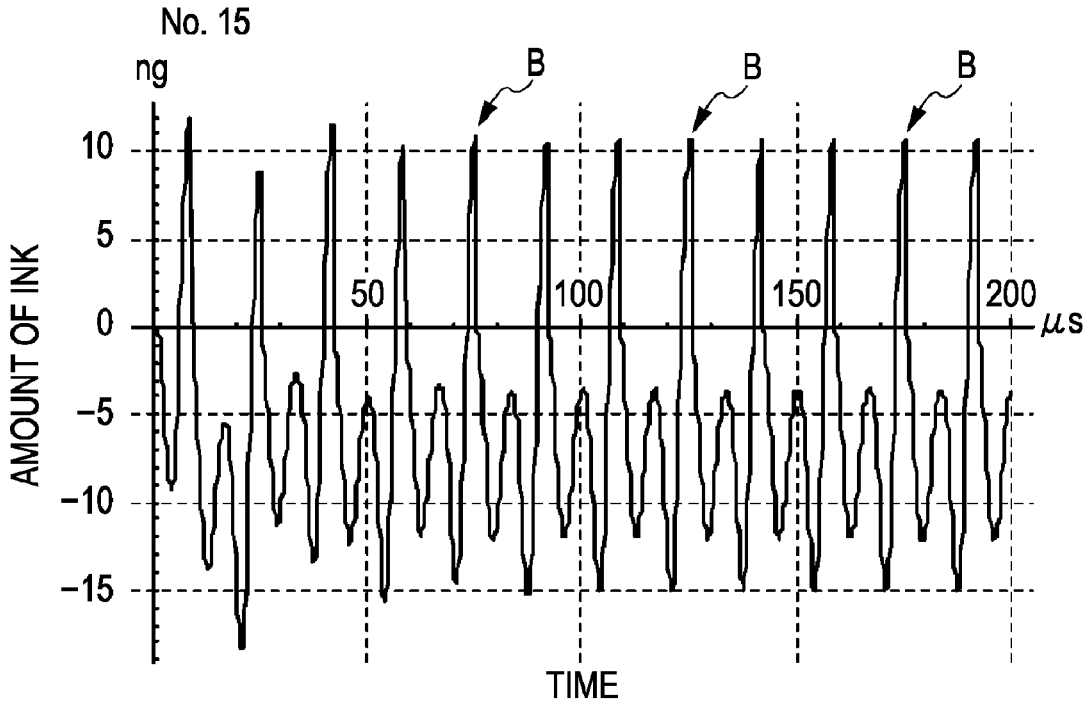
FIG. 36 illustrates results of a simulation in which ink having a viscosity of 6 mPa·s is ejected at 60 kHz using No. 15 head.

FIG. 36 illustrates tests of a simulation in which No. 15 head HD ejects ink having a viscosity of 6 mPa·s (a specific gravity of about 1) at a frequency of 60 kHz. No. 15 head HD stably ejects fourth and subsequent ink drops, each drop at a mount of about 11 ng. The test results also show that No. 15 head HD satisfies the previously described evaluation criteria. In other words, No. 15 head HD ejects reliably the ink drops, each drop having a viscosity of 6 mPa·s, even at a high frequency.

Figure 37:
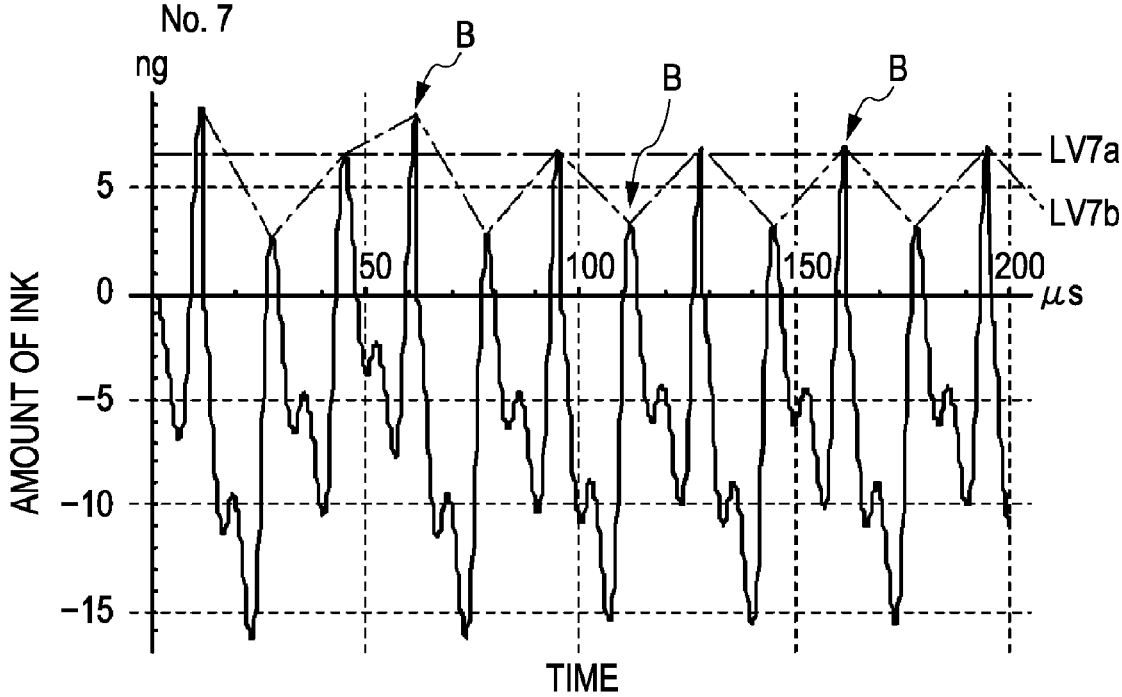
FIG. 37 illustrates results of a simulation in which ink having a viscosity of 6 mPa·s is ejected at 60 kHz using No. 7 head.
Figure 38:
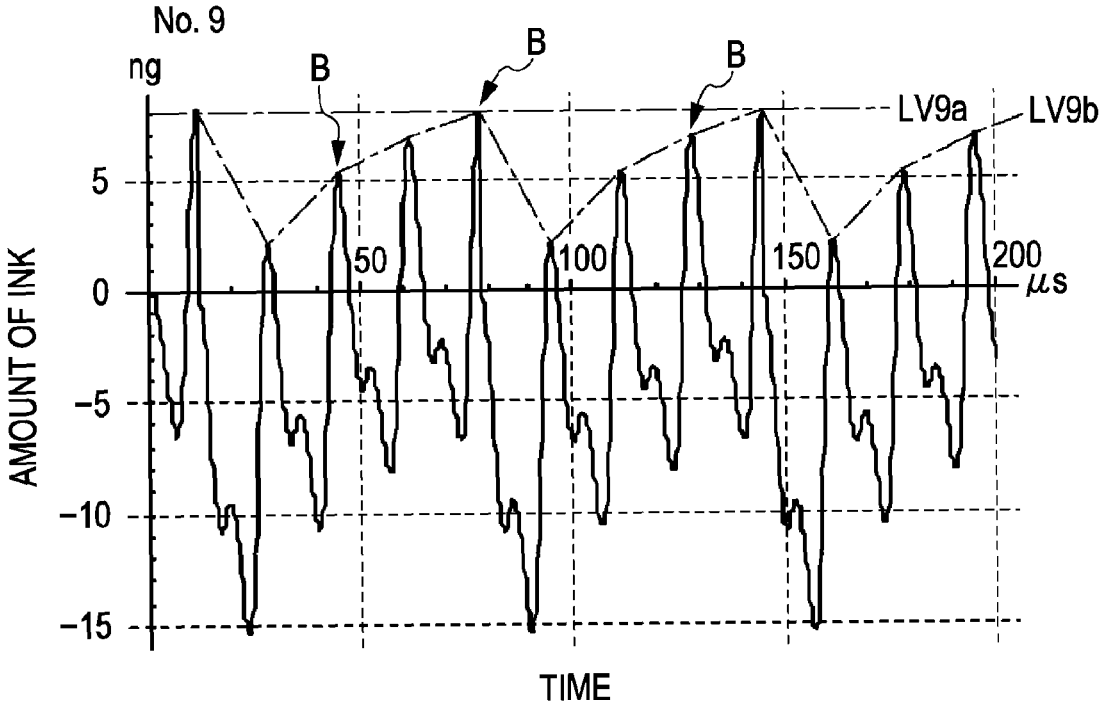
FIG. 38 illustrates results of a simulation in which ink having a viscosity of 6 mPa·s is ejected at 60 kHz using No. 9 head.
Figure 39:
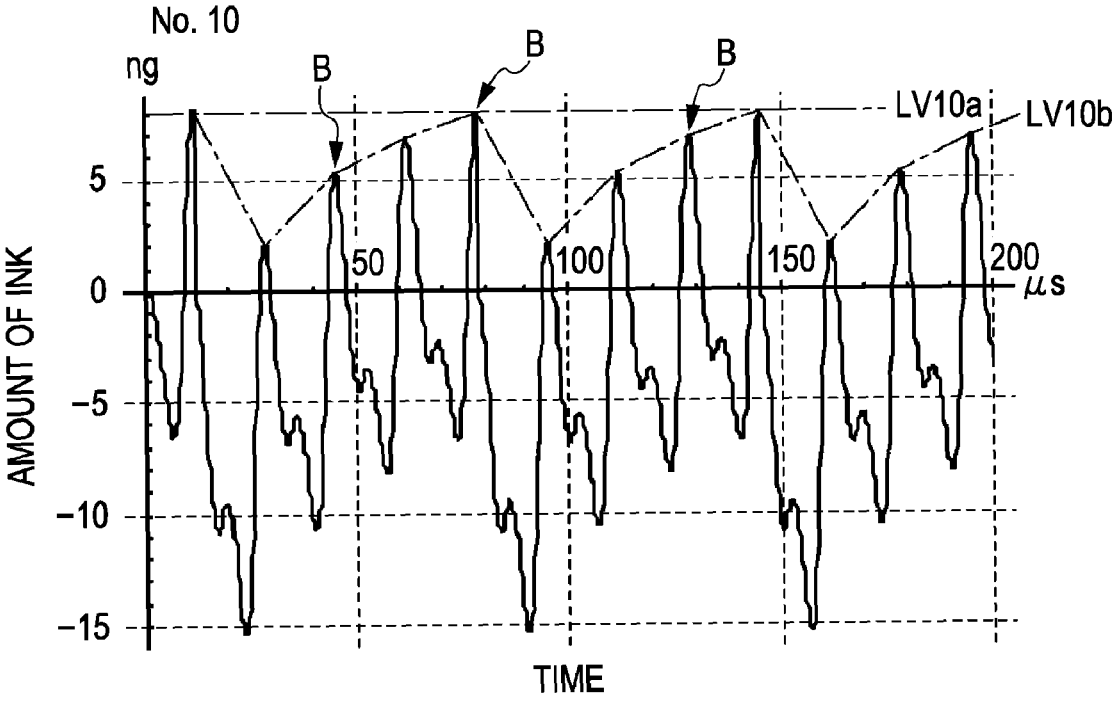
FIG. 39 illustrates results of a simulation in which ink having a viscosity of 6 mPa·s is ejected at 60 kHz using No. 10 head.

FIGS. 37-39 illustrate results of a simulation test in which No. 7 head HD, No. 9 head HD, and No. 10 head HD eject ink drops, each having a viscosity of 6 mPa·s, at a frequency of 60 kHz. As illustrated, the maximum amount of each ink drop ejected by each of these heads HD fails to reach the standard value (10 ng). See lines LV7*a*, LV9*a*, and LV10*a*. The ejection amount also suffers from changes (as represented by lines LV7*b*, LV9*b*, and LV10*b*). From these results, each of No. 7 head HD, No. 9 head HD, and No. 10 head HD suffers from an insufficient and unstable ink amount if the ink drop having a viscosity of 6 mPa·s is ejected at the high frequency.

Other Ejection Pulse PS2

Figure 40:
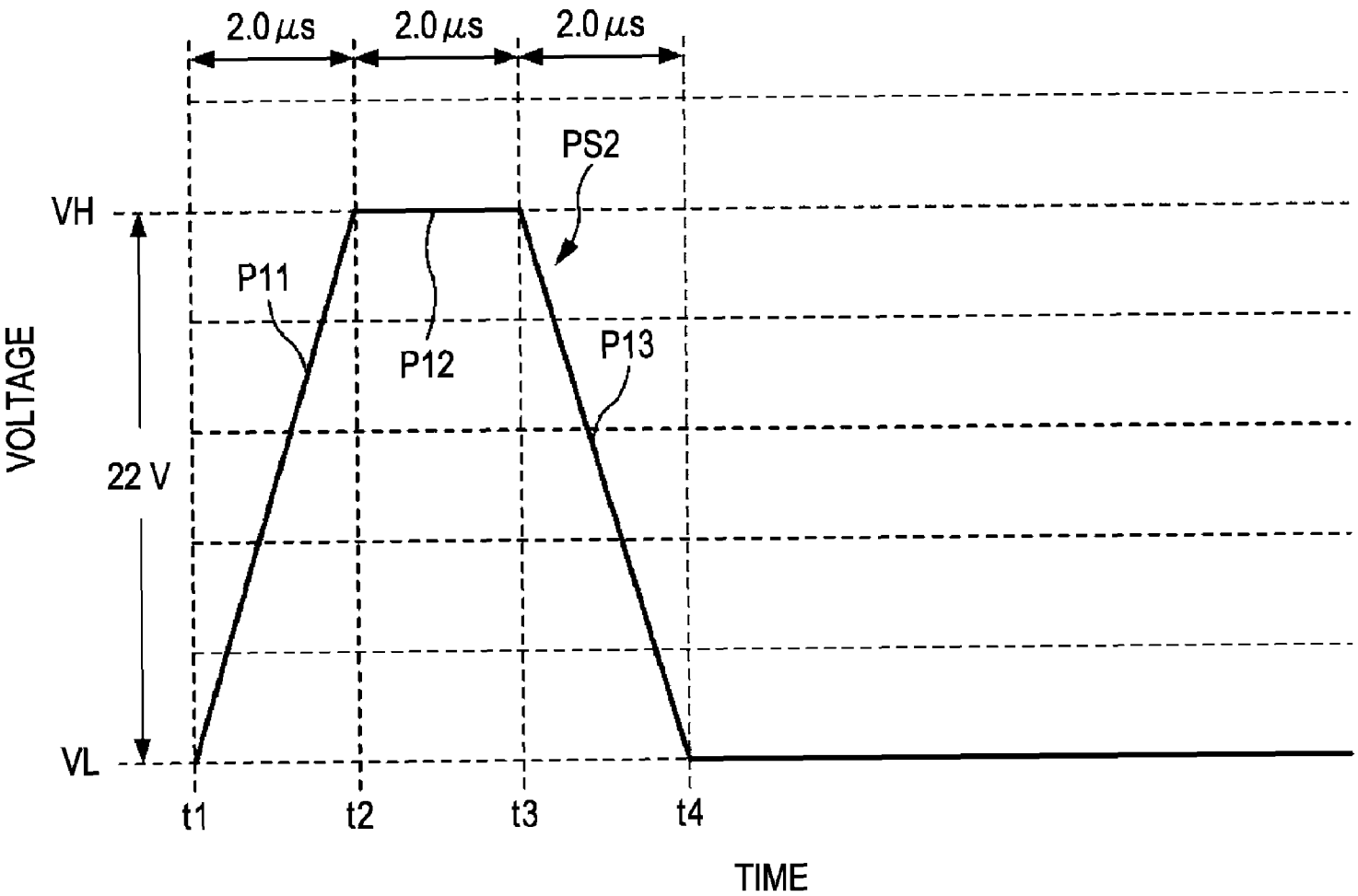
FIG. 40 illustrates another ejection pulse used in evaluation.

Results of evaluation tests performed using the other ejection pulse PS2 different from the ejection pulse PS1 are described below. FIG. 40 illustrates the other ejection pulse PS2. With reference to FIG. 40, the ordinate represents the voltage of the drive signal COM, and the abscissa represents time. The ejection pulse PS2 contains a plurality of portions labeled by reference characters P11 through P13. More specifically, the ejection pulse PS2 is defined by a voltage change pattern having a trapezoidal shape, and contains the depressurized portion P11, the voltage held portion P12, and the pressurized portion P13.

The depressurized portion P11 has the lowest voltage VL as a starting voltage at timing t1, and the highest voltage VH as an ending voltage at timing t2. The generation period of the depressurized portion P11 of the ejection pulse PS2 is 2.0 μs. The voltage held portion P12 is generated from timing t2 to timing t3, and remains constant at the highest voltage VH. The generation period of the voltage held portion P12 of the ejection pulse PS2 is 2.0 μs. The pressurized portion P13 has the highest voltage VH as a starting voltage at timing t3 and the lowest voltage VL as an ending voltage at timing t4. The generation period of the pressurized portion P13 of the ejection pulse PS2 is 2.0 μs.

Figure 41:
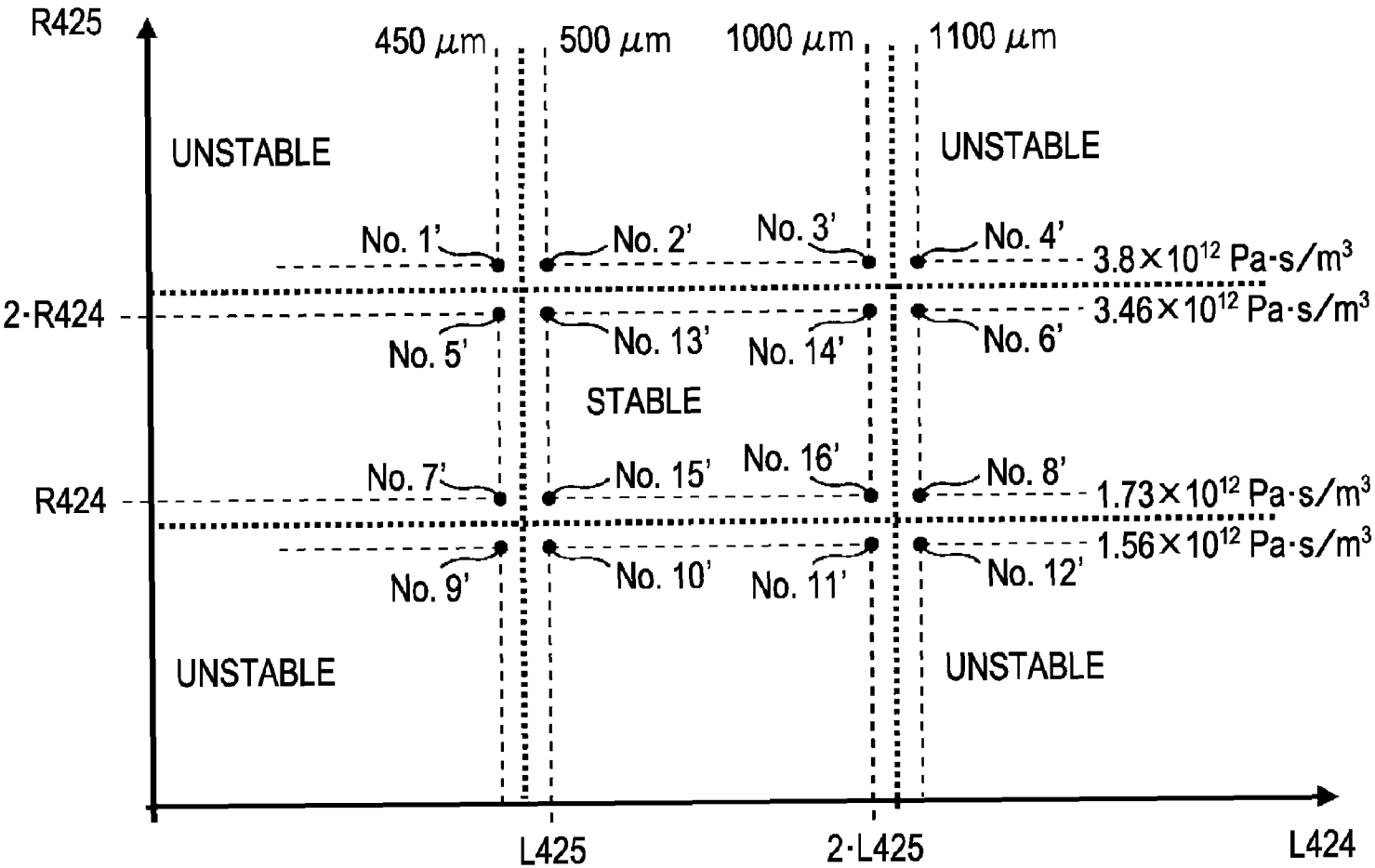
FIG. 41 illustrates structural parameters of each head to be evaluated.
Figure 42:
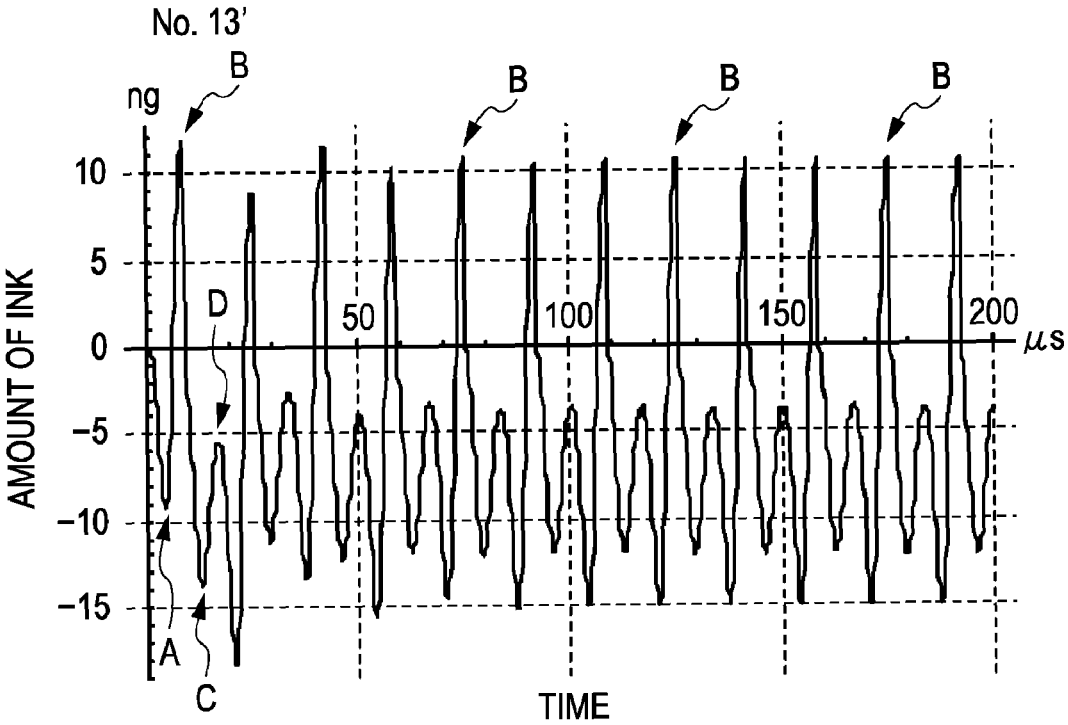
FIG. 42 illustrates results of a simulation in which No. 13' head is ejection-driven at 60 kHz.
Figure 43:
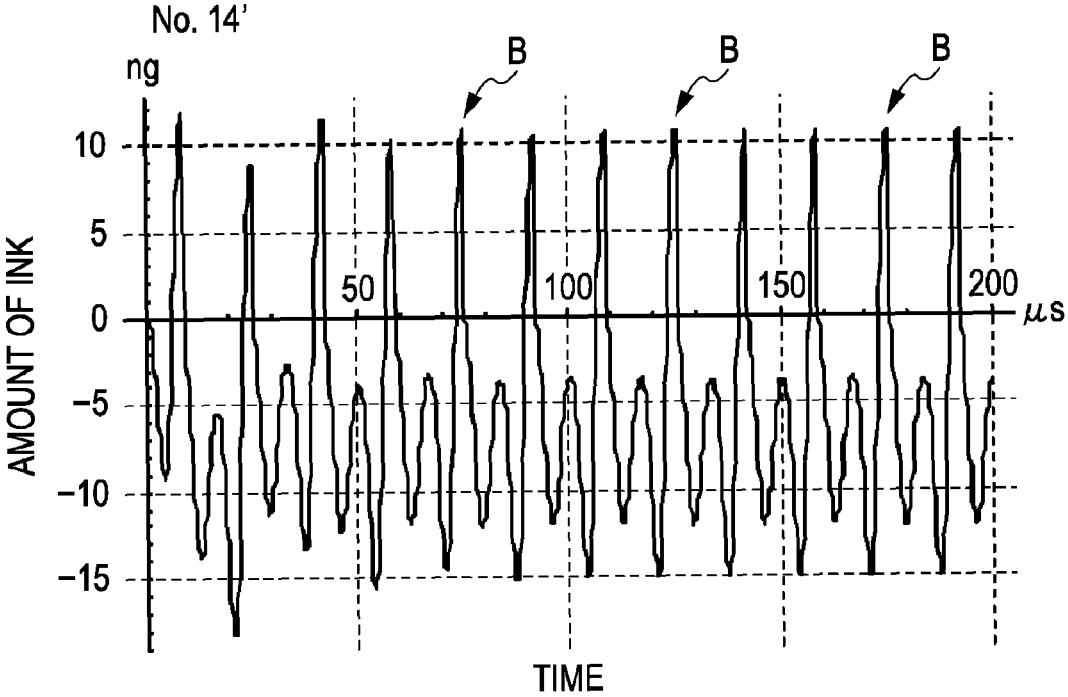
FIG. 43 illustrates results of a simulation in which No. 14' head is ejection-driven at 60 kHz.
Figure 44:
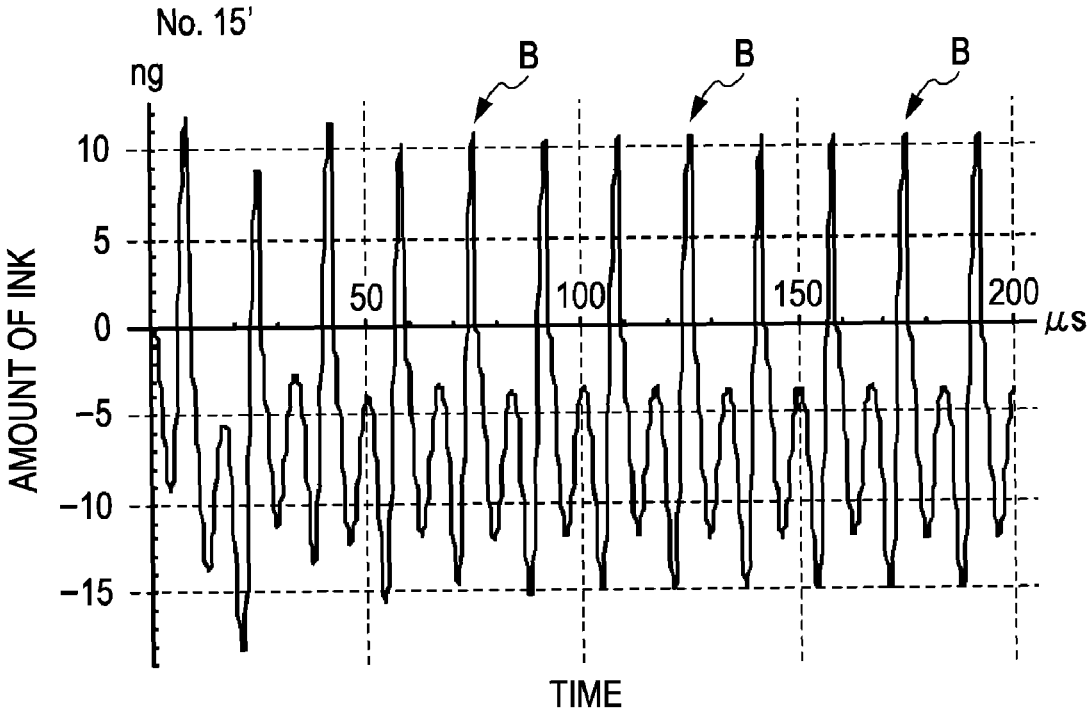
FIG. 44 illustrates results of a simulation in which No. 15' head is ejection-driven at 60 kHz.
Figure 45:
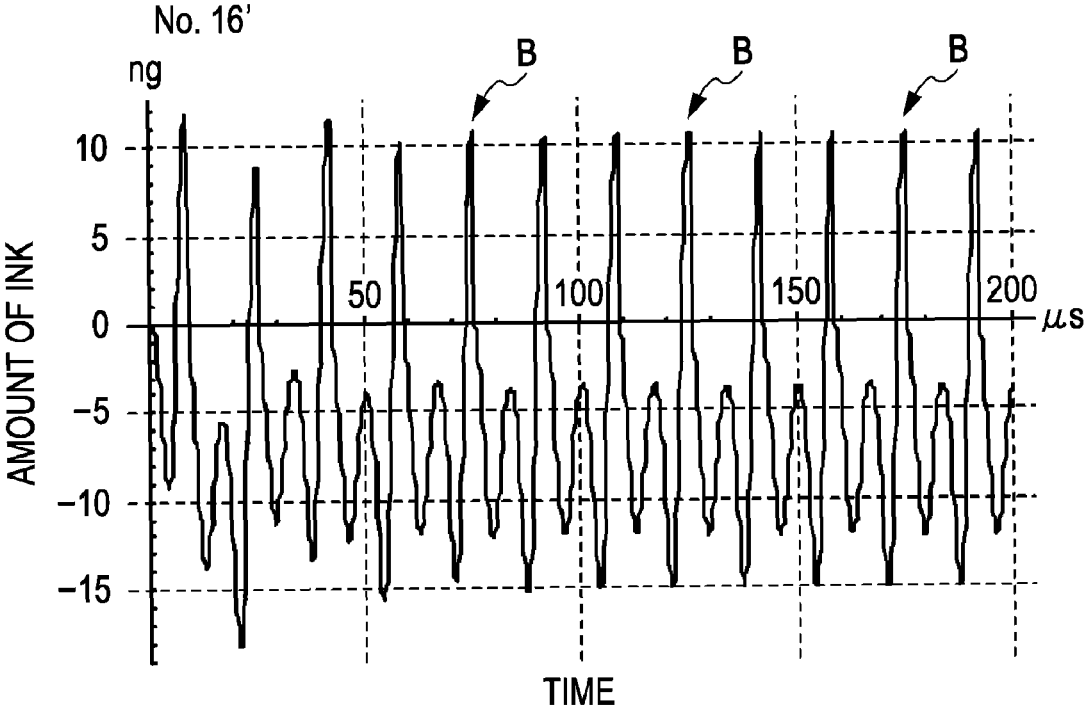
FIG. 45 illustrates results of a simulation in which No. 16' head is ejection-driven at 60 kHz.
Figure 46:
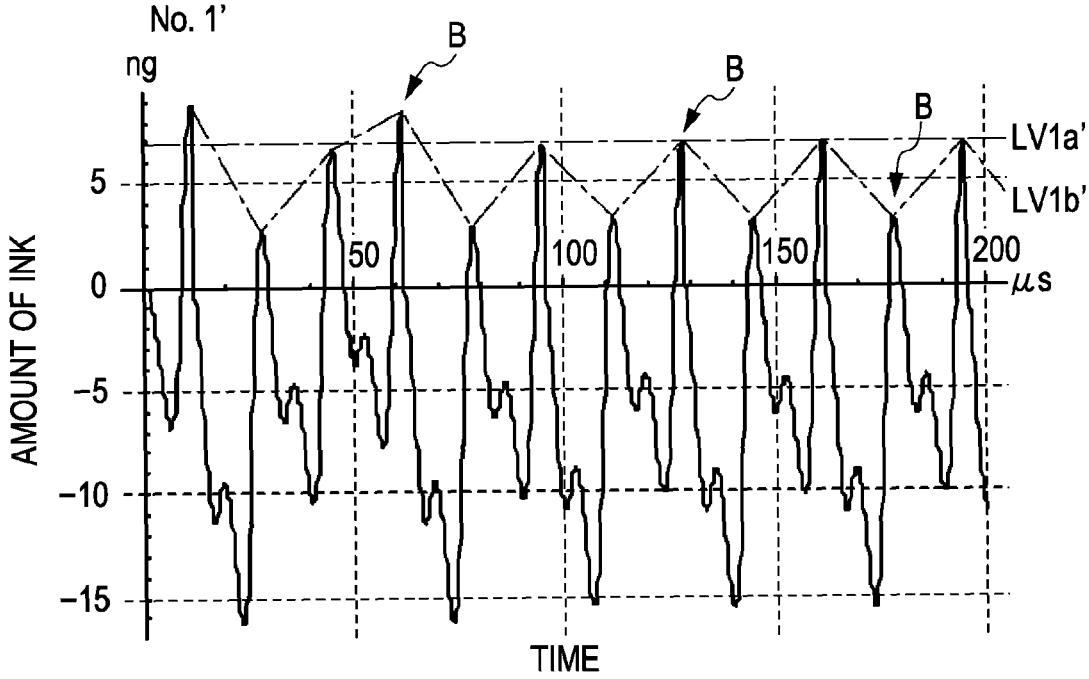
FIG. 46 illustrates results of a simulation in which No. 1' head is ejection-driven at 60 kHz.
Figure 47:
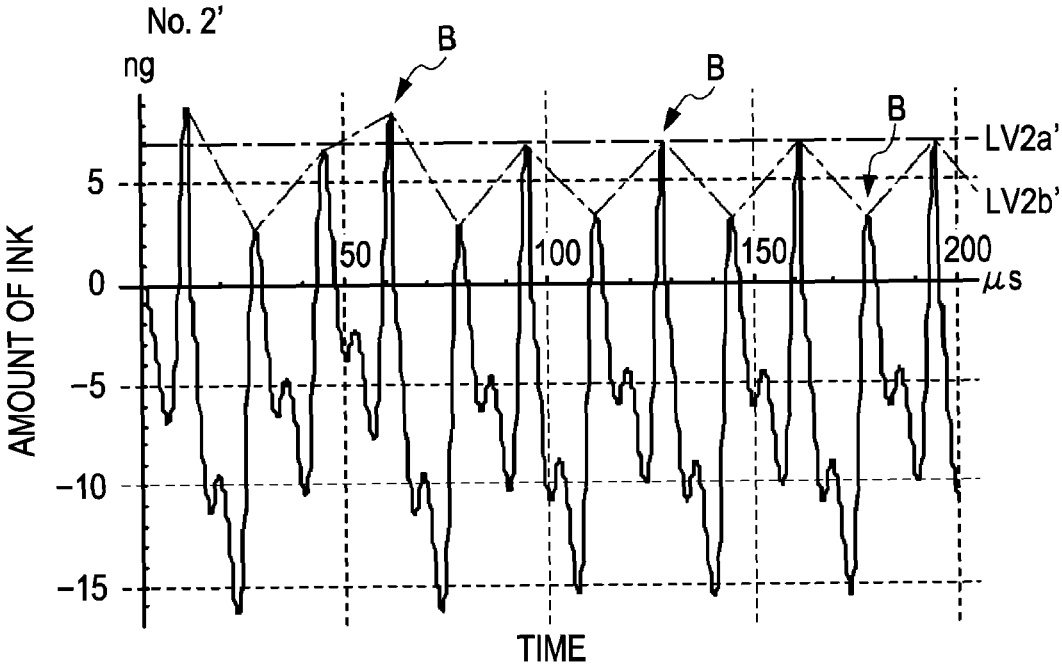
FIG. 47 illustrates results of a simulation in which No. 2' head is ejection-driven at 60 kHz.
Figure 48:
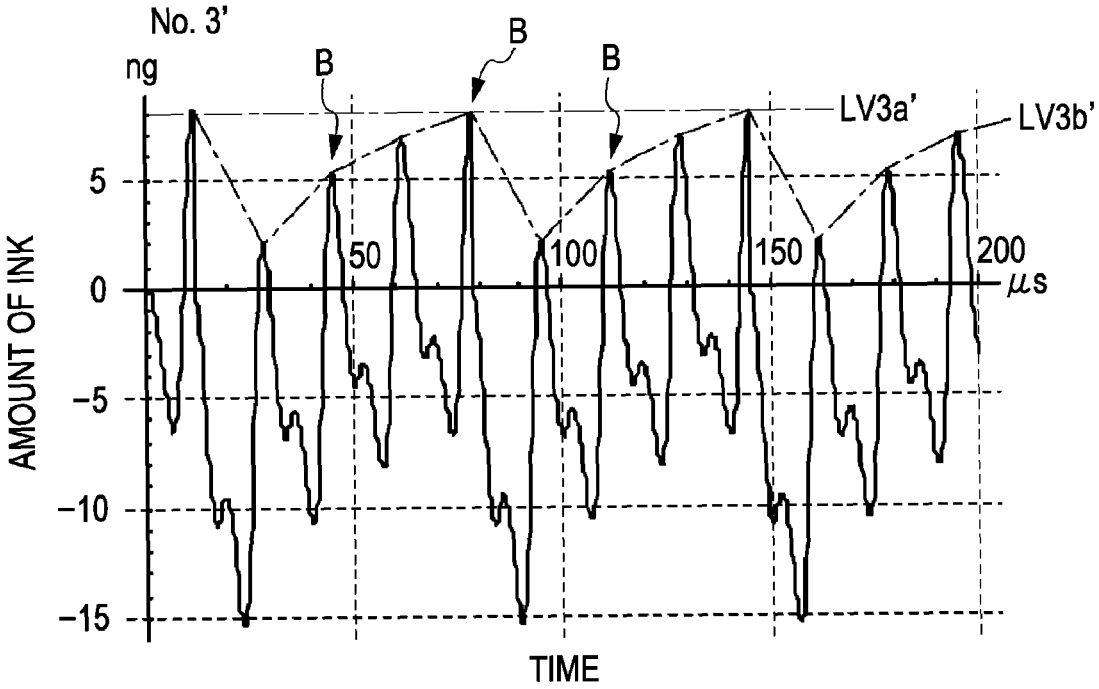
FIG. 48 illustrates results of a simulation in which No. 3' head is ejection-driven at 60 kHz.
Figure 49:
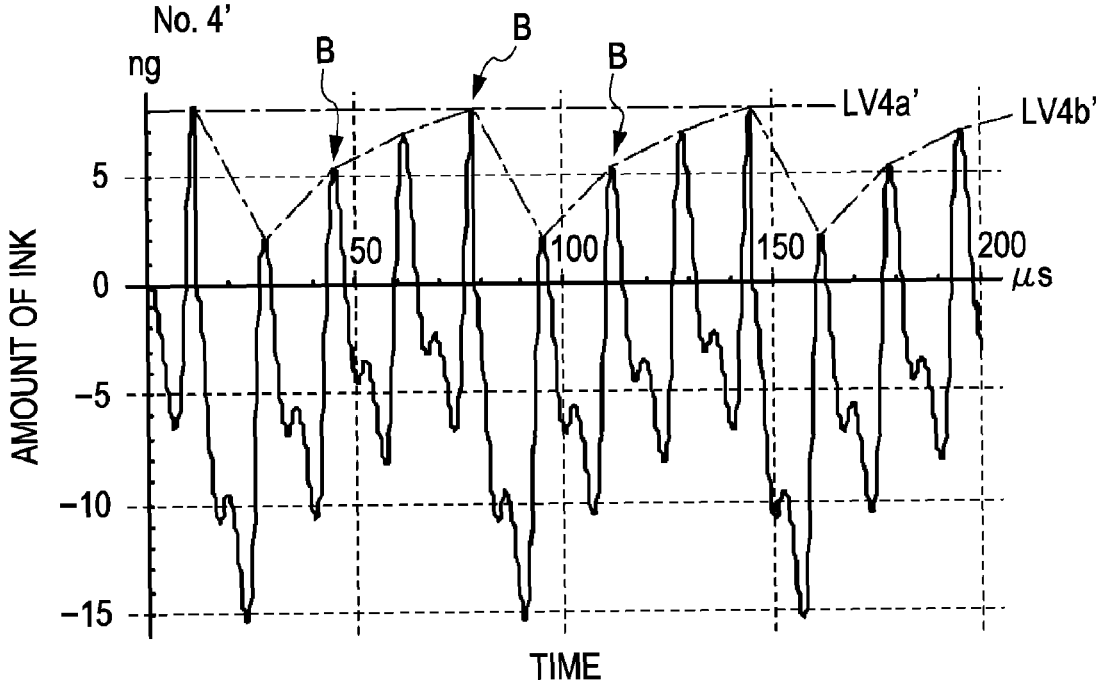
FIG. 49 illustrates results of a simulation in which No. 4' head is ejection-driven at 60 kHz.
Figure 50:
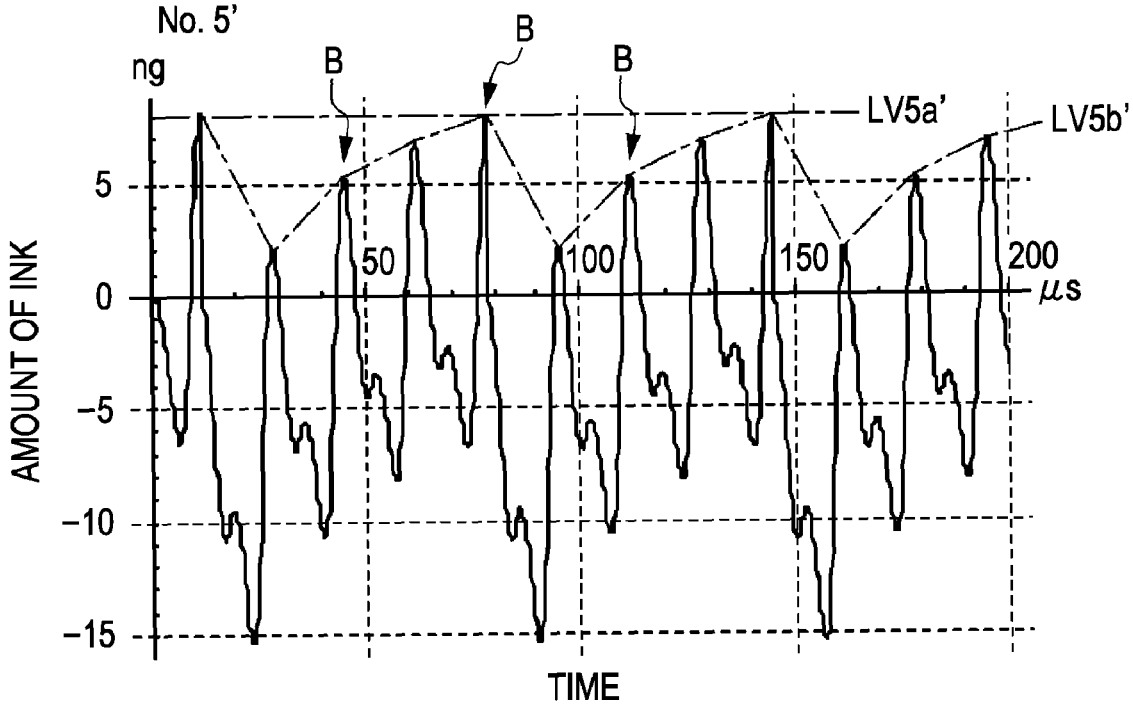
FIG. 50 illustrates results of a simulation in which No. 5' head is ejection-driven at 60 kHz.
Figure 51:
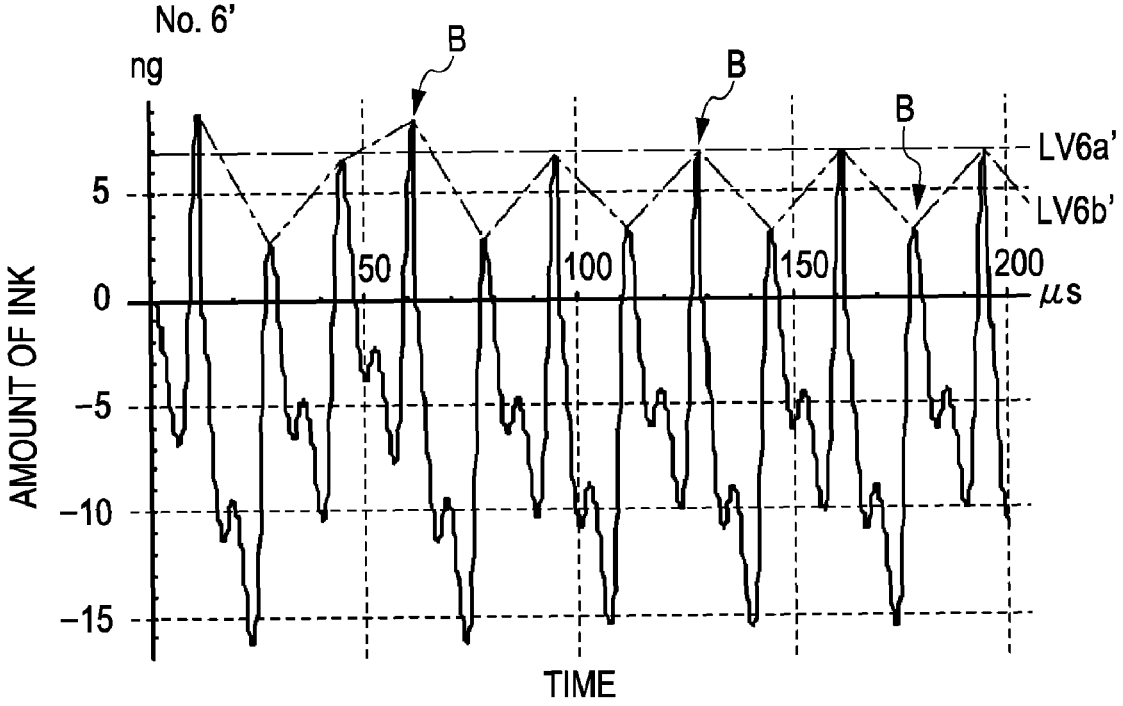
FIG. 51 illustrates results of a simulation in which No. 6' head is ejection-driven at 60 kHz.
Figure 52:
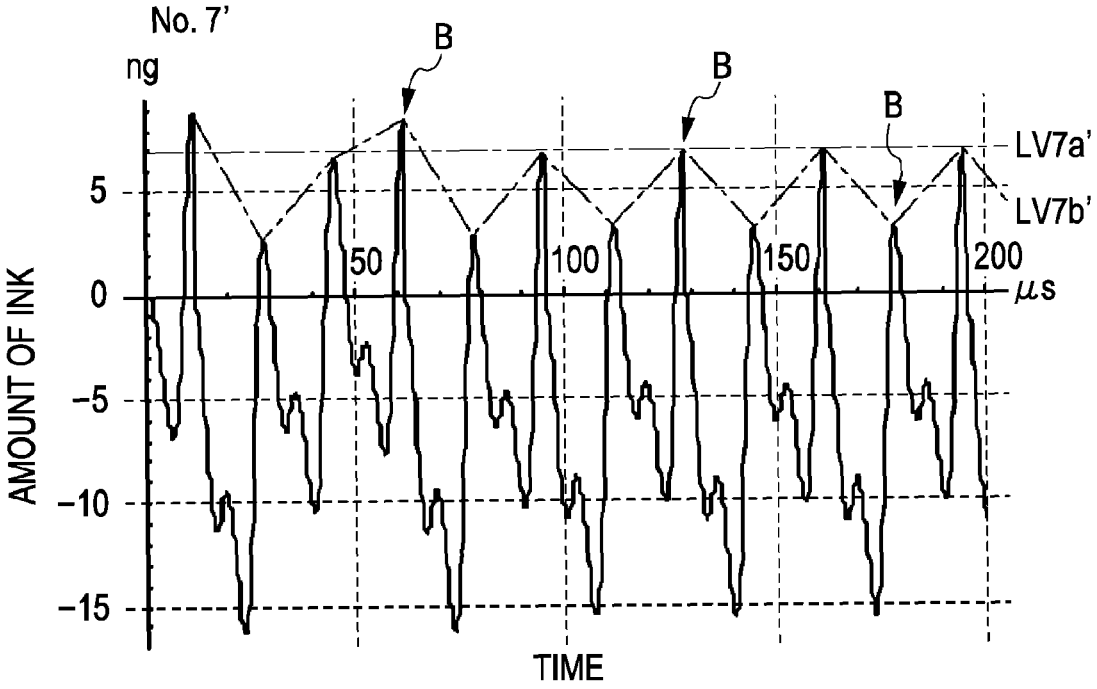
FIG. 52 illustrates results of a simulation in which No. 7' head is ejection-driven at 60 kHz.
Figure 53:
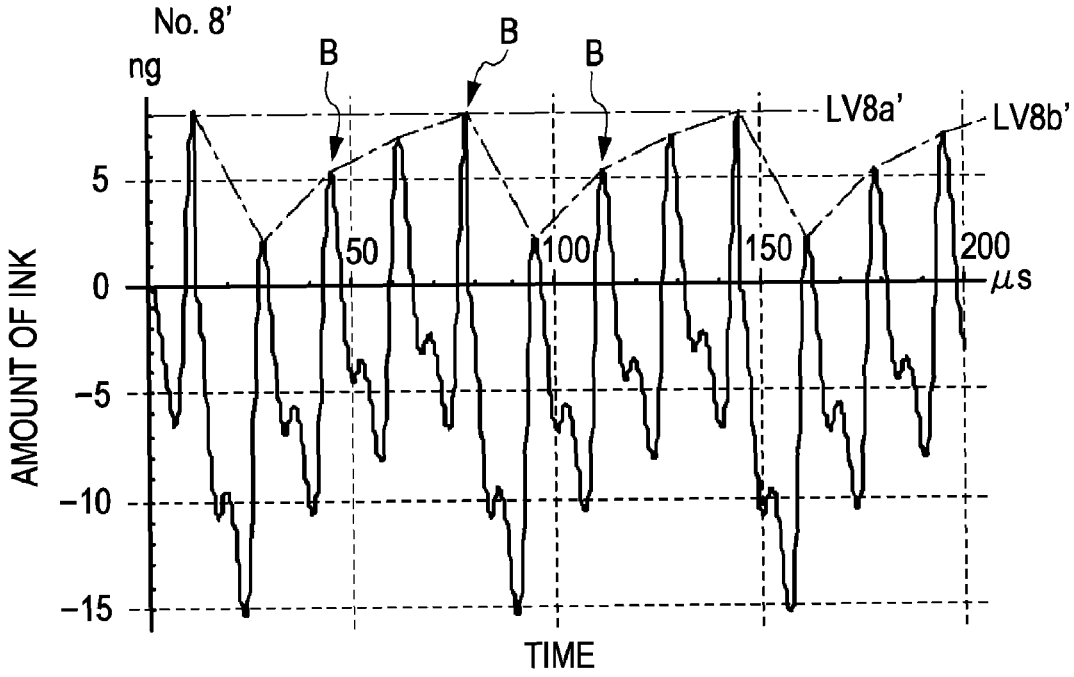
FIG. 53 illustrates results of a simulation in which No. 8' head is ejection-driven at 60 kHz.
Figure 54:
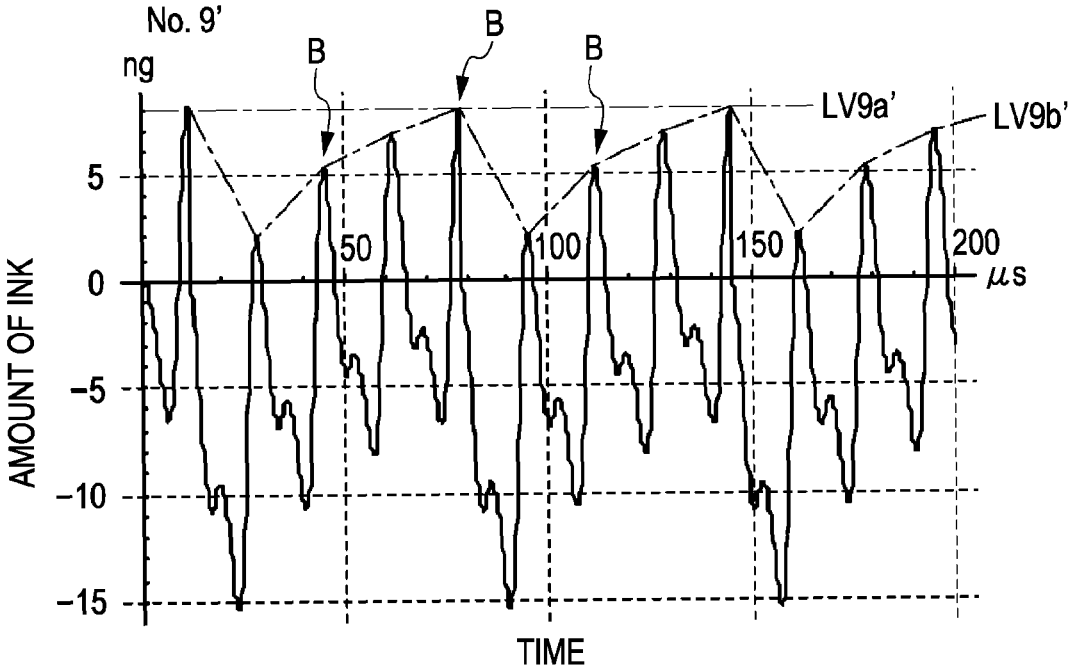
FIG. 54 illustrates results of a simulation in which No. 9' head is ejection-driven at 60 kHz.
Figure 55:
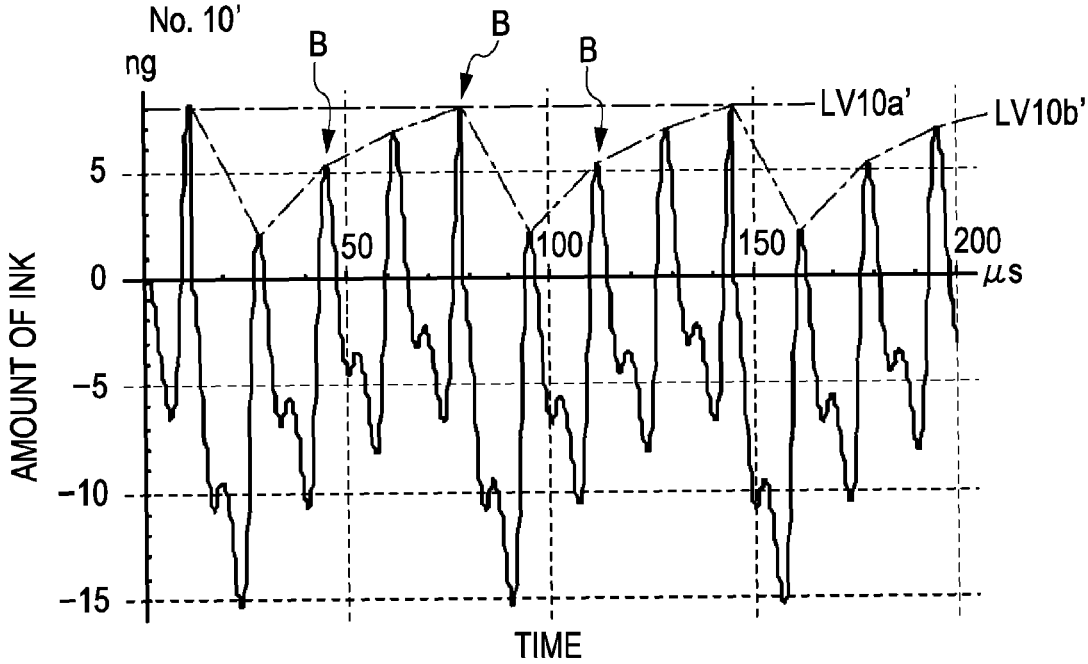
FIG. 55 illustrates results of a simulation in which No. 10' head is ejection-driven at 60 kHz.
Figure 56:
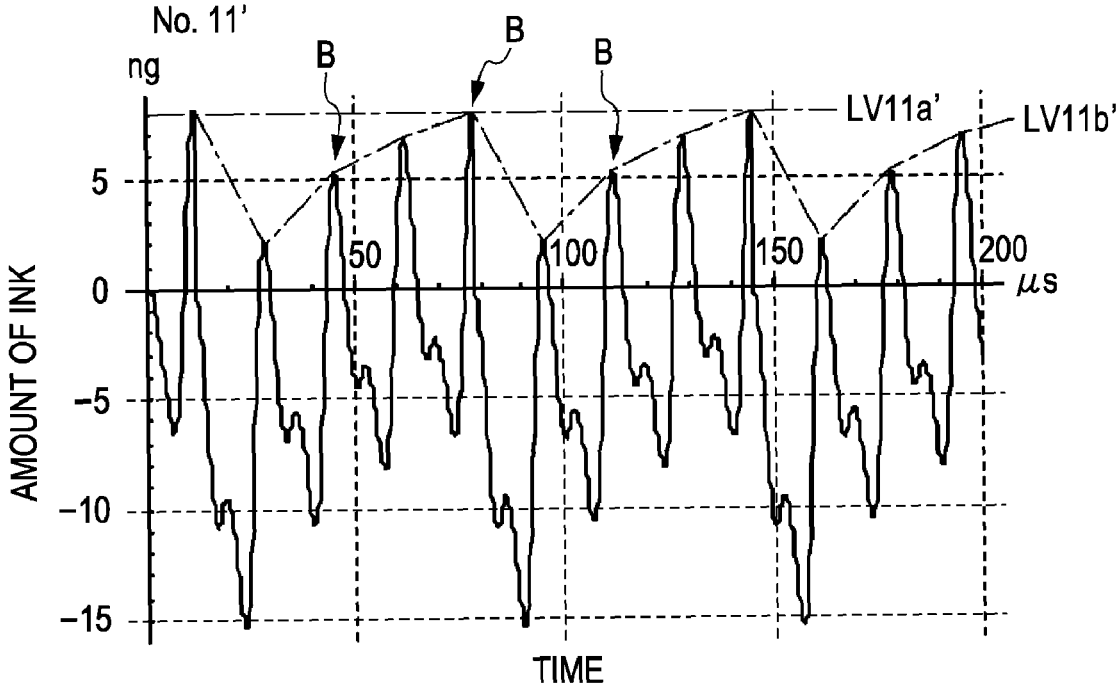
FIG. 56 illustrates results of a simulation in which No. 11' head is ejection-driven at 60 kHz.
Figure 57:
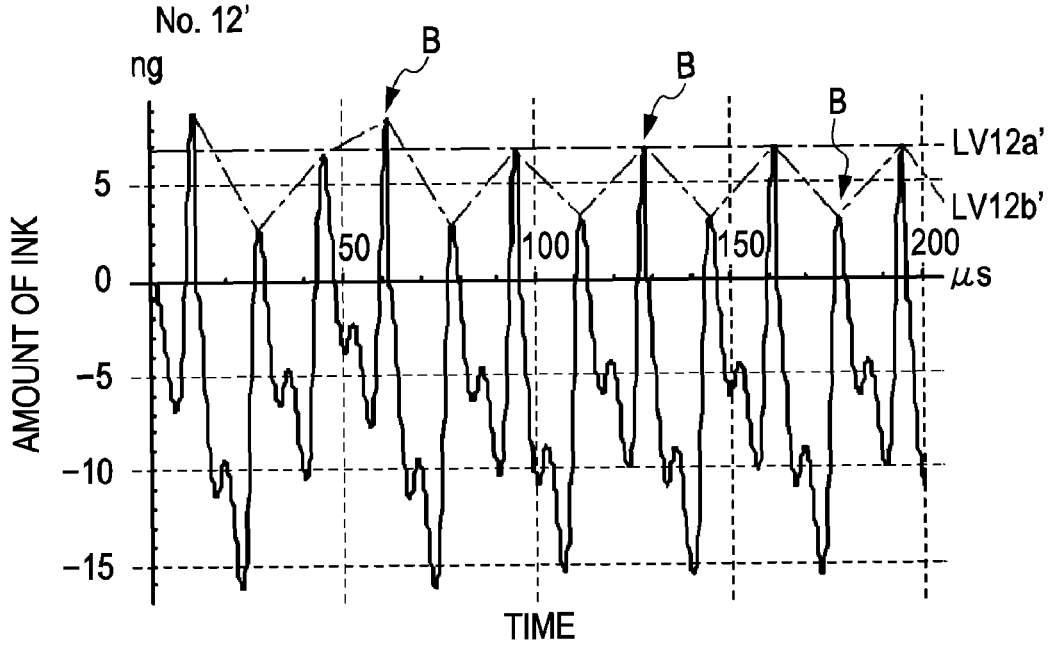
FIG. 57 illustrates results of a simulation in which No. 12' head is ejection-driven at 60 kHz.

When the other ejection pulse PS2 is applied to the piezoelectric element 433, ink is ejected through the nozzle 427. The meniscus behaves in the same manner as when the previously described ejection pulse PS1 is applied to the piezoelectric element 433. If simply described, ink within the pressure compartment 424 is depressurized in response to the depressurized portion P11, and the meniscus is drawn to the pressure compartment 424. The movement of the meniscus continues during the application of the voltage held portion P12. At the timing the meniscus reverses the movement (at timing denoted by the letter A in FIG. 42), the pressurized portion P13 is applied. The ink within the pressure compartment 424 is thus pressurized, causing the meniscus to be extended in a column-like shape. At timing B, an end portion of the meniscus is ejected as an ink drop. In reaction to the ejection, the meniscus is quickly drawn back to the pressure compartment 424 and then reverses the movement again (at timing denoted by the letter C). At timing D, the application of a next ejection pulse PS starts Evaluation Results FIG. 41 illustrates structural parameters of the heads HD to be evaluated. FIG. 41 corresponds to the previously discussed FIG. 7. The heads HD have the same structure as the ones previously described, but for convenience of explanation, the heads HD evaluated using the other ejection pulse PS2 are identified by attaching the prime symbol (') to the head number. No. 13' head HD through No. 16' head HD, out of the heads evaluated, are the heads of the embodiment of the invention. No. 1' head HD through No. 12' head HD are comparative heads.

FIGS. 42-57 illustrate results of simulations in which No. 1' head HD through No. 16' head HD eject ink drops, each having a viscosity of 6 mPa·s.

FIGS. 42-45 show that No. 13' head HD through No. 16' head HD eject uniform ink drops with each drop larger than the standard value (10 ng) even at a frequency as high as 60 kHz. Even if the ejection pulse PS2 is used, the ink drops, each drop equal to or larger than the standard value, are ejected at the high frequency in the same manner as when the ejection pulse PS1 is used.

On the other hand, if the ink drops are ejected using the comparative No. 1' head HD through No. 12' head HD at the high frequency as illustrated in FIGS. 46-57, the maximum ejection amount fails to reach the standard value (as represented by lines LV1*a*'-LV12*a*'), and the ejection amount suffers from a periodic change (as represented by lines LV1*b*'-LV12*b*').

These results show that the degree of difference is identical to the degree of difference when the ejection pulse PS1 is used. More specifically, the channel flow resistance R425 of the ink supply 425 is set to be within a range from equal to or higher than the channel flow resistance R424 of the pressure compartment 424 to equal to or lower than twice the channel flow resistance R424 of the pressure compartment 424, and the length L424 of the pressure compartment 424 is set to be within a range of from equal to or longer than the length L425 of the ink supply 425 to equal to or shorter than twice the length L425 of the ink supply 425. With this arrangement, ink drops, each drop equal to or heavier than 10 ng, can be ejected at a frequency as high as 60 kHz even if the other ejection pulse PS2 is used.

Alternative Embodiments

The above-described embodiment is related to the printing system including the printer 1 as the liquid ejecting apparatus. The embodiment includes the liquid ejecting method, the liquid ejecting system, the setting method of the ejection pulse, etc. The embodiment described above is provided for the understanding of the invention, and is not intended to limit the scope of the invention. The invention can be changed or modified without departing from the scope of the invention. Equivalents of the embodiment also falls within the scope of the invention. Embodiments to be discussed below also fall within the scope of the invention.

Other Heads HD

Figure 58:
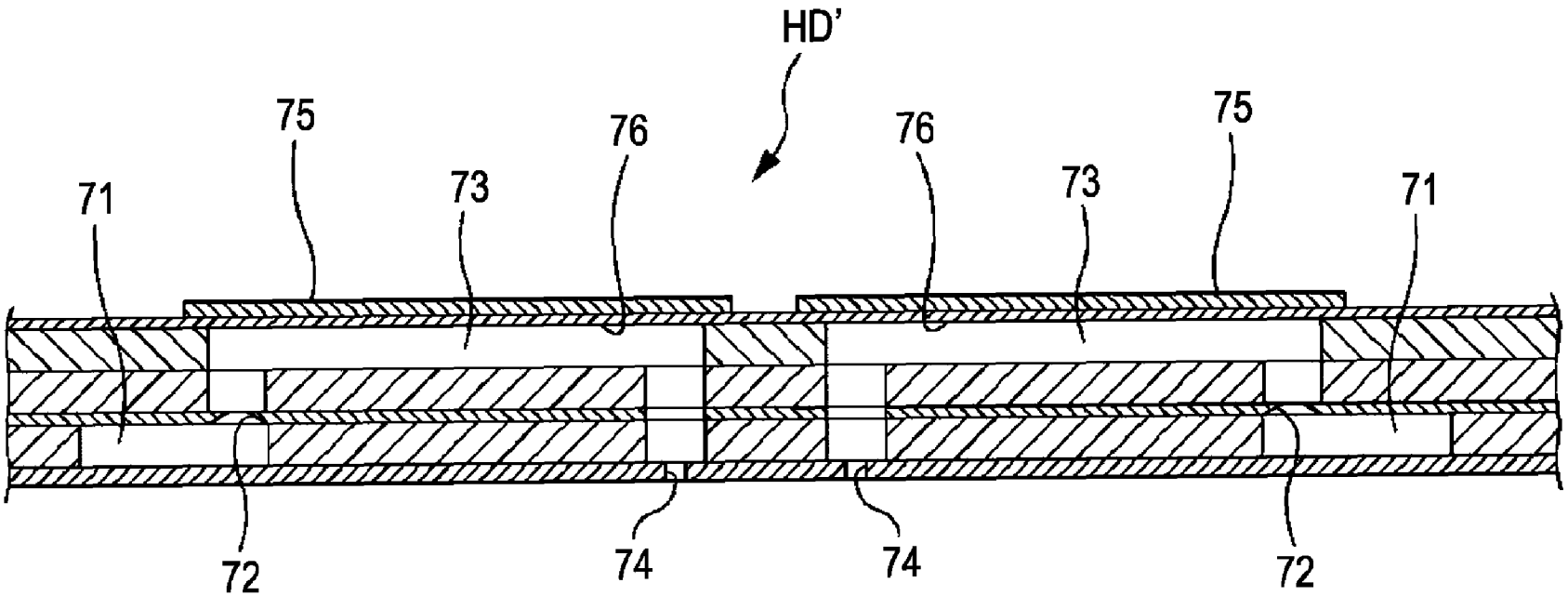
FIG. 58 is a sectional view illustrating another head.

The above-described head HD includes the piezoelectric element 433 of a type that operates to increase the volume of the pressure compartment 424 in response to a high voltage level of the ejection pulse PS (PS1 and PS2). A head of a different type may be used. Another head HD' illustrated in FIG. 58 includes a piezoelectric element 75 of a type that operates to decrease the volume of the pressure compartment 424 in response to a high voltage level of the ejection pulse PS.

If discussed simply, the other head HD' includes a common ink compartment 71, an ink supply port 72, a pressure compartment 73, and a nozzle 74. The head HD' includes a plurality of ink channels, each extending from the common ink compartment 71 to the pressure compartment 73 to the nozzles 74, corresponding to the nozzles 74. The pressure compartment 73 in the head HD' also changes the volume thereof in response to the operation of the piezoelectric element 75. More specifically, a portion of the pressure compartment 73 is defined by a vibration plate 76, and the piezoelectric element 75 is arranged on the surface of the vibration plate 76 opposed to the pressure compartment 73.

A plurality of piezoelectric elements 75 are arranged respectively for the pressure compartments 73. Each piezoelectric element 75 includes an upper electrode, a lower electrode, and a piezoelectric body sandwiched between the two electrodes (all these elements not shown). By providing a voltage difference between the two electrodes, the piezoelectric element 75 changes the shape thereof. In this example, the piezoelectric body is charged when the voltage of the upper electrode is raised. The piezoelectric element 75 is deformed, thereby becoming convex toward the pressure compartment 73. The pressure compartment 73 thus constricts. In the other head HD', a section defining the pressure compartment 73 in the vibration plate 76 corresponds to the defined section.

The head HD' also changes the pressure of the ink within the pressure compartment 73, and ejects an ink drop using the pressure change. The behavior of the ink within the pressure compartment 73 at the ejection of the ink drop remains unchanged from that in the previously discussed head HD. The same effect and advantages as those of the previously discussed head HD are also provided by adjusting the length of the pressure compartment 73 and the length of the ink supply port 72.

Element Performing Ejection Operation

The heads HD and HD' respectively include the piezoelectric elements 433 and 75 for ejecting ink drops. The element for performing the ejection operation is not limited to the piezoelectric elements 433 and 75. For example, the element may be a magnetostrictive element. The use of each of the piezoelectric elements 433 and 75 provides the advantage that the volume of each of the piezoelectric elements 433 and 75 is accurately controlled in response to the voltage of the ejection pulse PS.

Shape of the Nozzle 427 and the Ink Supply 425

In accordance with the above-described embodiment, the nozzle 427 is formed in a funnel-like hole penetrating the nozzle plate 422 in the thickness direction thereof. The ink supply 425 has a rectangular opening shape, and defines a hole communicating with the pressure compartment 424 and the common ink container 426. In other words, the ink supply 425 is a communicating hole having a rectangular column space.

Figure 61A:
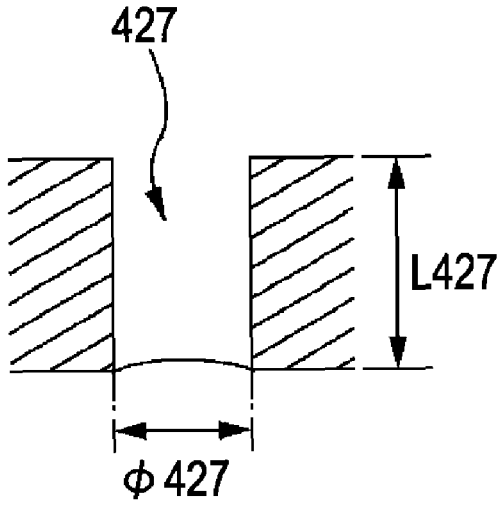
FIG. 61A is an expanded view of a nozzle having only a straight portion.

Each of the nozzle 427 and the ink supply 425 takes a variety of shapes. For example, as illustrated in FIG. 61A, the nozzle 427 may define a cylindrical column having a constant cross section in a plane perpendicular to the nozzle direction. In other words, the nozzle 427 may have only the previously described straight portion 427*b*.

Figure 61B:
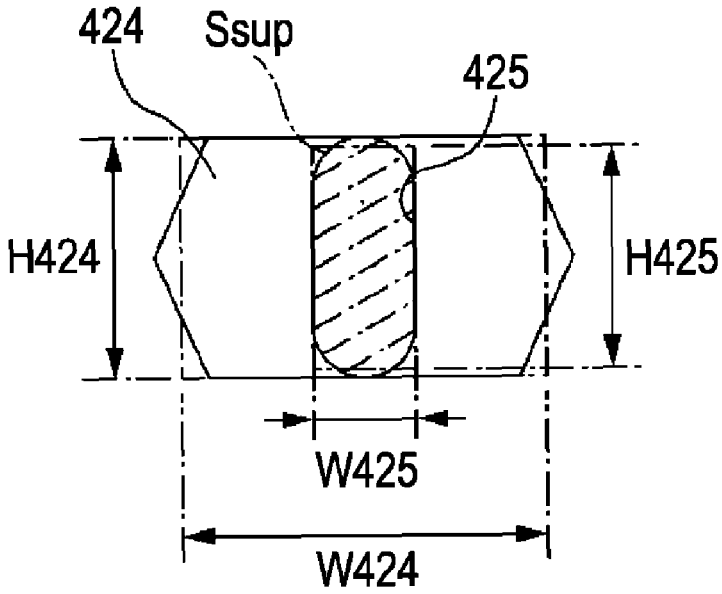
FIG. 61B illustrates a modified example of an ink supply unit channel and a pressure compartment.

Referring to FIG. 61B, the ink supply 425 may have a channel having a oval opening (a shape with two semicircles having the same radius connected by two external tangents). In this case, a section area Ssup of the ink supply 425 is represented by the hatched oval shape. The ink supply 425 having such an oval opening may be analyzed using a channel having a rectangular opening, the area of which equals the area of the overall opening. In this case, the height H425 of the ink supply 425 is slightly higher than the maximum height of the actual ink supply 425. The same is true even if the opening of the ink supply 425 is elliptical.

The above discussion also applies to the pressure compartment 424. Referring to FIG. 61B, if the cross section of the pressure compartment 424 in a plane perpendicular to the longitudinal direction of the pressure compartment 424 is an elongated hexagon, a channel having the same section area as the elongated hexagon may be defined, and then analyzed. More specifically, a channel having a rectangular cross section having a height H424 and a width W424 slightly smaller than the maximum width of the pressure compartment 424 may be defined and then analyzed.

Other Applications

The liquid ejecting apparatus is the printer 1 in the above discussion. The application of the liquid ejecting apparatus is not limited to the printer. The technique of the above-described embodiment is applicable to a variety of liquid ejecting apparatuses implementing the ink jet technique. Such liquid ejecting apparatuses include a color filter manufacturing apparatus, a dyeing apparatus, a precision machining apparatus, a semiconductor device manufacturing apparatus, a surface treatment apparatus, a 3D modeling apparatus, a liquid vaporization apparatus, an organic EL manufacturing apparatus (in particular, a polymer EL manufacturing apparatus), a display manufacturing apparatus, a coating apparatus, and a DNA chip manufacturing apparatus. The invention is also applicable to the method of each of the apparatuses and the manufacturing method of each of the apparatuses.

The entire disclosure of Japanese Patent Applications No: 2008-050545, filed Feb. 29, 2008 and No: 2008-305332, filed Nov. 28, 2008 are expressly incorporated by reference herein.

What is claimed is:

1. A liquid ejecting method, comprising ejecting a liquid through a liquid ejecting head, wherein viscosity of the liquid falls within a range of from equal to or higher than 6 mPa·s to equal to or lower than 15 mPa·s, and wherein the liquid ejecting head includes:

a nozzle that ejects the liquid, a pressure compartment that causes a change in the pressure of the liquid in order to eject the liquid through the nozzle, and a supply unit that communicates with the pressure compartment and supplies the liquid to the pressure compartment, wherein a channel flow resistance of the supply unit falls within a range of from equal to or higher than a channel flow resistance of the pressure compartment to equal to or lower than twice the channel flow resistance of the pressure compartment, and wherein a channel length of the pressure compartment falls within a range of from equal to or longer than a channel length of the supply unit to equal to or shorter than twice the channel length of the supply unit.

2. The liquid ejecting method according to claim 1, wherein a channel flow resistance of the nozzle is higher than the channel flow resistance of the supply unit.

3. The liquid ejecting method according to claim 1, wherein inertance of the nozzle is lower than inertance of the supply unit.

4. The liquid ejecting method according to claim 1, wherein the channel flow resistance of the supply unit falls within a range of from equal to or higher than $1.73\times10^{12}$ Pa·s/m$^3$ to equal to or lower than $3.46\times10^{12}$ Pa·s/m$^3$, and wherein the channel length of the pressure compartment falls within a range of from equal to or longer than 500 μm to equal to or shorter than 1000 μm.

5. The liquid ejecting method according to claim 4, wherein a diameter of the nozzle falls within a range of from equal to or larger than 10 μm to equal to or smaller than 40 μm, and wherein a length of the nozzle falls within a range of from equal to or longer than 40 μm to equal to or shorter than 100 μm.

6. The liquid ejecting method according to claim 1, wherein the pressure compartment comprises a section, the section changing the shape thereof to cause a change in the pressure of the liquid.

7. The liquid ejecting method according to claim 6, wherein the liquid ejecting head comprises an element that changes the section in shape in response to a change pattern of a voltage of an applied ejection pulse.

8. A liquid ejecting head, comprising:

a nozzle that ejects a liquid, a pressure compartment that causes a change in the pressure of the liquid in order to eject the liquid through the nozzle, and a supply unit that communicates with the pressure compartment and supplies the liquid to the pressure compartment, wherein viscosity of the liquid falls within a range of from equal to or higher than 6 mPa·s to equal to or lower than 15 mPa·s, wherein a channel flow resistance of the supply unit falls within a range of from equal to or higher than a channel flow resistance of the pressure compartment to equal to or lower than twice the channel flow resistance of the pressure compartment, and wherein a channel length of the pressure compartment falls within a range of from equal to or longer than a channel length of the supply unit to equal to or shorter than twice the channel length of the supply unit.

9. The liquid ejecting head according to claim 8, wherein a channel flow resistance of the nozzle is higher than the channel flow resistance of the supply unit.

10. The liquid ejecting head according to claim 8, wherein inertance of the nozzle is lower than inertance of the supply unit.

11. The liquid ejecting head according to claim 8, wherein the channel flow resistance of the supply unit falls within a range of from equal to or higher than $1.73\times10^{12}$ Pa·s/m$^3$ to equal to or lower than $3.46\times10^{12}$ Pa·s/m$^3$, and wherein the channel length of the pressure compartment falls within a range of from equal to or longer than 500 μm to equal to or shorter than 1000 μm.

12. The liquid ejecting head according to claim 11, wherein a diameter of the nozzle falls within a range of from equal to or larger than 10 μm to equal to or smaller than 40 μm, and wherein a length of the nozzle falls within a range of from equal to or longer than 40 μm to equal to or shorter than 100 μm.

13. The liquid ejecting head according to claim 8, wherein the pressure compartment comprises a section, the section changing the shape thereof to cause a change in the pressure of the liquid.

14. The liquid ejecting head according to claim 13, wherein the liquid ejecting head comprises an element that changes the section in shape in response to a change pattern of a voltage of an applied ejection pulse.

15. A liquid ejecting apparatus, comprising:

an ejection pulse generator that generates an ejection pulse, and a liquid ejecting head that ejects a liquid through a nozzle, wherein the liquid ejecting heads includes:

a pressure compartment that changes a shape of a section to cause a change in the pressure of the liquid so that the liquid is ejected through the nozzle, an element that changes the shape of the section in response to a change pattern of a voltage of an applied ejection pulse, a supply unit that communicates with the pressure compartment and supplies the liquid to the pressure compartment, wherein viscosity of the liquid falls within a range of from equal to or higher than 6 mPa·s to equal to or lower than 15 mPa·s, wherein a channel flow resistance of the supply unit falls within a range of from equal to or higher than a channel flow resistance of the pressure compartment to equal to or lower than twice the channel flow resistance of the pressure compartment, and wherein a channel length of the pressure compartment falls within a range of from equal to or longer than a channel length of the supply unit to equal to or shorter than twice the channel length of the supply unit.

* * * * *